US011066815B2

(12) United States Patent
O'Neill et al.

(10) Patent No.: US 11,066,815 B2
(45) Date of Patent: Jul. 20, 2021

(54) OUTLET BOX

(71) Applicant: Accor Technology, Inc., Kirkland, WA (US)

(72) Inventors: Jerry Edward O'Neill, Kirkland, WA (US); Charlie E Whitney, East Wenatchee, WA (US)

(73) Assignee: Accor Technology, Inc., Kirkland, WA (US)

( * ) Notice: Subject to any disclaimer, the term of this patent is extended or adjusted under 35 U.S.C. 154(b) by 65 days.

(21) Appl. No.: 16/539,279

(22) Filed: Aug. 13, 2019

(65) Prior Publication Data

US 2019/0360181 A1 Nov. 28, 2019

Related U.S. Application Data

(63) Continuation of application No. 15/721,589, filed on Sep. 29, 2017, now Pat. No. 10,385,554.

(60) Provisional application No. 62/402,896, filed on Sep. 30, 2016.

(51) Int. Cl.

| | |
|---|---|
| ***E03C 1/02*** | (2006.01) |
| ***E03B 7/09*** | (2006.01) |
| ***D06F 39/08*** | (2006.01) |
| *E03C 1/184* | (2006.01) |

(52) U.S. Cl.

CPC ..... *E03C 1/021* (2013.01); *D06F 39/08* (2013.01); *E03B 7/095* (2013.01); *E03C 1/184* (2013.01); *Y10T 137/698* (2015.04)

(58) Field of Classification Search

CPC ..... E03B 7/095; E03C 1/021; Y10T 137/798

See application file for complete search history.

(56) References Cited

U.S. PATENT DOCUMENTS

| | | | | | |
|---|---|---|---|---|---|
| 2,952,271 | A ‡ | 9/1960 | Dick | D06F 39/08 | 137/360 |
| 3,470,901 | A * | 10/1969 | Nisley | F16L 27/12 | 137/360 |
| 4,716,925 | A ‡ | 1/1988 | Prather | D06F 39/08 | 137/36 |
| 5,050,632 | A * | 9/1991 | Means, Jr. | E03C 1/021 | 137/360 |

(Continued)

*Primary Examiner* — Kevin F Murphy

(74) *Attorney, Agent, or Firm* — George C. Rondeau, Jr.; Davis Wright Tremain, LLP

(57) ABSTRACT

A utility box for mounting at least in part within a wall for use with a fluid carrying supply pipe, the box comprising, a housing including a top wall, a bottom wall, a first side wall and a second side wall, a back wall and a front opening providing access into an interior of the housing defined by the top, bottom, first side, second side and back walls, a bottom wall aperture in the bottom wall sized for extending the pipe through the bottom wall aperture with the pipe terminating in a free end portion positioned within the interior of the housing at a location above the bottom wall, a valve attachable to the free end portion of the pipe, the junction of the valve and the pipe being within the interior of the housing above the bottom wall, and a first seal positioned to provide a fluid-tight seal between the bottom wall and the pipe to prevent fluid within the interior of the housing from passing out of the interior of the housing through the bottom wall aperture.

61 Claims, 84 Drawing Sheets

(56) References Cited

U.S. PATENT DOCUMENTS 5,305,785 A ‡ 4/1994 Humber ..... F16L 5/00 137/36
5,566,708 A ‡ 10/1996 Hobbs, Jr. ..... F16L 19/02 137/360
6,125,881 A * 10/2000 Hobbs ..... D06F 39/08 137/360
6,148,850 A ‡ 11/2000 Kopp ..... D06F 39/08 137/35
6,155,286 A ‡ 12/2000 Geary ..... D06F 39/08 137/36
6,732,758 B2 ‡ 5/2004 Kopp ..... A47L 15/4217 137/207
7,204,267 B1 * 4/2007 Persico ..... E03C 1/021 137/357
7,270,144 B2 ‡ 9/2007 Minnick ..... B05C 5/0216 137/36
7,686,346 B1 ‡ 3/2010 Buccicone ..... F16L 41/021 285/12
9,388,555 B2 ‡ 7/2016 Whitehead et al. ..... F25C 1/25
9,394,674 B2 ‡ 7/2016 Whitehead et al. .... E03C 1/021
9,518,381 B2 ‡ 12/2016 Whitehead et al. .... E03C 1/021
9,650,765 B2 ‡ 5/2017 Whitehead et al. ..... F25C 1/25
9,650,766 B2 ‡ 5/2017 Whitehead et al. .... E03C 1/021
2002/0134431 A1 ‡ 9/2002 Kopp ..... A47L 15/4217 137/36
2007/0215211 A1 ‡ 9/2007 Minnick ..... B05C 5/0216 137/36
2010/0132810 A1 * 6/2010 Pompian ..... F16L 5/00 137/356
2012/0042963 A1 ‡ 2/2012 Sanzone ..... E03C 1/021 137/31
2014/0352798 A1 ‡ 12/2014 Clarke e ..... E03C 1/021 137/15
2015/0197923 A1 ‡ 7/2015 Whitehead ..... F25C 1/25 137/36
2016/0108608 A1 ‡ 4/2016 Williams ..... E03C 1/284 137/15.08
2016/0298319 A1 ‡ 10/2016 Whitehead ..... E03C 1/021

* cited by examiner
‡ imported from a related application

OUTLET BOX

RELATED APPLICATIONS

This application is a continuation of U.S. patent application Ser. No. 15/721,589, filed Sep. 29, 2017 which claims benefit of U.S. Provisional Application No. 62/402,896, filed on Sep. 30, 2016, the entire disclosures and content of which are hereby incorporated by reference in their entirety.

FIELD OF INVENTION

The invention relates to outlet boxes for mounting in a wall, and more particularly, to outlet boxes having a housing with one or more apertures for installing fixtures for utilities, such as water.

BACKGROUND

Utility outlet boxes may be installed in building walls to provide access and/or disposal points for utilities, such as water. In one application, outlet boxes may be installed within building walls during the construction or renovation, and pipes and/or fixtures may be connected to the outlet boxes. Leaks that develop in the outlet box, such as in the connected pipes and/or fixtures connected thereto, may be difficult to discover because water drains out of the outlet box. Water leaking in the outlet box may drain or otherwise intrude into interior portions of the surrounding wall potentially causing mold or water damage. Additionally, even if the leak is discovered, removal of a portion of the wall or removal of the outlet box from the wall or may be required to repair or discover the offending leak. Accordingly, there is a need for an outlet box that prevents water leaks from intruding into the surrounding building walls, that increases detectability of leaks, and that improves ease of repair of leaky fixtures and/or pipes connected to the outlet box.

Previously-implemented outlet boxes may also be difficult to mount to building walls and may not be securely attached when mounted thereto. For example, some currently existing methods for attachment of outlet boxes include securing the outlet boxes using straps. However, straps may require access to the rear of the outlet box during installation, and not provide adequate structural support for the outlet box alone. There is therefore the need for an apparatus that facilitates an easier and more secure means of mounting the outlet boxes within building walls.

Previously-implemented outlet boxes are also configured for use in a single application, such as installing a water fixture for supplying water to an appliance. Installation of additional boxes may be necessary to provide additional drains, an air admittance valve, or additional water supply valves, for example. Therefore, currently existing outlet boxes do not provide sufficient versatility for installing different combinations of fixtures.

Further, previously-implemented outlet boxes do not easily accommodate attachment of differently sized pipes or different fixtures, and do not allow for pipes and/or fixtures to be connected to the outlet boxes at different positions. For example, a pipe above an outlet box may need to be routed to the underside of the utility box because the top of the utility box does not include an appropriate receptacle for receiving the pipe. Even when the previously-implemented outlet box installed in the building wall has an appropriately located receptacle for receiving a pipe (e.g., at the bottom), the receptacle may not be appropriately sized for connecting the pipe. The previously-implemented may not allow for installation of fixtures having differently sized attachment portions.

DETAILED DESCRIPTION

Figure 1:
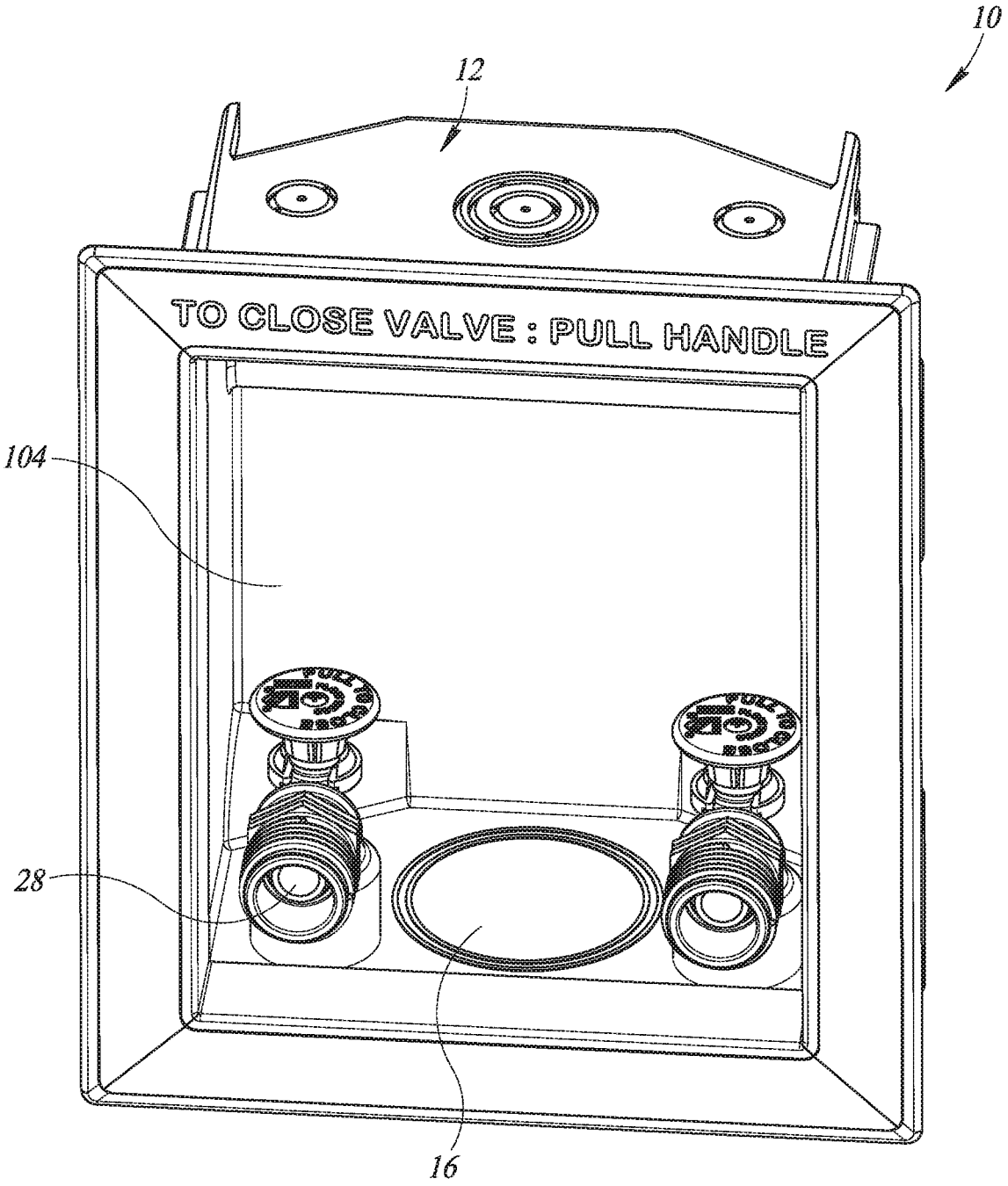
FIG. 1 illustrates a perspective view of a utility box according to a first embodiment.

A utility box 10 according to a first embodiment is shown in FIG. 1. The utility box 10 is configured to be installed in the wall of a residential or commercial building to provide one or more access and/or disposal points for utilities. The utility box 10 may be comprised of a rigid waterproof material, such as plastics, polymers, or polyvinyl chloride (PVC); however, other similar materials are contemplated. In this first embodiment, the utility box 10 is configured to provide water access and disposal points for appliances, such as washing machines, dishwashers and ice makers; however, those of ordinary skill in the art will recognize that the configuration of the utility box may be suitable for other applications.

Figure 5:
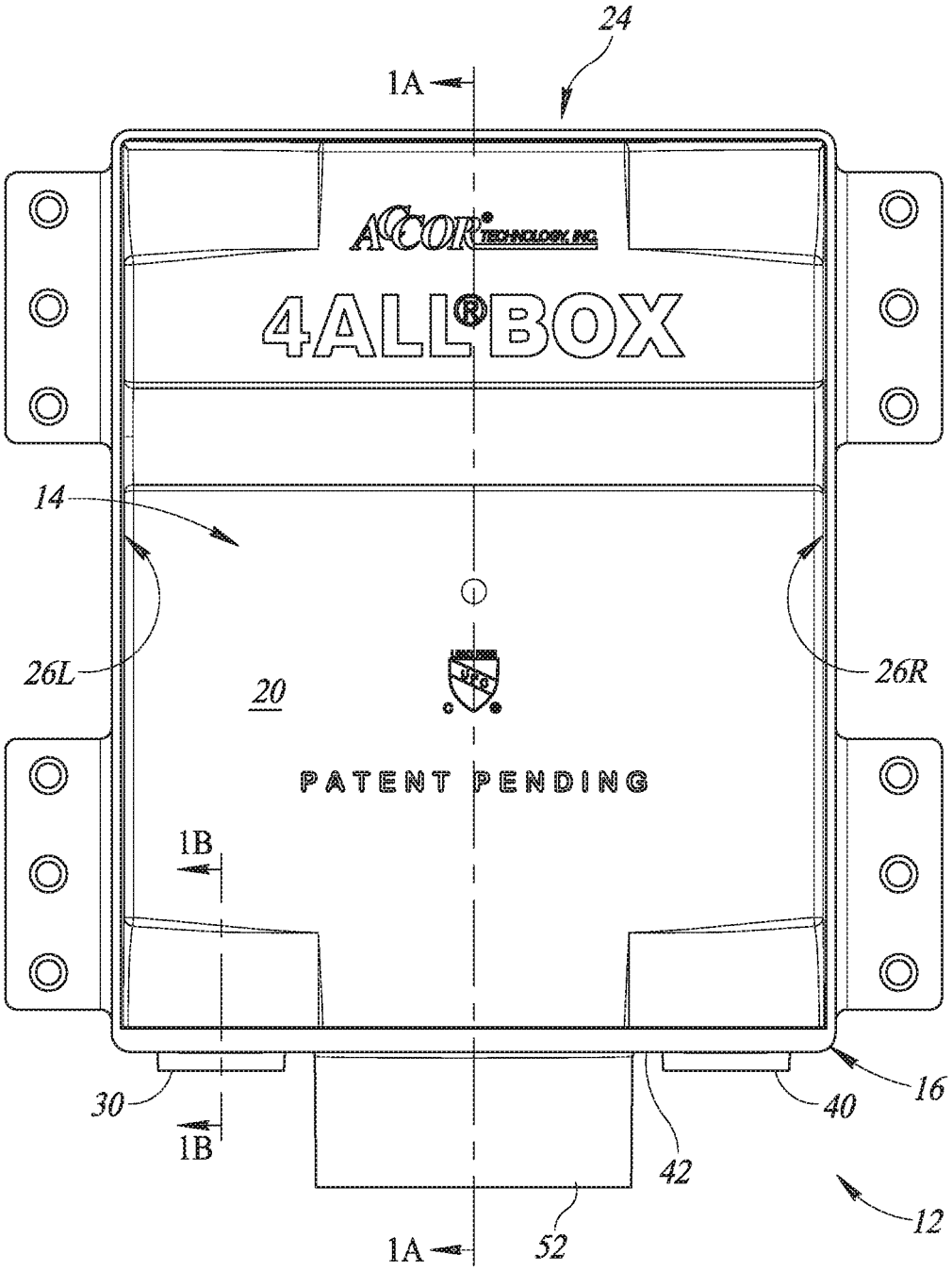
FIG. 5 illustrates a front view of a box main housing of the utility box of FIG. 1.

The utility box 10 includes a box main housing 12 having a generally three-dimensional square or rectangular outer shape, as shown in FIGS. 5, 6, 7, 8A, 10 and 11. A forwardly opening cavity portion 14 is defined by housing walls 16 extending rearwardly from an opening 18 and terminating at a rear wall 20. The housing walls 16 are comprised of a lower wall 22, an upper wall 24 opposite to the lower wall, and opposing left and right sidewalls 26L and 26R, as shown in FIG. 5. The opening 18 is sized to allow a user's hand to reach into the cavity portion 14 for operation, installation and removal of water valves and drains therein, as described below.

Figure 2:
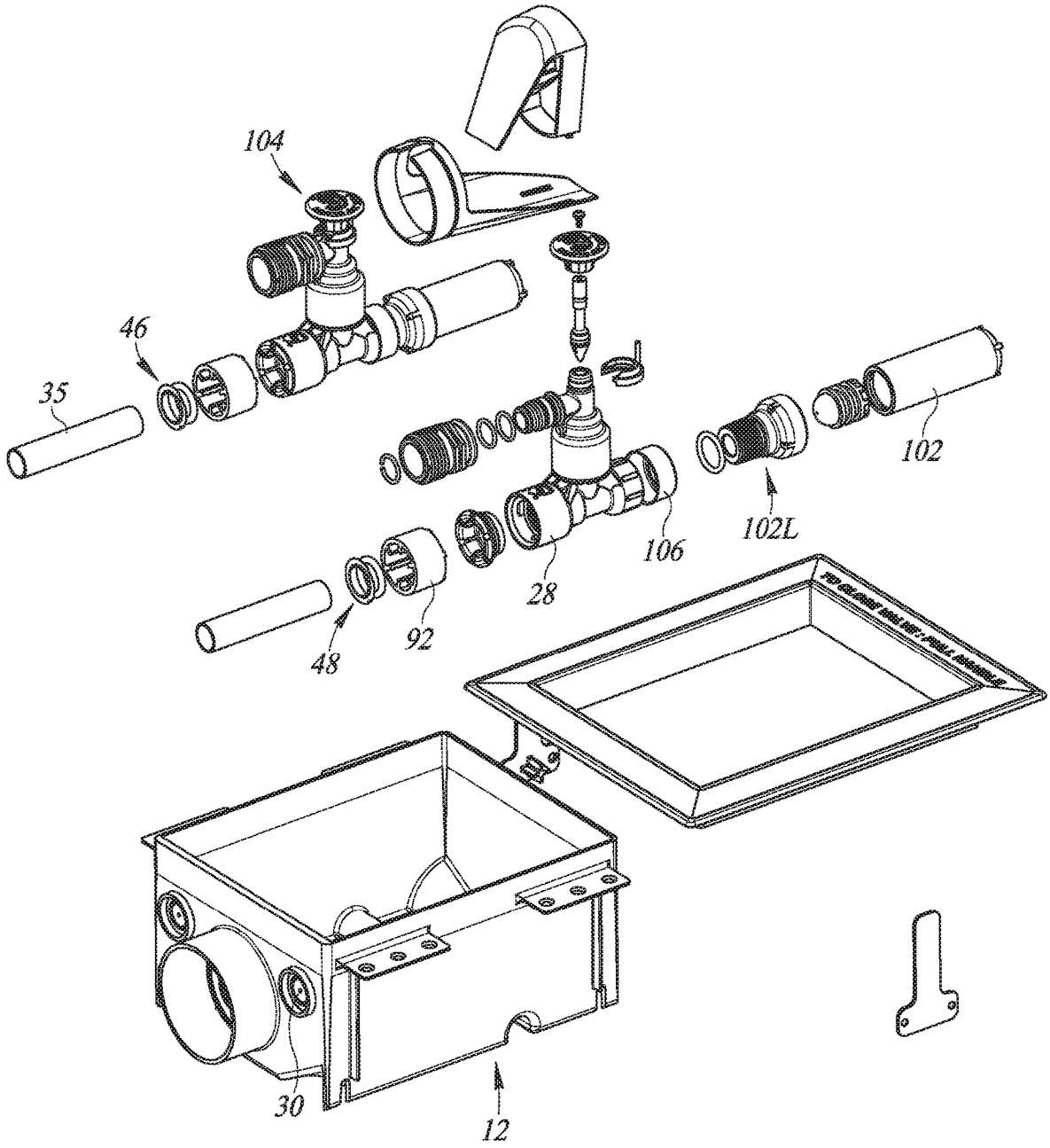
FIG. 2 illustrates a first exploded view of the utility box of FIG. 1.
Figure 3:
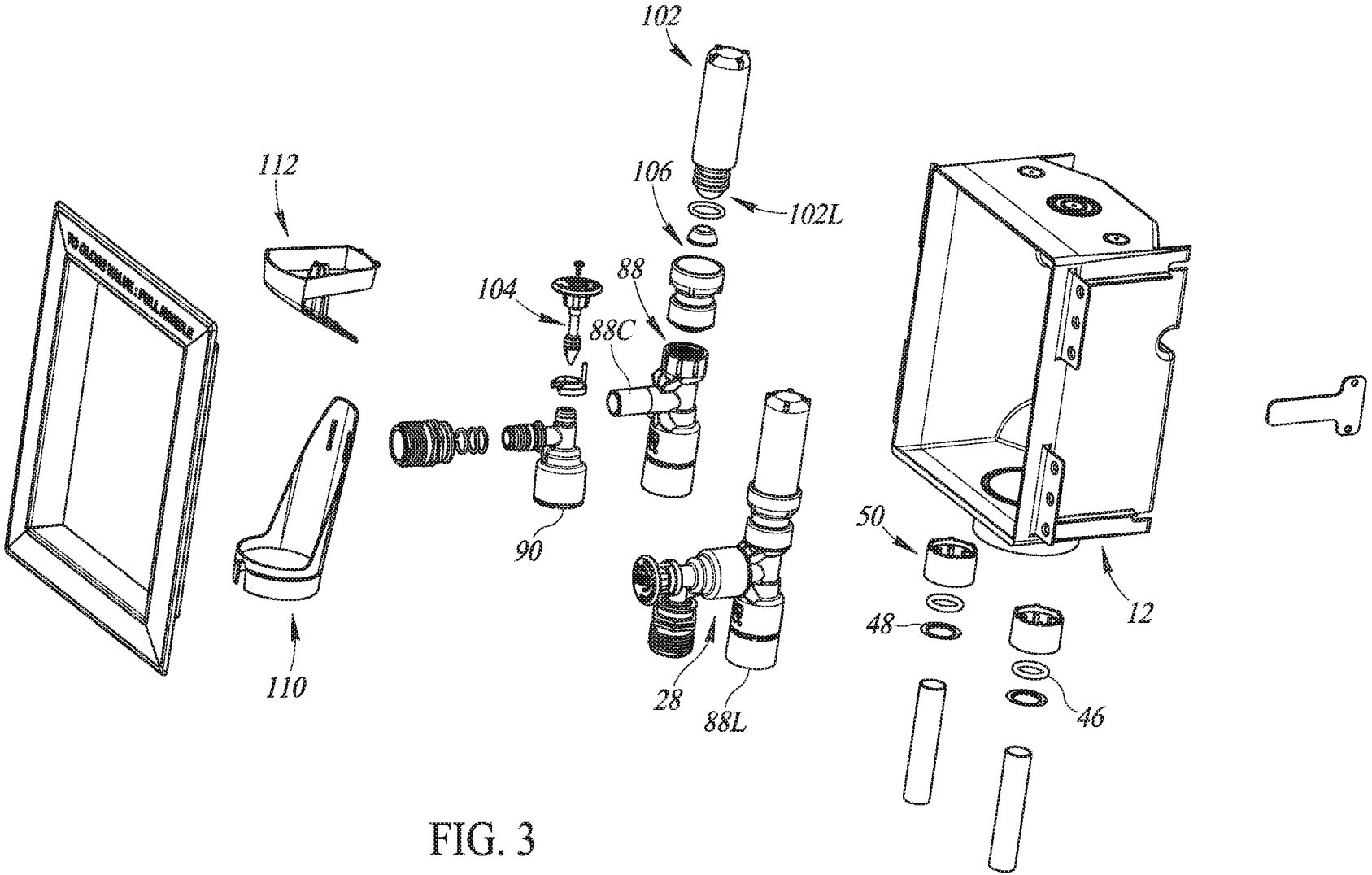
FIG. 3 illustrates a second exploded view of the utility box of FIG. 1.
Figure 7:
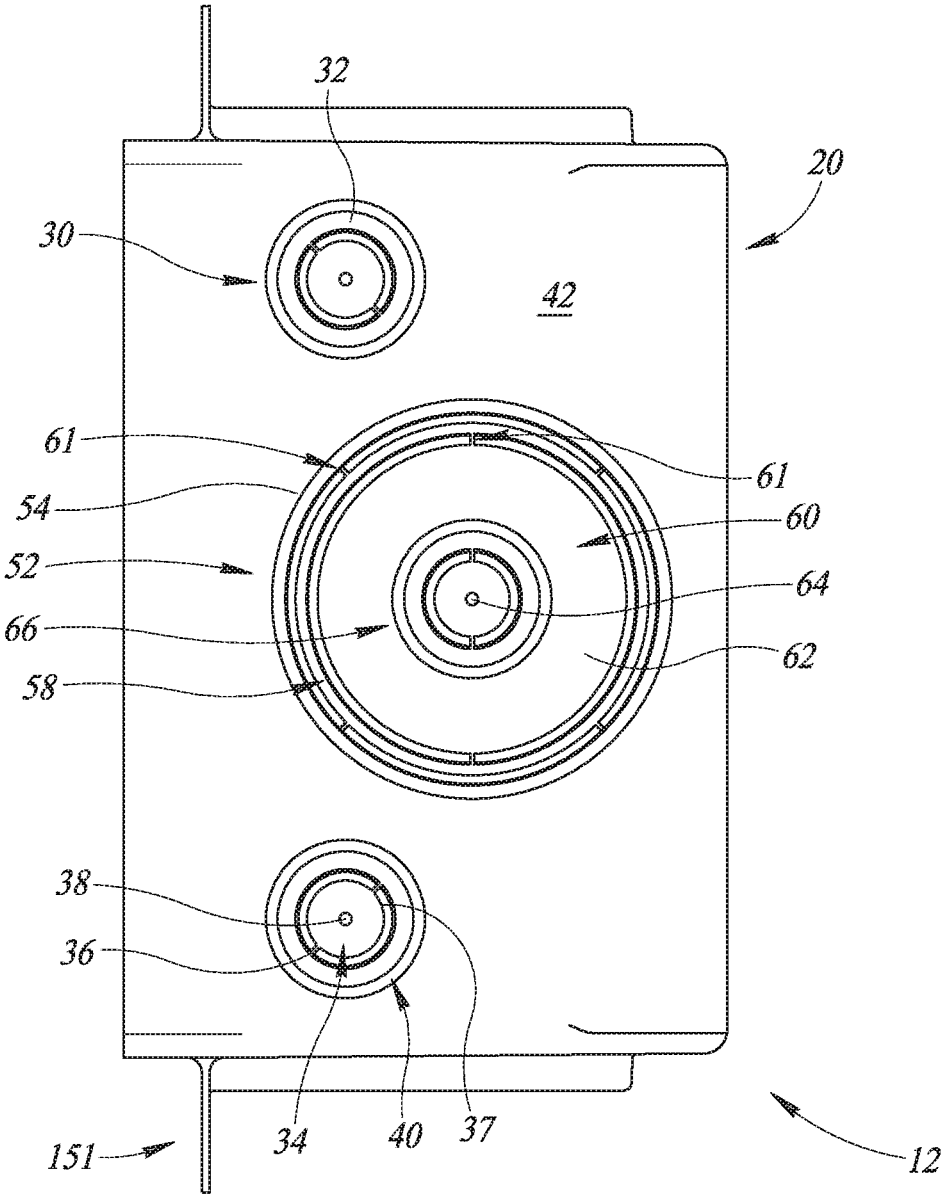
FIG. 7 illustrates a bottom plan view of the box main housing of FIG. 5.
Figure 8B:
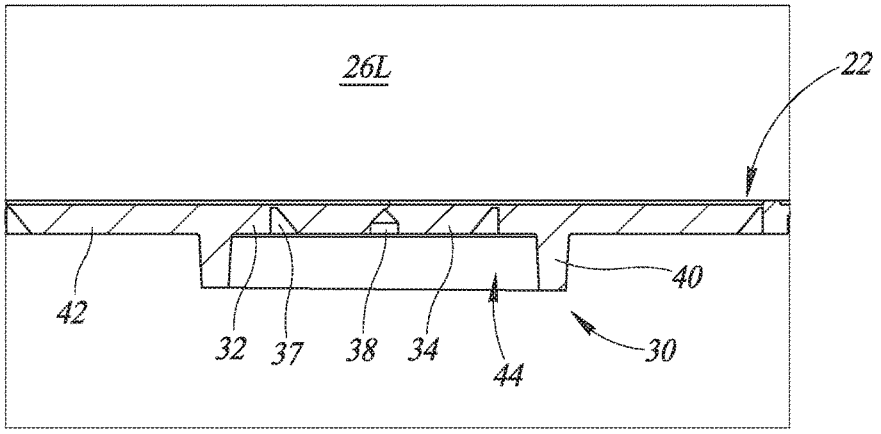
FIG. 8B illustrates an enlarged cross-sectional view substantially along line 1B-1B of the box main housing of FIG. 5.
Figure 9:
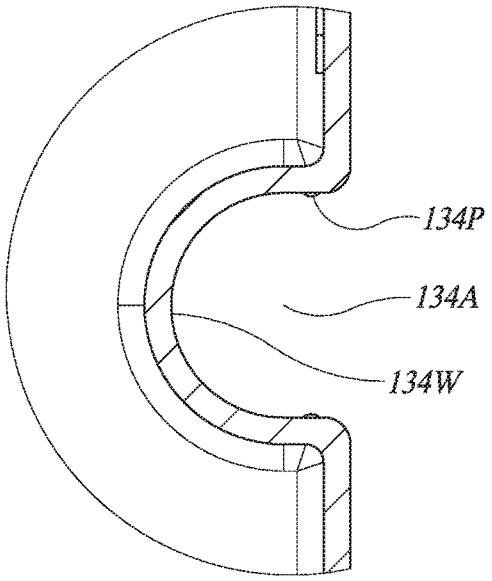
FIG. 9 illustrates an enlarged cross-sectional view substantially along line 1A-1A of a support receptacle of the box main housing of FIG. 5.
Figure 10:
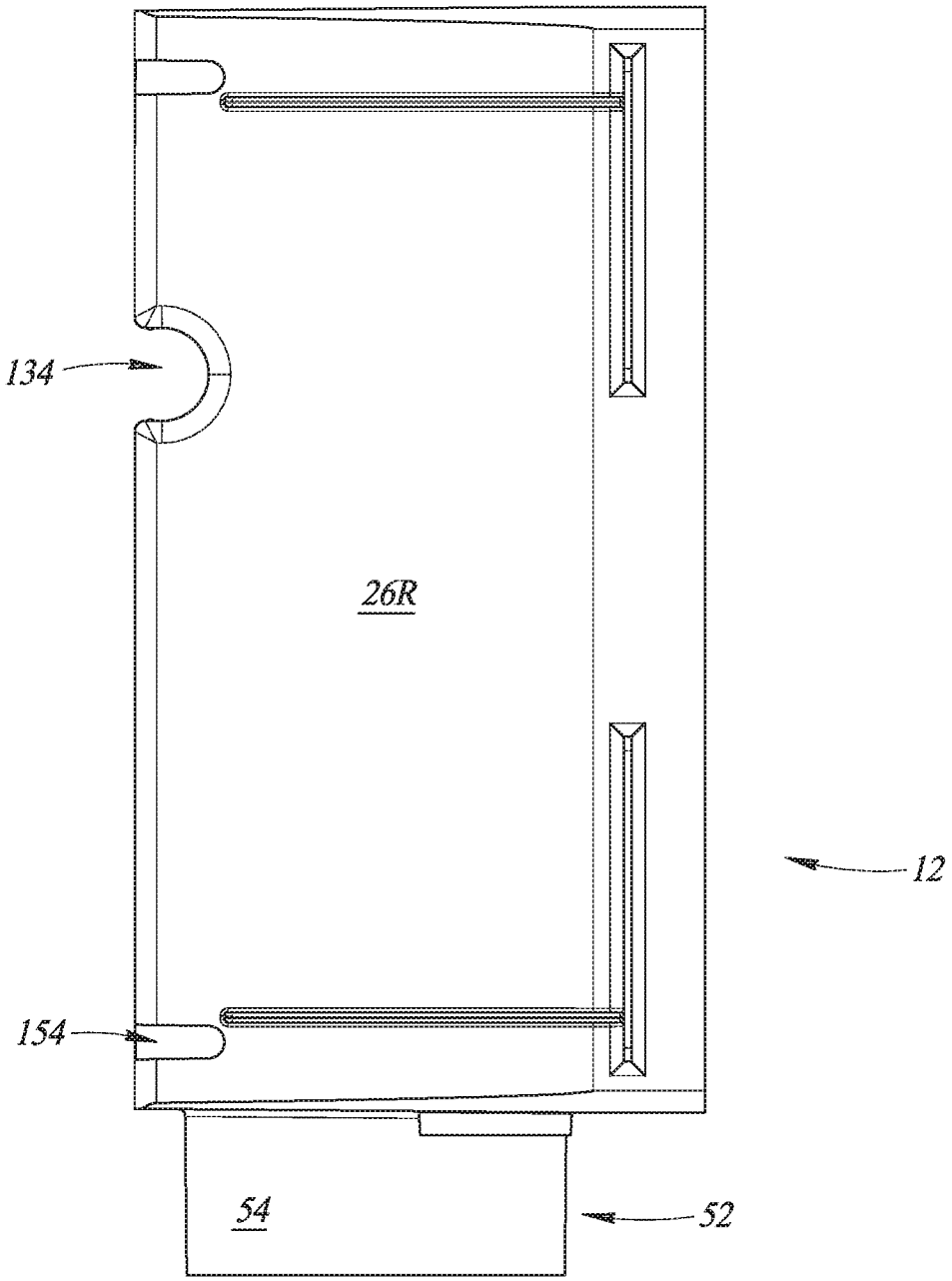
FIG. 10 illustrates a right side view of the box main housing of FIG. 5.

The utility box 10 includes one or more receptacles for connecting a water pipe to the utility box, and for installation of a water supply valve or drain, such as a valve assembly 28 shown in FIGS. 1, 2, 3, and 4. A pair of laterally offset first lower receptacles 30 is disposed on the lower wall 22, as shown in FIGS. 5, 7, 8B, and 11. The lower receptacles 30 each include an annular wall 32 circumferentially extending around a removable circular knockout portion 34, as shown in FIGS. 7 and 8B. The knockout portion 34 is at least partially joined or connected to the lower wall 22 by two narrow bridge portions 36 extending radially inward from the annular ring to the knockout portion, as shown in FIGS. 3 and 9. The bridge portions 36 are located at 180° from one another around the knockout portion 34. The knockout portion 34 may include an outer portion 37 having a thickness less than the annular wall 32, the outer portion extending around the circumference of the knockout portion 34 between the bridge portions 36 and connecting the knockout portion to the annular wall 32. The outer portion 37 may have a tapered or angular cross-sectional shape that tapers radially inward from an upper surface to a lower surface of the knockout portion 34. The knockout portion 34 may be removed by cutting through all or most of the outer portion 37, using a utility knife or blade for example, without severing the bridge portions 36. The remaining bridge portions 36 may be broken after severing the outer portion to prevent unintentional loss of the knockout portion within the wall or a pipe. The bridge portions 36 may act as pivot points about which the knockout portion 34 may be rotated to increase strain in, and thereby weaken, the bridge portions. After rotating the knockout portion 34 about the bridge portions 36, the user may grip the knockout portion and sever the bridge portions 36 to remove the knockout portion from the utility box 10 without the dropping it into a wall or pipe below. Removal of the knockout portion 34 creates an aperture 33 defined by the surrounding annular wall 32, the aperture being sized and shaped to receive a corresponding part, such as a pipe, having a known size and shape.

In other embodiments, an air gap may space the annular wall 32 apart from the knockout portion 34 instead of having the outer portion 37 therebetween. A pilot guide 38 is provided to guide a drill bit through a center the bottom side of the knockout portion to create an aperture of a desired size therein for receiving a pipe or hose, as shown in FIG. 8B. The pilot guide 38 may be a hole or divot extending partially or completely through the center of the knockout portion 34. The lower receptacles 30 include a cylindrical sidewall portion 40 extending downwardly from a lower surface 42 of the lower wall 22 around the annular wall 32 and defining a cavity 44 therein.

The design of the receptacles (e.g., lower receptacles 30) and associated components prevents water from leaking therethrough and into the wall containing the utility box 10. Installation of the pipe and associated components are now described with reference to FIGS. 48, 49, and 50. First, an upper end of a pipe 35 is inserted through the aperture 33 of the lower receptacle 30 to extend between the cavity portion 14 and a lower side of the lower wall 22. An O-ring 46 may be positioned around the pipe 35 below the lower wall 22 and against or abutting the annular wall 32. The O-ring 46 is sized and shaped to resiliently and radially compress between the outer diameter of the pipe 35 and the inner diameter of the cylindrical sidewall portion 40, thereby forming a fluid-tight seal around the pipe 35 at the lower surface of the annular wall 32.

A metallic gripper ring 48 having circumferentially spaced axially and radially inwardly protruding teeth (described in U.S. Pat. No. 6,464,266, which is incorporated herein in its entirety by reference) may be installed around the pipe 35 beneath the O-ring 46 to help retain the O-ring within the cavity 44. When the pipe 35 is inserted through the gripper ring 48, the inwardly protruding teeth of the gripper ring 48 bend in the direction of insertion, and dig into or press inwardly against the outer diameter of the pipe 35. For instance, the teeth of the gripper ring 48 may bend downwardly when the pipe 35 is inserted downwardly through the aperture 33. The pipe 35 may be rotated in a first direction (e.g., clockwise) relative to the gripper ring 48 to score the outer diameter of the pipe 35 and prevent further movement of the pipe 35 through the gripper ring 48. The gripper ring 48 may have a larger diameter than the inner diameter of the sidewall portion 40 so as to abut a lower side of the sidewall portion 40. In some embodiments, the gripper ring 48 may be fixed to the bottom of the sidewall portion 40 using adhesives or sonic welding, by way of non-limiting example.

When the pipe 35 is inserted through the aperture 33, the O-ring 46, and the gripper ring 48, as described above, the pipe 35 is maintained in fluid-tight attachment to the box main housing 12. Thereafter, a valve assembly 28 or other assembly may be installed over the upper end of the pipe 35 within the cavity portion 14, as described below. If the valve assembly 28 leaks or breaks, or water otherwise accumulates within the cavity portion 14, the O-ring 46 sealed around the pipe 35 prevents liquid from leaking through the aperture 33 and into the wall. The inside of the building walls is thereby protected from leaks within or around the utility box 10, and leaking water will pool within the cavity portion 14 providing a visual indication of a leak. Moreover, a leaky valve assembly 28 may be removed and replaced without removal of the building wall or the box main housing 12 from the wall. Thus, the valve assembly 28 may be easily removed or replaced without extensive cost or effort.

The utility box 10 may be provided with the pipe 35 installed in the fluid-tight configuration. Alternatively, the pipe 35 may be installed in the fluid-tight configuration on site.

Figure 8A:
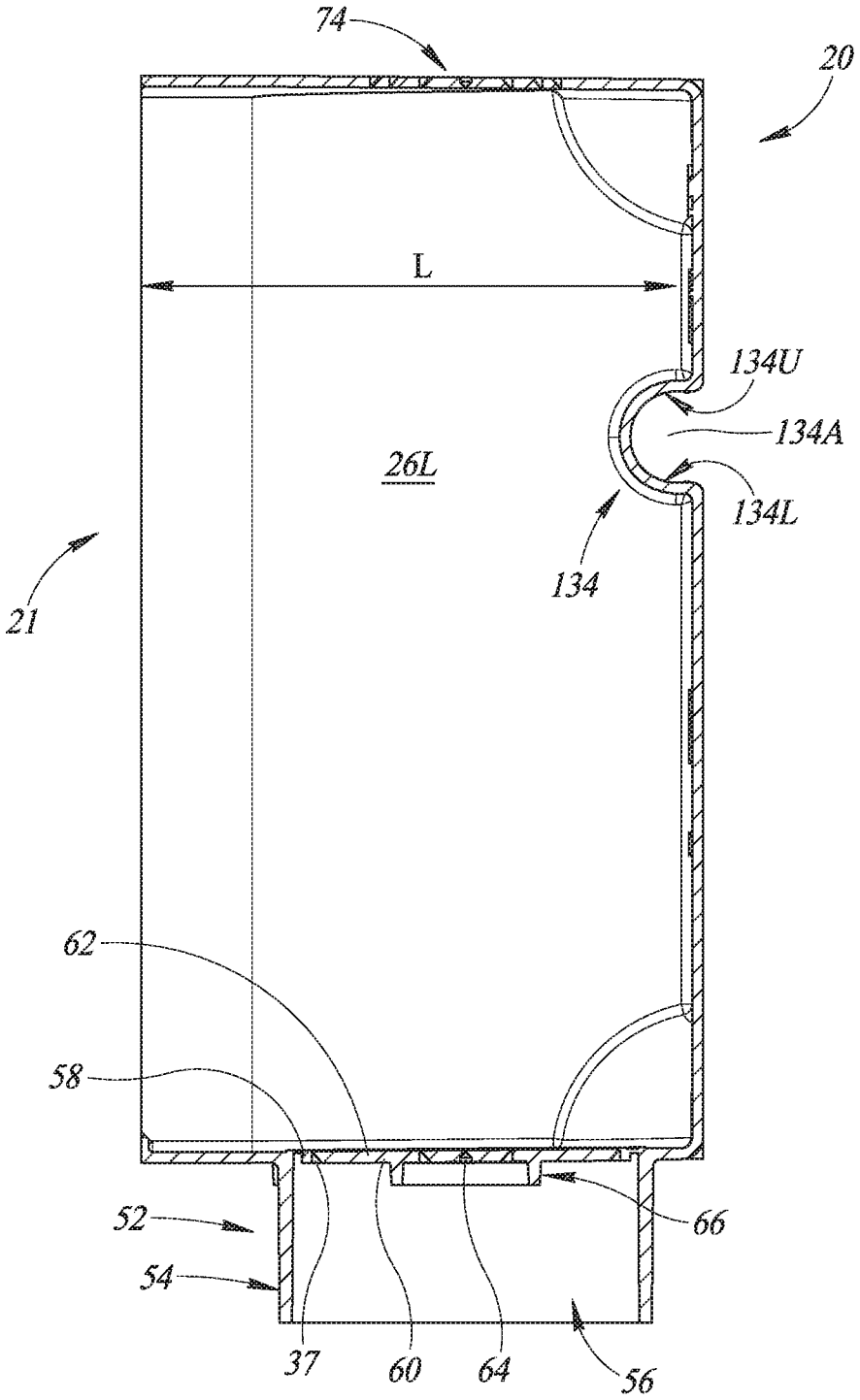
FIG. 8A illustrates an enlarged cross-sectional view substantially along line 1A-1A of the box main housing of FIG. 5.

In some embodiments, one or more second lower receptacle 52 having a different configuration than the first lower receptacles 30 may also be disposed on the lower wall 22, as shown in FIGS. 7 and 8A. The second lower receptacle 52 may have a larger outer diameter than the first lower receptacles 30 to allow for attachment of a pipe 67 having a larger diameter than the pipe 35. A second sidewall 54 having a cylindrical shape with a larger diameter than the sidewall 40 extends downwardly from the lower wall 22 to define a downwardly opening cavity 56. The second sidewall 54 may have a length extending downwardly farther than the sidewall 40. The second lower receptacle 52 may include one or more removable knockout portions for installing a pipe and/or a water supply or drain. For example, an annular first knockout portion 58 of the second lower receptacle 52 is located radially inward of the second sidewall 54. The first knockout portion 58 may be connected to the lower surface 22 by an outer portion 59 and a plurality of the bridge portions 61 substantially similar to those described above, except that there may be a different number of bridge portions than two. For example, the second lower receptacle 52 may have four bridge portions 61 spaced apart at 90° from one another around the perimeter of the first knockout portion 58. The first knockout portion 58, including all portions of the second lower receptacle 52 located radially inward thereof, by severing the bridge portions 61 and the outer portion 59.

Figure 14A:
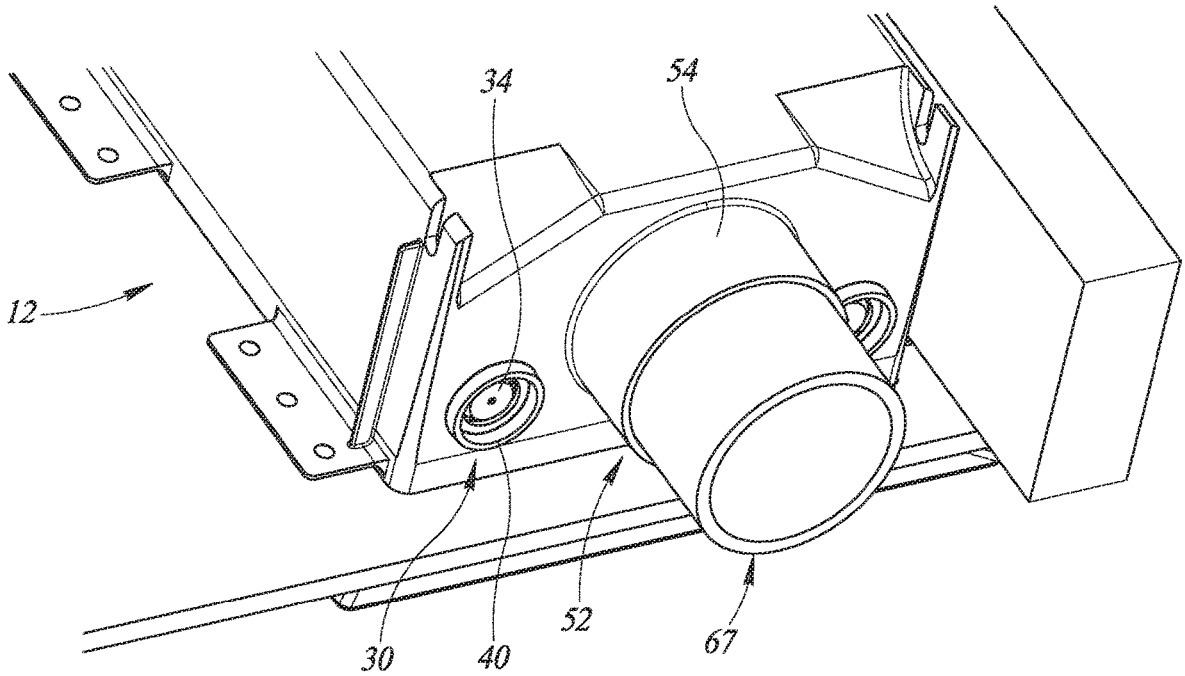
FIG. 14A illustrates a bottom perspective view of the box main housing of FIG. 5 positioned against an interior side of a building wall and having a pipe inserted into a second lower receptacle thereof.
Figure 14B:
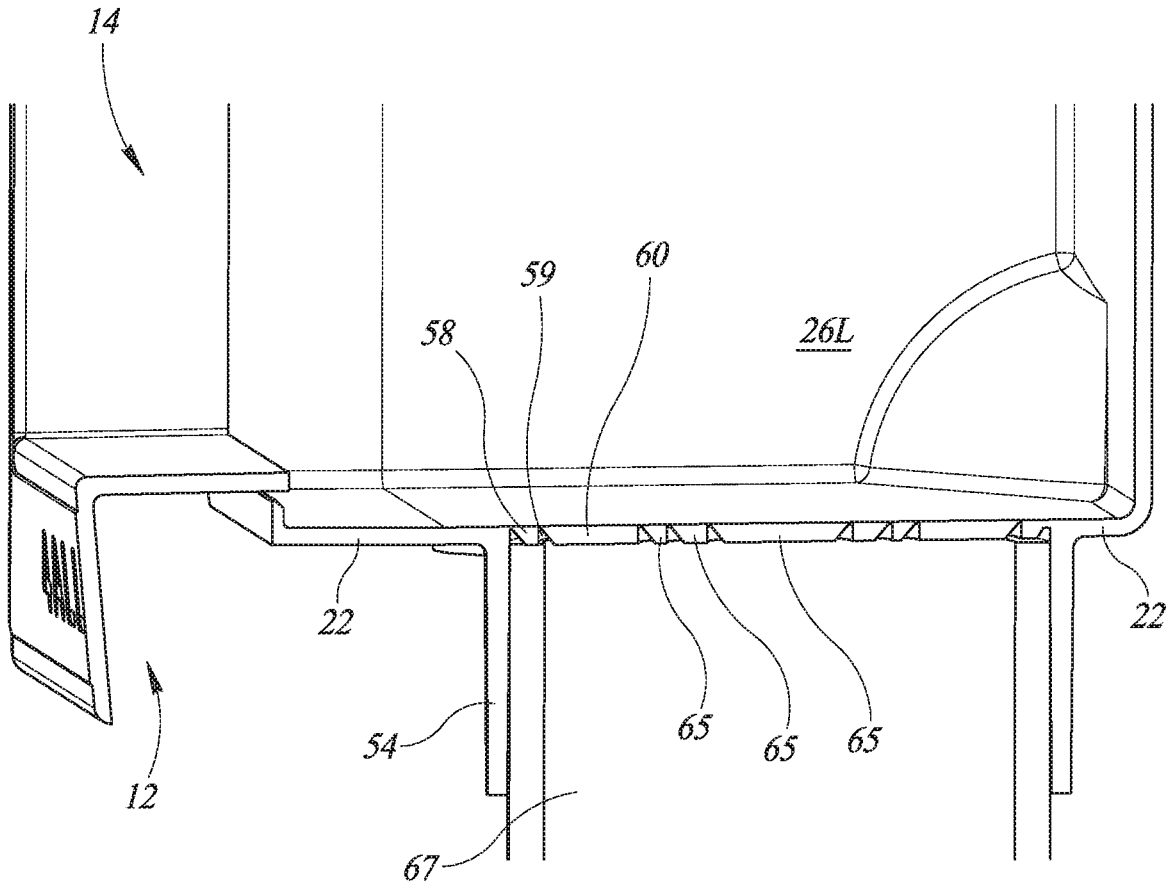
FIG. 14B illustrates a cross-sectional view of a lower wall of the box main housing of FIG. 14A taken along line 1-1 of FIG. 5.

The second lower receptacle 52 may include a second knockout portion 60 located radially inward from the first knockout portion 58. The second knockout portion 60 may include a circular plate 62 having a radial wall thickness greater than the first knockout portion. The second knockout portion 60 may be connected to the first knockout portion 58 by a plurality of the bridge portions 63 and/or the outer portion in the manner described above. The circular plate 62 is removable from the second lower receptacle 52 without also removing the first knockout portion 58. In particular, a pipe 67 having a similar inner diameter to the first knockout portion 58 may be inserted upward into the cavity 56 and abutting against a lower surface of the first knockout portion 58, as shown in FIGS. 14A and 14B. The first knockout portion 58 is sized such that it is too large to fall into the pipe 67 when the knockout portion 58 is severed or removed from the box main housing 12.

The outer portion 37 between the second knockout portion 60 and the first knockout portion 58 may be broken or severed to remove the second knockout portion 60. A blade or other tool may be used to cut along at least some of the outer portion 37, and a user may push or pull the second knockout portion 60 to further separate the second knockout portion 60 and the first knockout portion 58 along the outer portion 37. The bridge portion(s) 36 is thicker than the outer portion 37, and designed so that it may not be broken when the outer portion 37 is severed so as to prevent the second knockout portion 60 from falling into the pipe below the receptacle. After breaking the outer portion 37, the user may then grip the second knockout portion 60 and break the remaining bridge portion 36 to separate the second knockout portion 60 from the second lower receptacle 52 without removing the first knockout portion 58. Thereafter, a drain assembly may be installed in the second lower receptacle 52 through the cavity portion 14 of the utility box 10.

Figure 15:
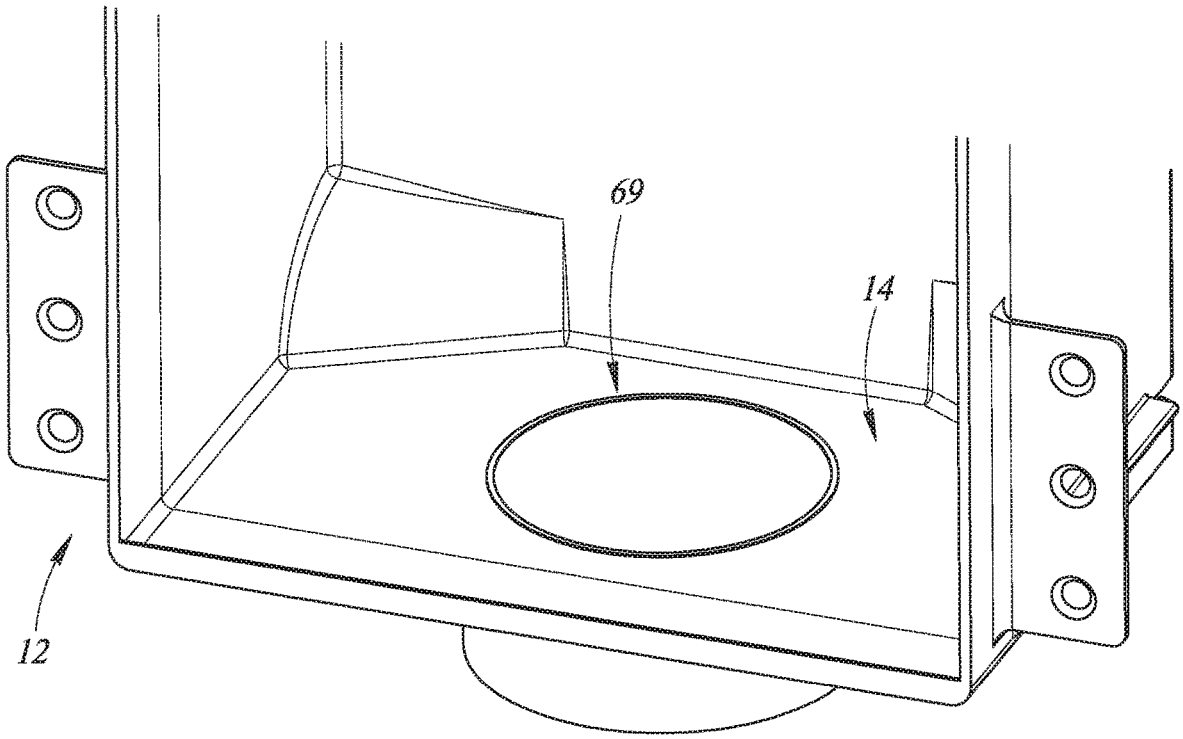
FIG. 15 illustrates a front perspective view of the lower wall of the box main housing of FIG. 5.

The box main housing 12 may include a feature providing a guide or outline 69 indicating where to cut to remove a knockout portion, as shown in FIG. 15. The guide 69 may be an annular recess disposed on an upper surface of the lower wall 22 in the cavity portion 14, and coaxially located with the knockout portions of the second lower receptacle 52 (or other receptacles). The guide 69 in the present embodiment is circumferentially located along the outer diameter of the first knockout portion 58. A user may insert the tip of a blade in and cut along the guide 69 to remove the knockout portion 58 and the portions radially inward therefrom. Therefore, the knockout portion 58 may be removed after the utility box 10 is installed in a building wall or without requiring access to the lower surface of the lower wall 22. In some embodiments, the guide 69 may include an outline or indication provided on the upper surface of the lower wall 22. There may be a plurality of concentrically-located guides 69 on each receptacle for which the guides are provided. For example, there may be another guide 69 located between the first knockout portion 58 and the second knockout portion 60 (i.e. located along the outer portion 59) for removing the second knockout portion 60 while leaving the first knockout portion 58 installed. One or more of the other receptacles (e.g., first lower receptacle 30) may be provided with one or more of the guides 69 for removing knockout portions.

Referring to FIG. 8A, the second lower receptacle 52 may also include a pilot guide 64 similar to the pilot guide 38 described above extending partially or completely through the center of the plate section 62, providing a pilot hole or divot to guide a drill bit to drill upwardly through the bottom side of the knockout portion to create an aperture of a desired size therein. The second lower receptacle 52 may further include a third lower receptacle 66 disposed at the center of the plate section 62. The third lower receptacle 66 may be substantially similar in structure and/or size to the first lower receptacle 30. That is, the third lower receptacle 66 may include an annular wall surrounding a removable circular knockout portion, and a cylindrical sidewall portion extending downwardly from a lower surface of the plate section 62 in a structure substantially similar to the lower receptacles 30. The second lower receptacle 52 may have more knockout portions 65 disposed radially inward of the first knockout portion 58 and the second knockout portion 60, as shown in FIG. 14B. The differently sized knockout portions of the second lower receptacle allow for connection of differently sized pipes or hoses to the utility box 10.

Figure 6:
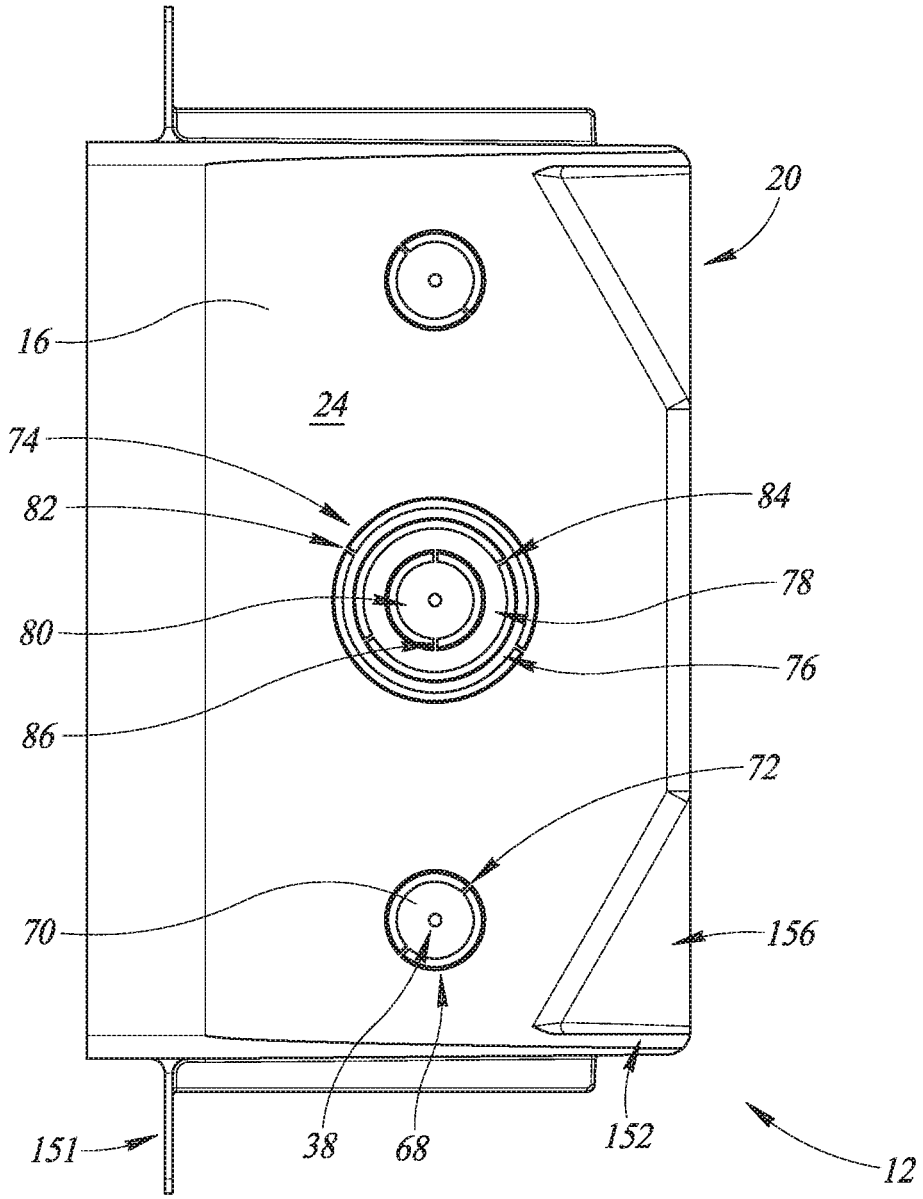
FIG. 6 illustrates a top plan view of the box main housing of FIG. 5.

A pair of laterally offset first upper receptacles 68 may be disposed on the upper wall 24, as shown in FIG. 6. The first upper receptacles 68 may allow for pipes and valves to be connected to an upper side of the utility box 10. The first upper receptacles 68 may have a similar configuration to the first lower receptacles 30. In particular, each of the first upper receptacles 68 may include a knockout portion 70 substantially similar to the knockout portions 34 described above and two narrow bridge portions 72 extending radially inward from the upper wall 24 to the knockout portion 70. The knockout portion 70 may include an outer portion 71 having a thickness less than the upper wall 24 and extending around the circumference of the knockout portion 70 between the bridge portions 72 and connecting the knockout portion to the upper wall 24. The outer portion 71 may have a tapered or angular shape tapering radially inward toward an upper surface of the knockout portion 70. In other embodiments, the outer portion 71 may be omitted and an air gap may separate the knockout portion 70 from the upper wall 24. The center of the knockout portion 70 may include a pilot guide substantially similar to the pilot guide 38. In some embodiments, the first upper receptacles may each include a cylindrical sidewall portion extending upwardly from the upper wall 24 around the connecting ring (or air gap) in a manner similar to the sidewall portion 40.

Figure 12:
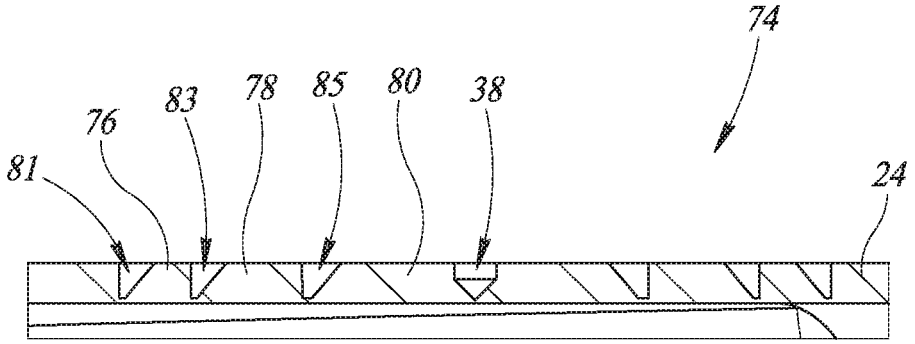
FIG. 12 illustrates an enlarged cross-sectional view substantially along line 1A-1A of a second upper receptacle of the box main housing of FIG. 5.

A second upper receptacle 74 may be disposed on a central portion of the upper wall 24. The second upper receptacle 74 may have a plurality of concentrically arranged knockout portions arranged in a "bullseye" configuration for connecting pipes and/or fixtures having different sizes at the upper wall 24, as shown in FIGS. 6, 8A, and 12. For example, the second upper receptacle 74 may include a first knockout portion 76 having a largest outer diameter, a second knockout portion 78 having an outer diameter positioned radially inward of an inner diameter of the first knockout portion, and a third knockout portion 80 having an outer diameter positioned radially inward of an the second knockout portion. The upper wall 24 is connected to the first knockout portion 76 by an outer portion 81 and a pair of narrow radially extending first bridge portions 82, which are similar to the bridge portions 36 and located at 180° from one another around the outer circumference of the first knockout portion. The outer portion 81 has a thickness less than the first knockout portion 76 and extends circumferentially around the first knockout portion. The outer portion 81 may have a tapered or angular cross-sectional shape that tapers radially inward from lower surface to an upper surface of the knockout portion 76.

Each of the plurality of concentrically arranged knockout portions may be connected by circumferentially offset bridge portions. The first knockout portion 76 is connected to the second knockout portion 78 by an outer portion 83 and a pair of second bridge portions 84 similar to the bridge portions 36, but each of which are circumferentially offset relative to one of the first bridge portions 82 around at 120° (and conversely −60° to the other of the first bridge portions). The second knockout portion 78 is connected to the third knockout portion 80 by an outer portion 85 and a pair of third bridge portions 86 similar to the bridge portions 36, but each of which are circumferentially offset relative to one of the second bridge portions 84 at 120°. The outer portions 83 and 85 have a structure similar to the outer portion 81 describe above, as shown in FIG. 12.

Circumferentially offsetting the bridge portions 82, 84, 86 from one another allows a user to remove an inner knockout portion without removal of an adjacent outer knockout portion, thereby adjusting the circumference of an aperture of the second upper receptacle 74 for installation a pipe or fixture having approximately the same outer circumference. To remove the third knockout portion 80, a user may sever the outer portion 85, then grip the third knockout portion and sever or forcibly break the bridge portions 86. A pipe or fixture having an outer circumference similar to the inner circumference of the second knockout portion 78 may be inserted through the aperture left by the removed third knockout portion 80. An upper surface of the third knockout portion 80 may include a pilot guide substantially similar to the pilot guide 36 described above for drilling an aperture of a desired size in the second upper receptacle 74.

Figure 13A:
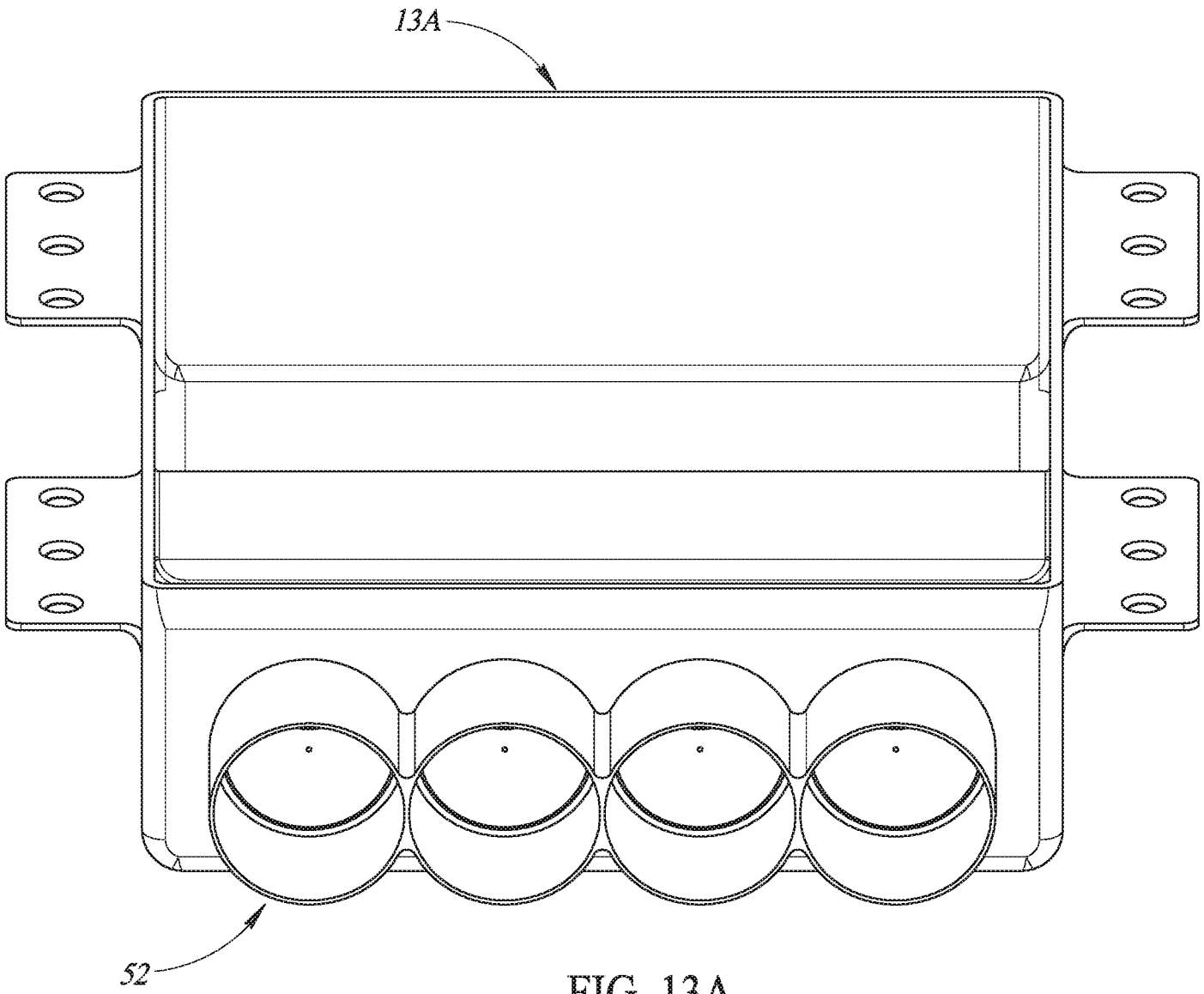
FIG. 13A illustrates a bottom perspective view of a box main housing according to a second embodiment.
Figure 13B:
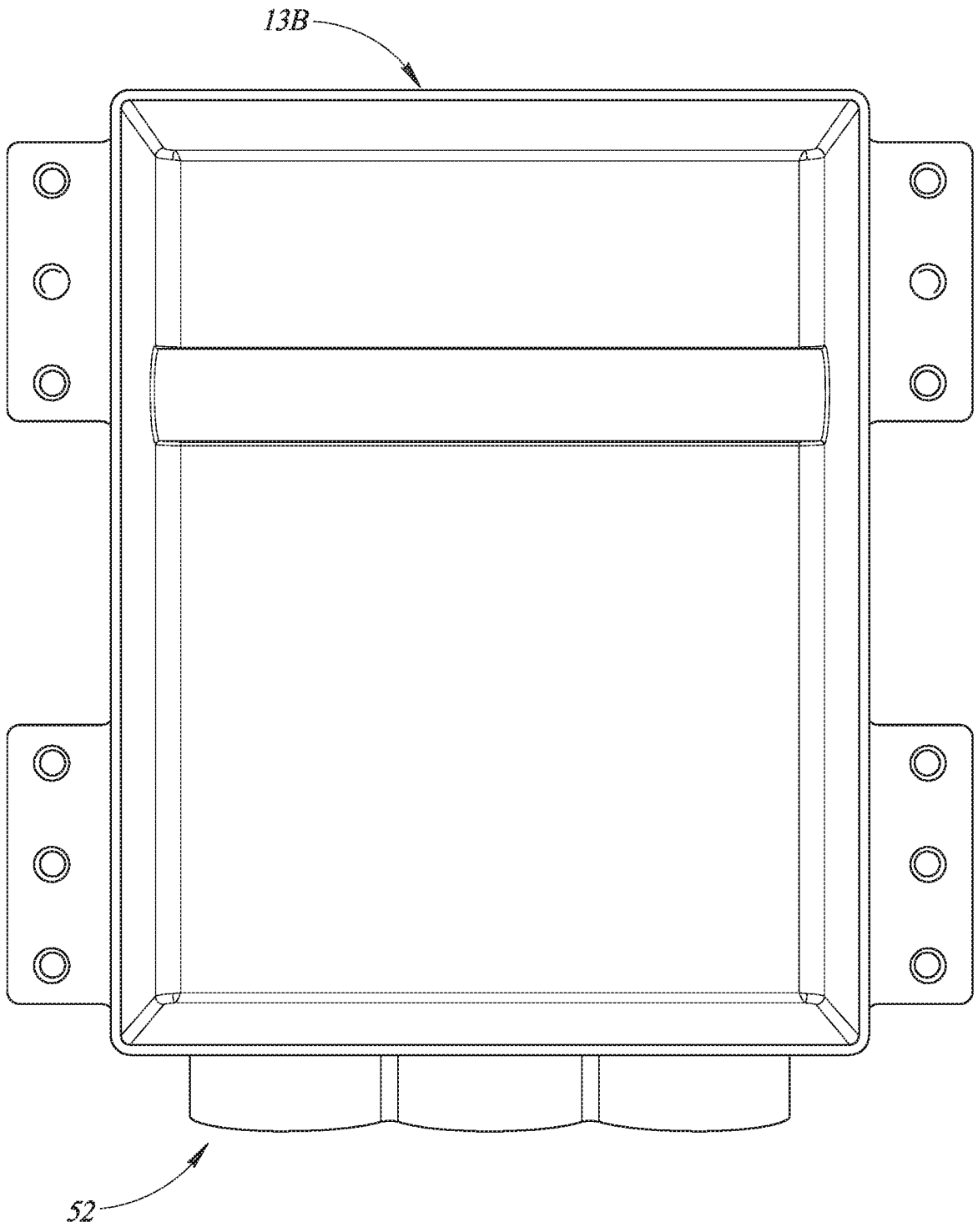
FIG. 13B illustrates a front view of a box main housing according to a third embodiment.
Figure 13C:
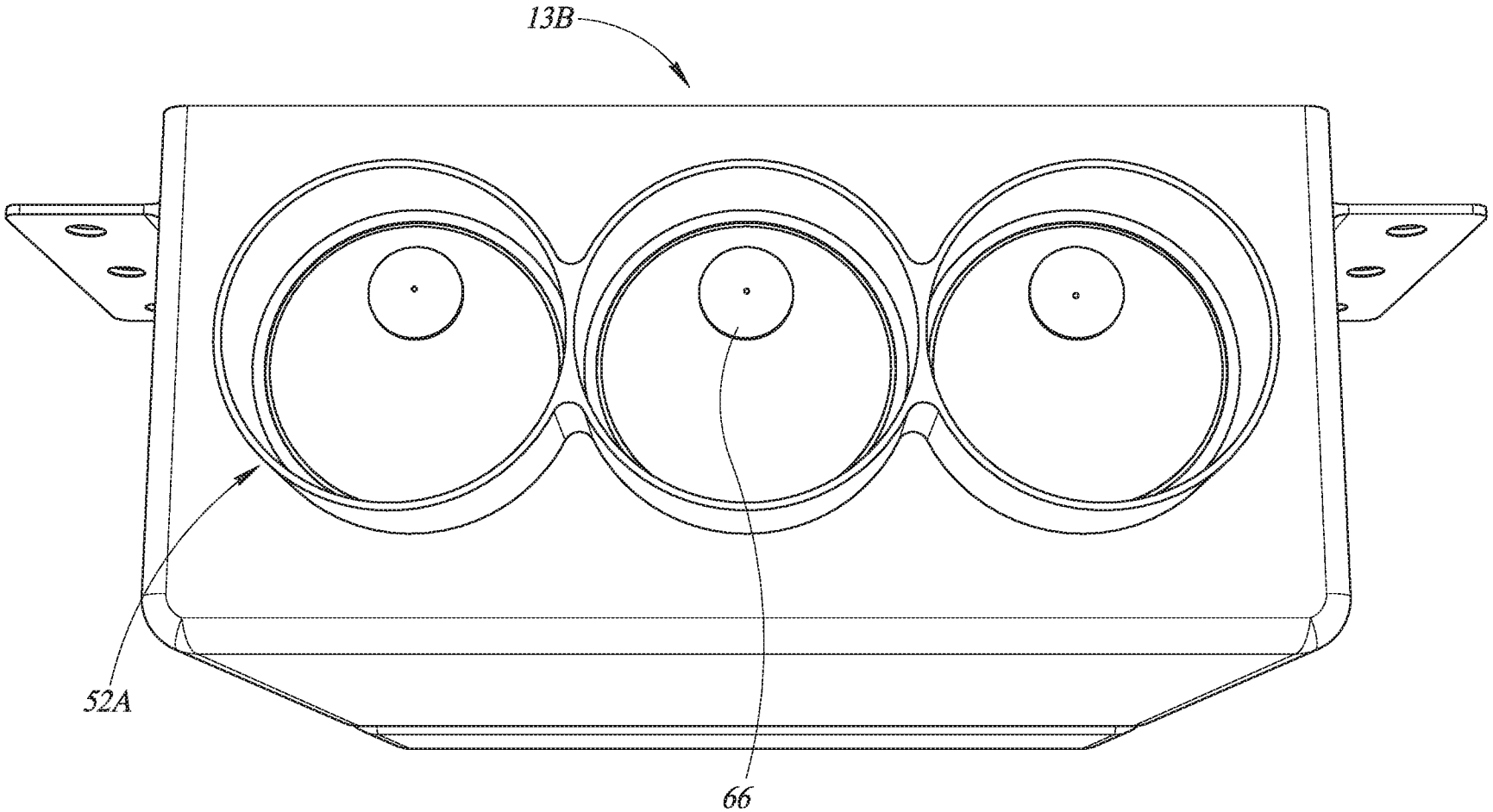
FIG. 13C illustrates a bottom perspective view of the box main housing of FIG. 13B.

The configuration of the lower and/or upper receptacles of the utility box 10 allow for attachment of different fixtures, valves and drains thereto, and to facilitate simple and secure connection of pipes and/or hoses to the different fixtures, valves and drains. Although three receptacles for attaching fixtures are provided on each of the upper wall 24 and lower wall 22 of the box main housing 12, a different number of receptacles may be provided in other embodiments. For example, a box main housing 13A may be provided having four second lower receptacles 52, as shown in FIG. 13A. Accordingly, two separate drain assemblies and two separate water valve assemblies, described below, may be attached to the box main housing, allowing for greater variation in uses and configurations. For example, a dishwasher and ice maker, each using a single water supply assembly and a single drain assembly, may be attached at the same outlet box instead of having two separate outlet boxes. A different number of receptacles may be provided in other embodiments. For instance, a box main housing 13B is shown in FIGS. 13B and 13C having three lower receptacles 52. Each of the lower receptacles 52 may include one of the third lower receptacles 66 (see FIG. 13C) for installing a pipe and/or a valve, as described below. Different configurations of drains and/or valves may be installed in the box main housing 13B. A drain assembly may be installed in each of the leftmost one and center one of the receptacles 52 shown in FIG. 13C, and a water supply valve may be installed in the rightmost one of the receptacles 52, by way of non-limiting example. Therefore, a user may configure the box main housings 13A and 13B according to the application, or the most convenient access to the supply or drain pipe.

Figure 48:
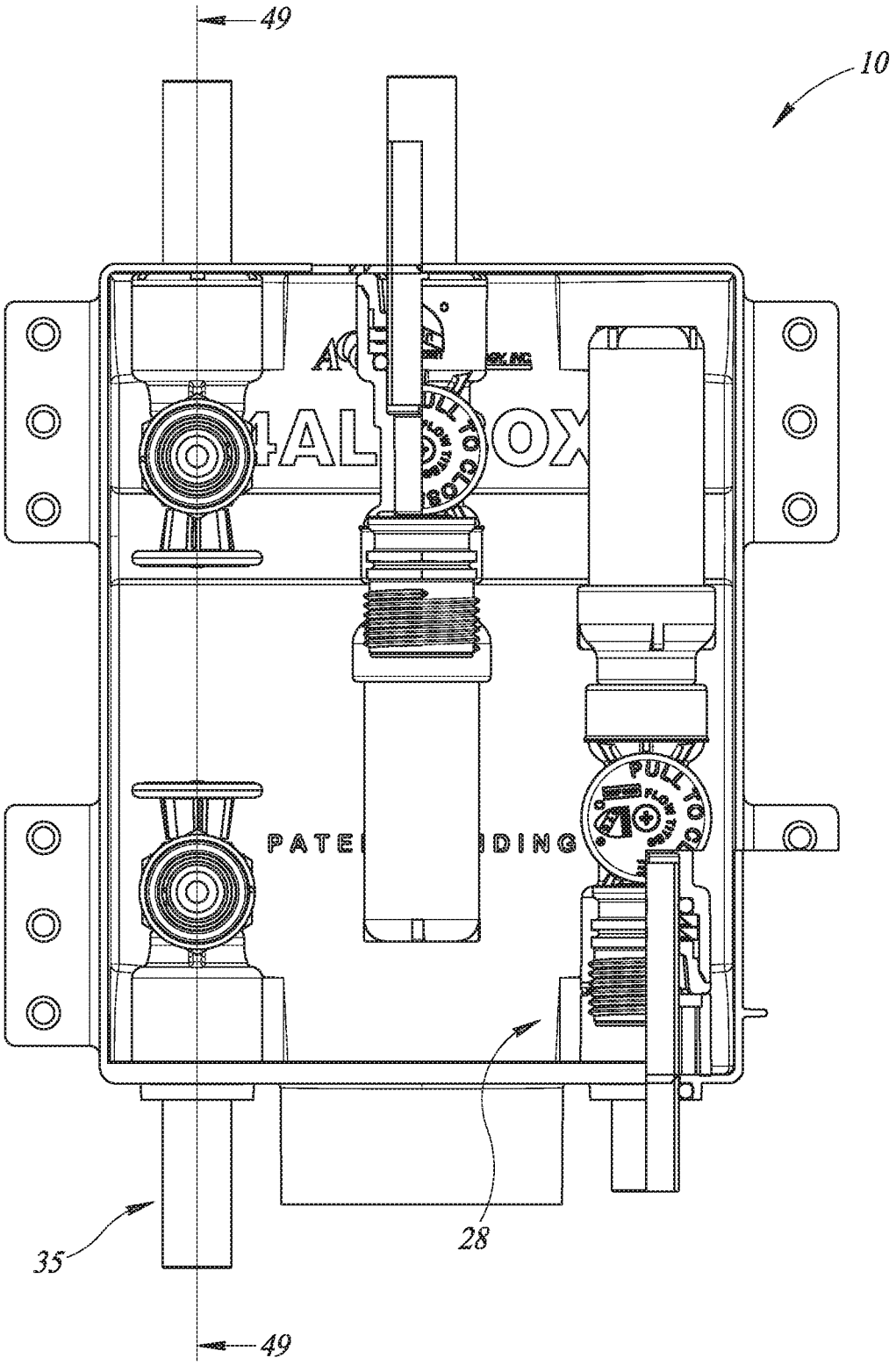
FIG. 48 illustrates a front view of a utility box having a plurality of valve assemblies installed therein, and provided with partially transparent and partial sectional views of some of the valve assemblies.
Figure 49:
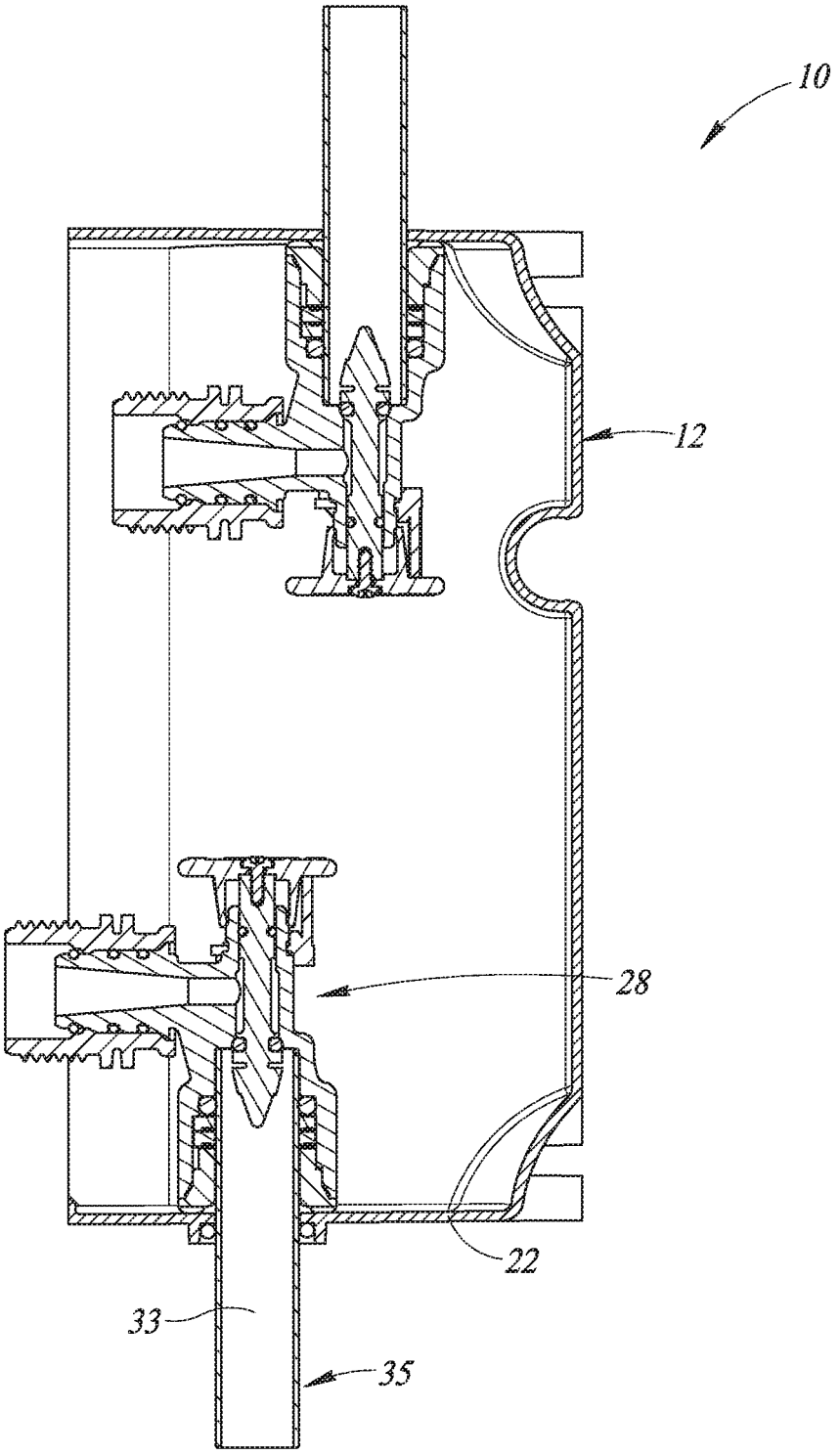
FIG. 49 illustrates a cross-sectional view of the utility box of FIG. 48 taken substantially along line 8-8.
Figure 50:
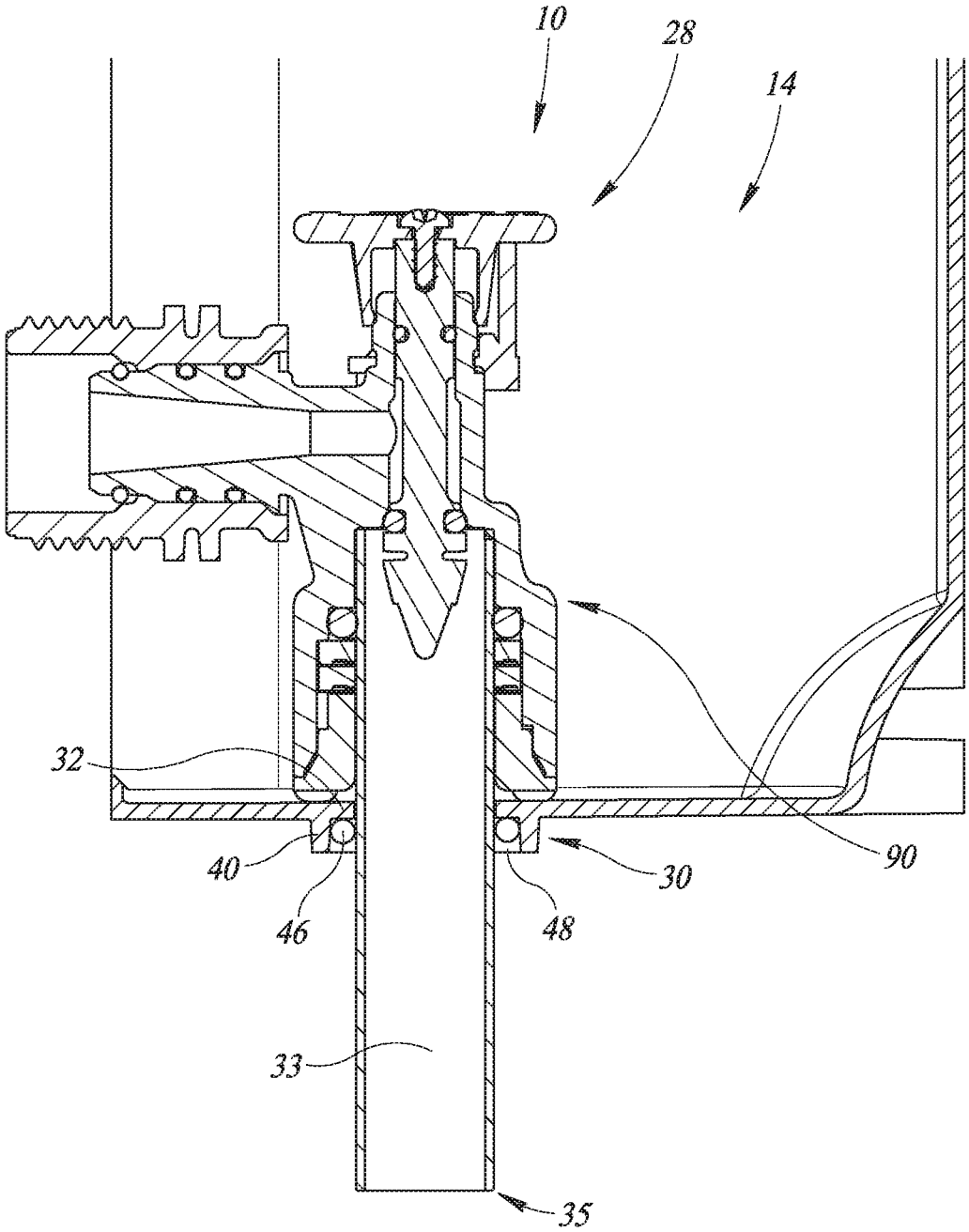
FIG. 50 illustrates an enlarged cross-sectional view of a water valve assembly installed in the utility box of FIG. 48 taken substantially along line 8-8.
Figure 51:
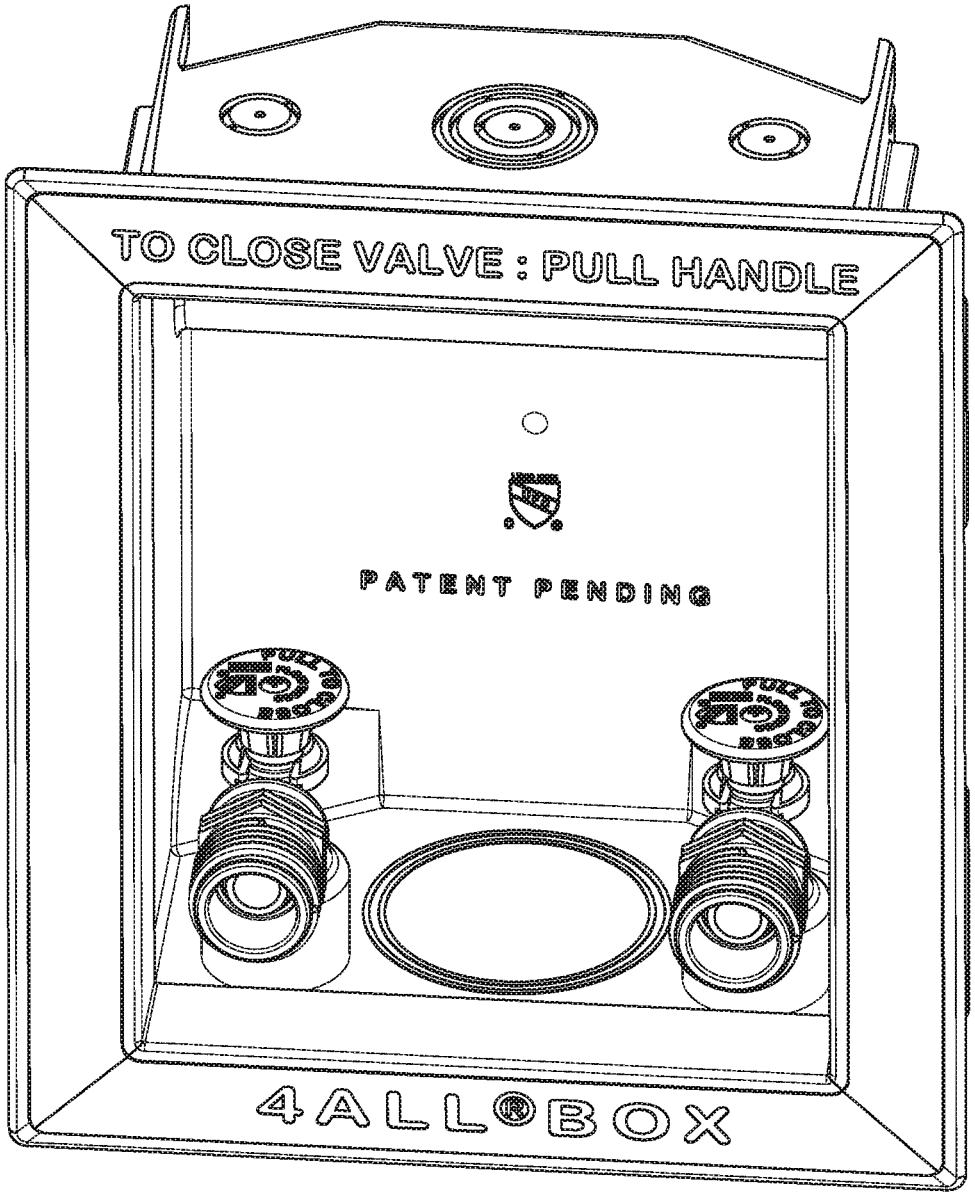
FIGS. 51-93 illustrate additional embodiment of the utility box and its component parts similar to those shown in FIGS. 1-50.
Figure 52:
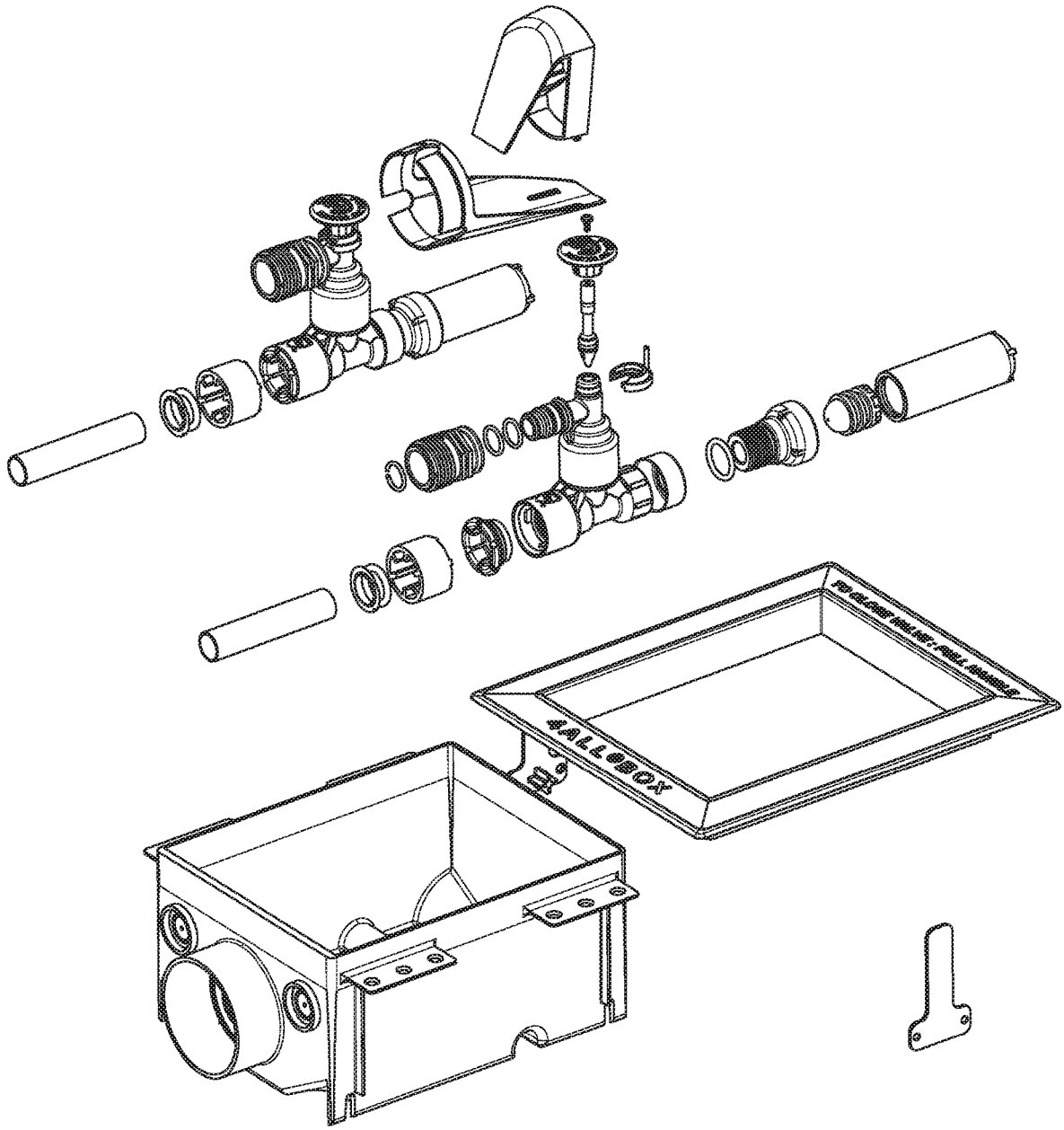
Figure 53:
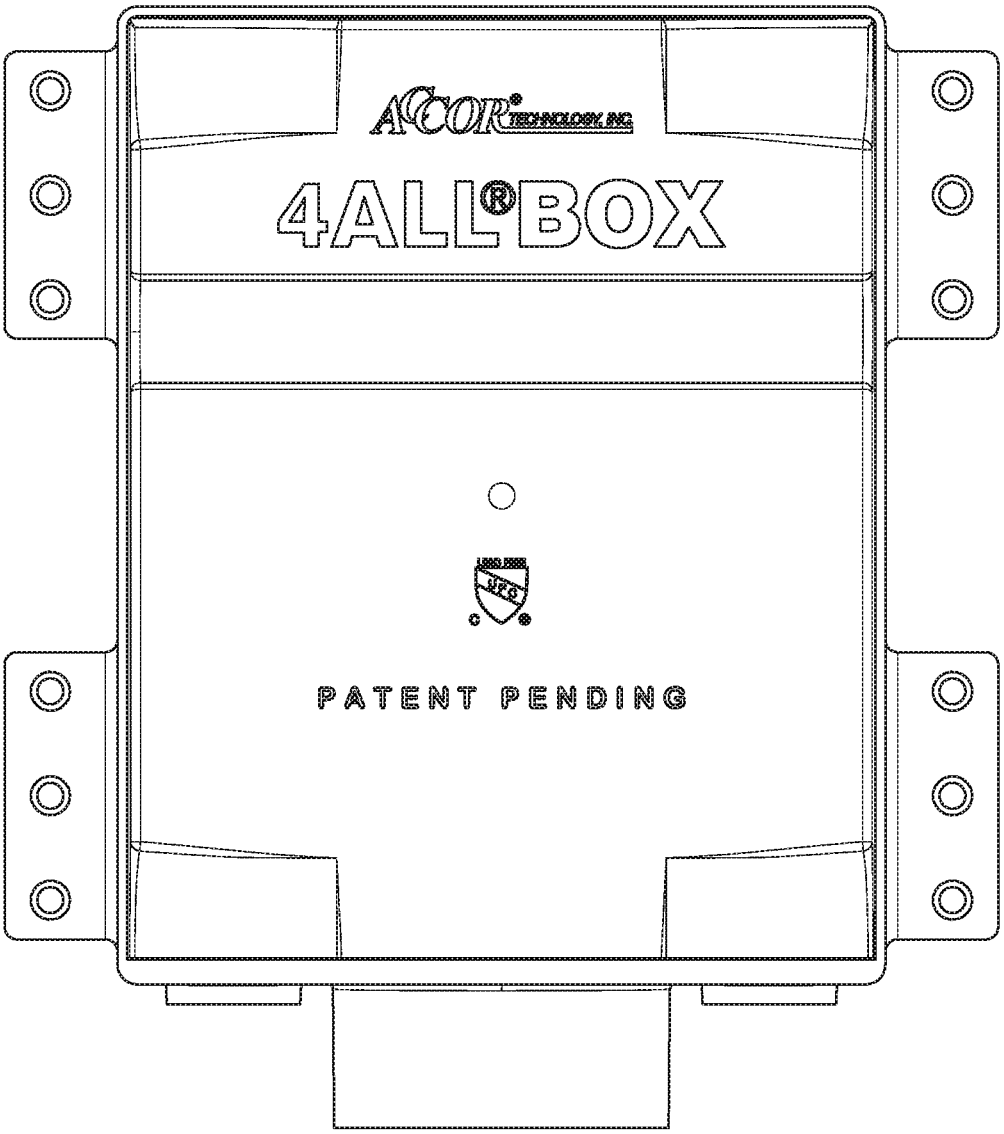
Figure 54:
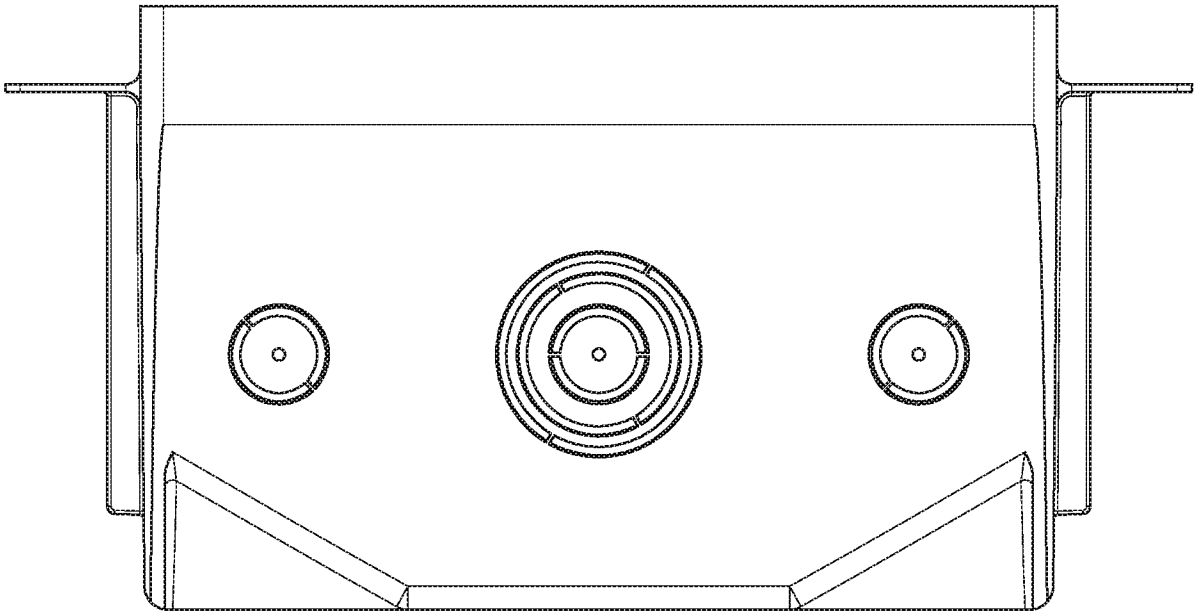
Figure 55:
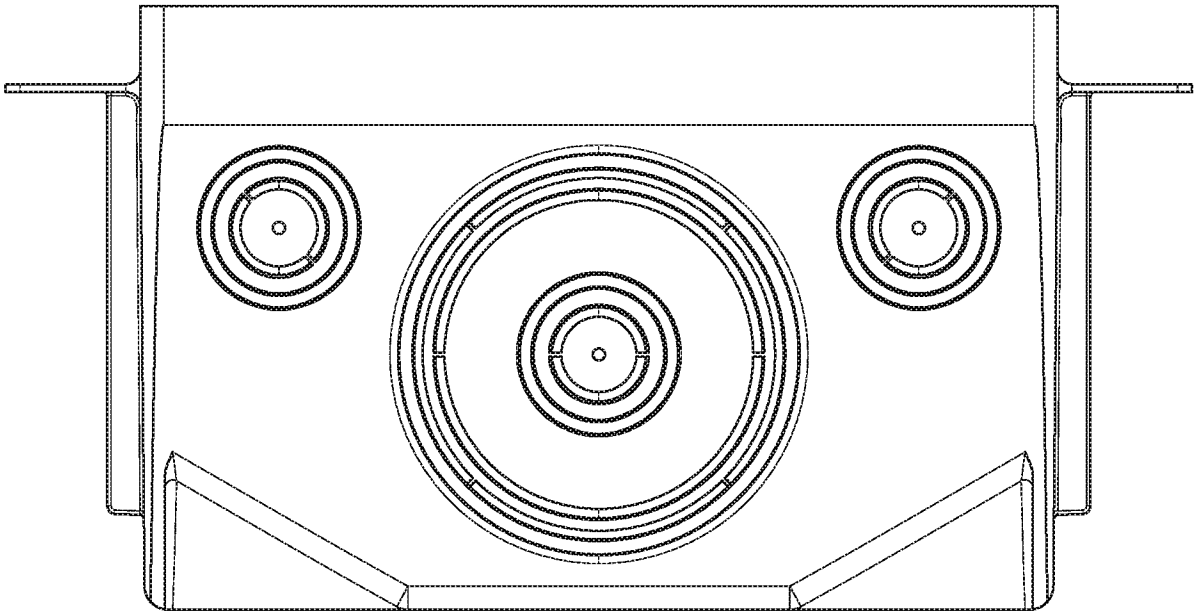
Figure 56A:
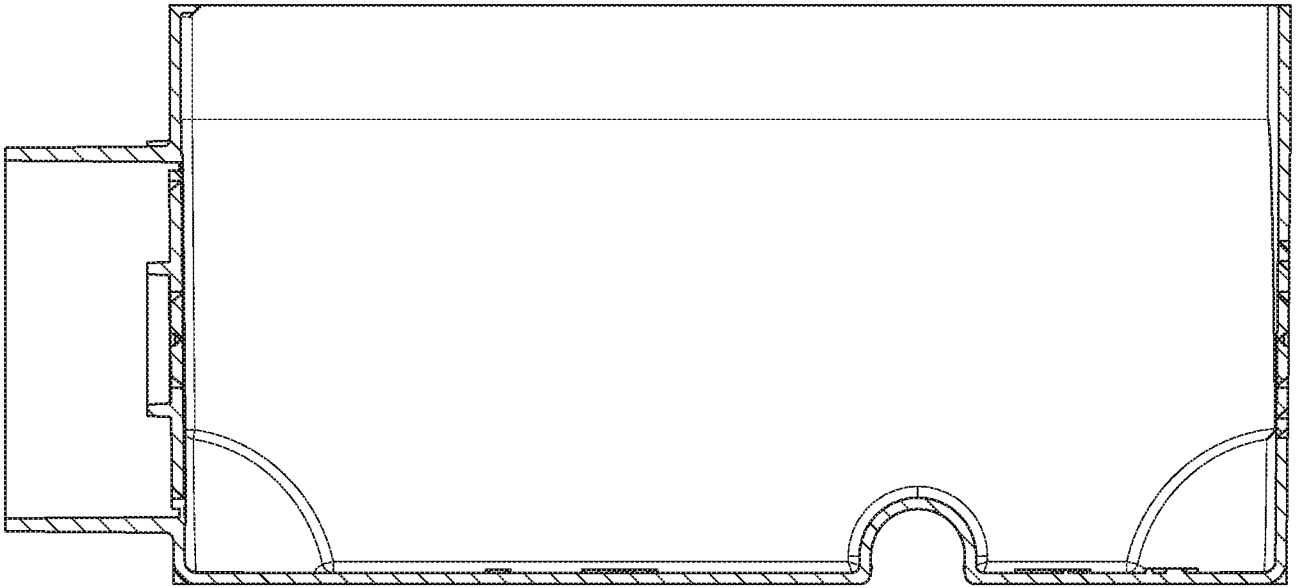
Figure 56B:
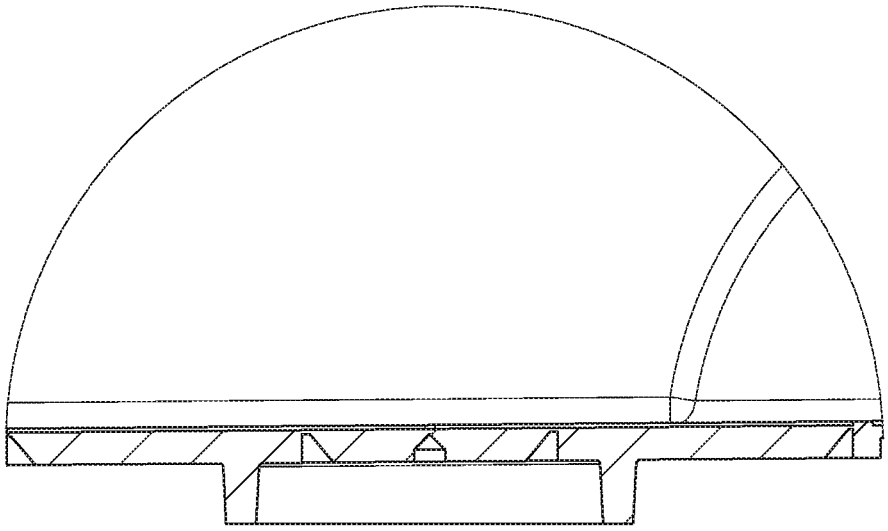
Figure 57:
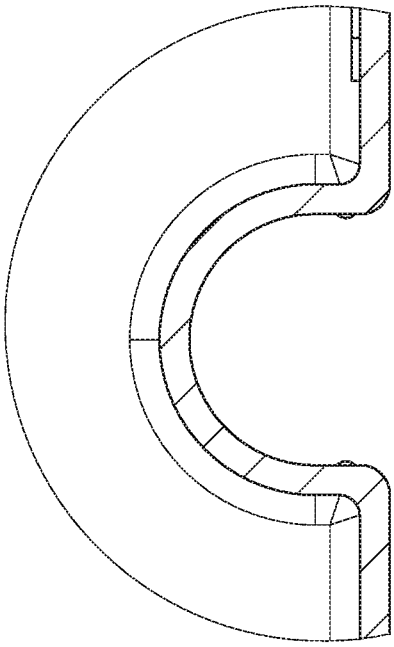
Figure 58:
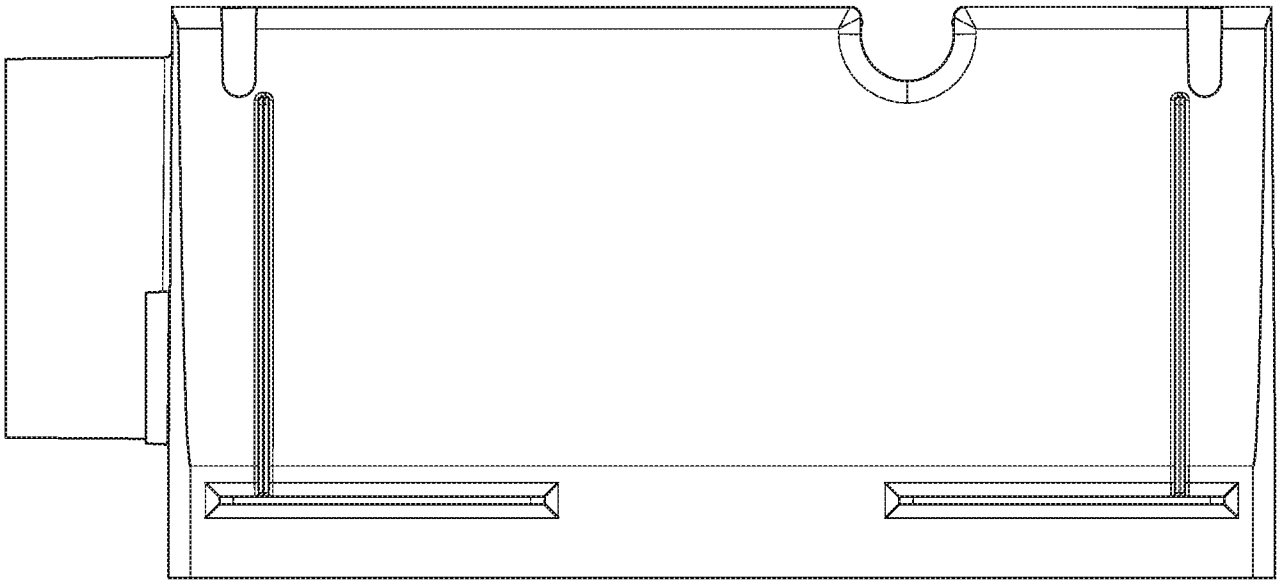
Figure 59:
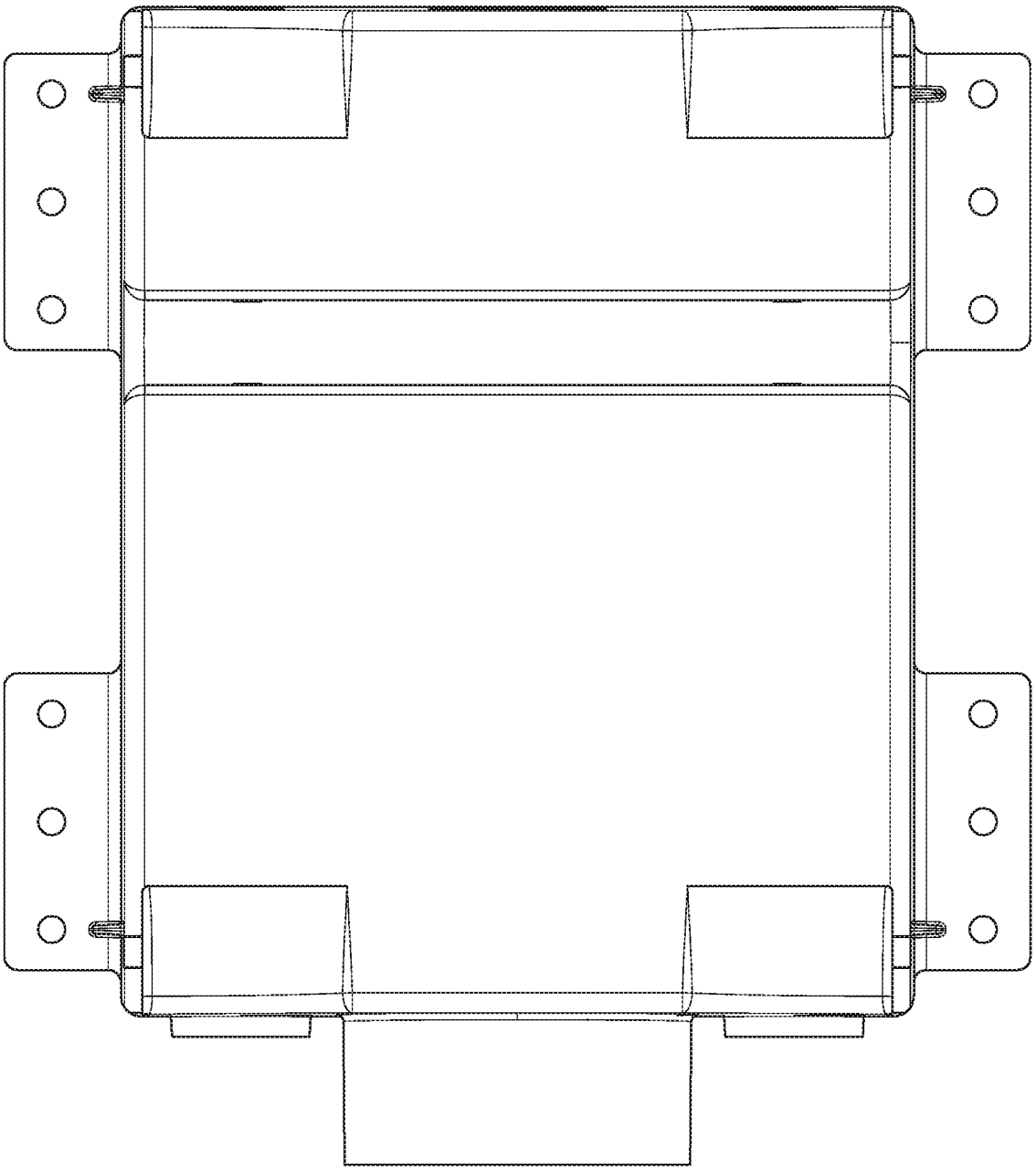
Figure 60:
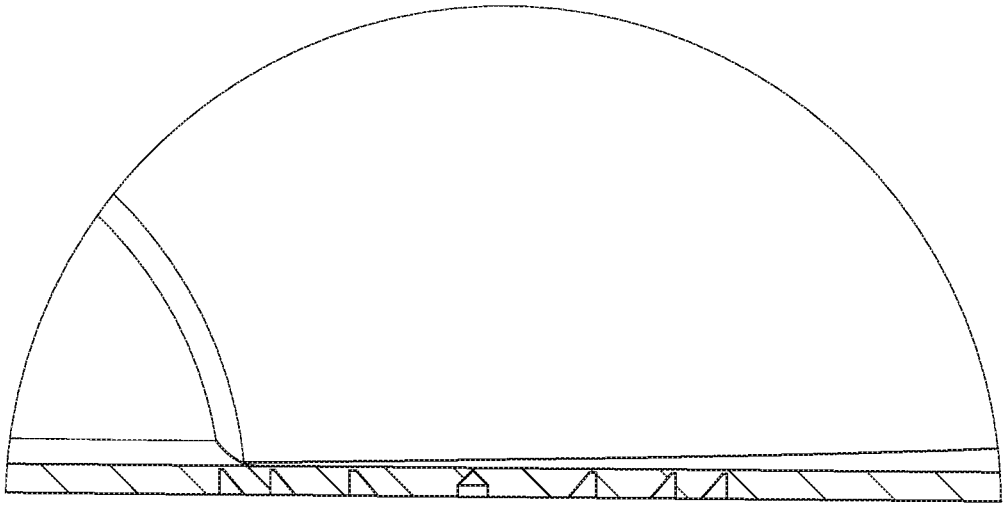
Figure 61A:
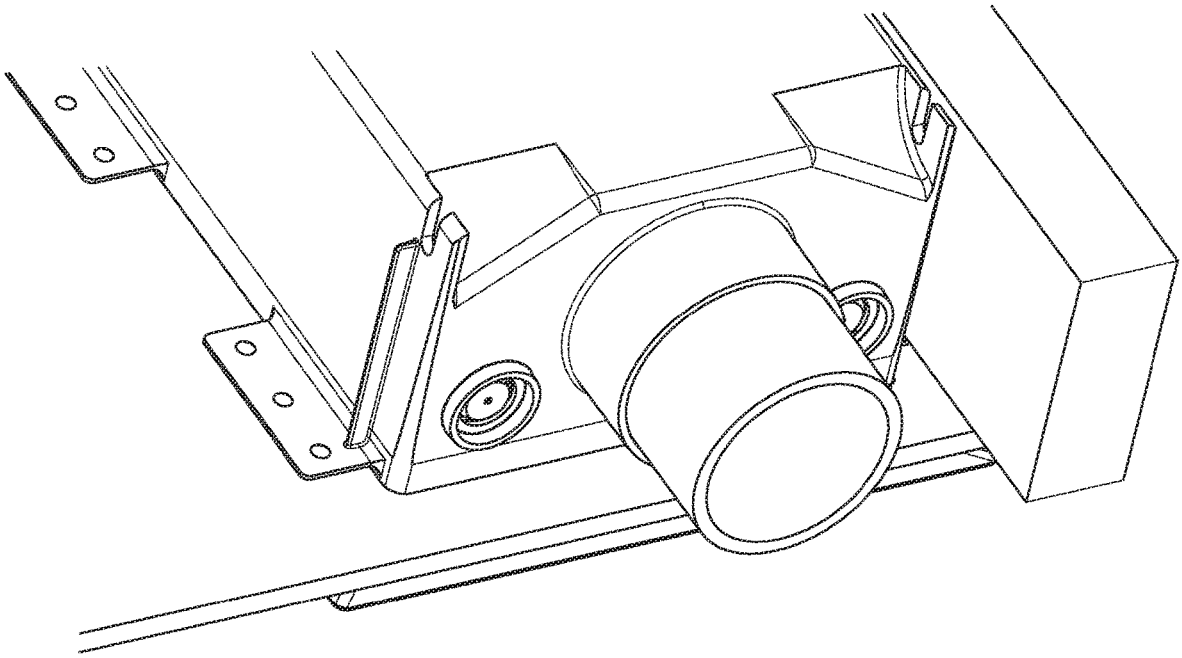
Figure 61B:
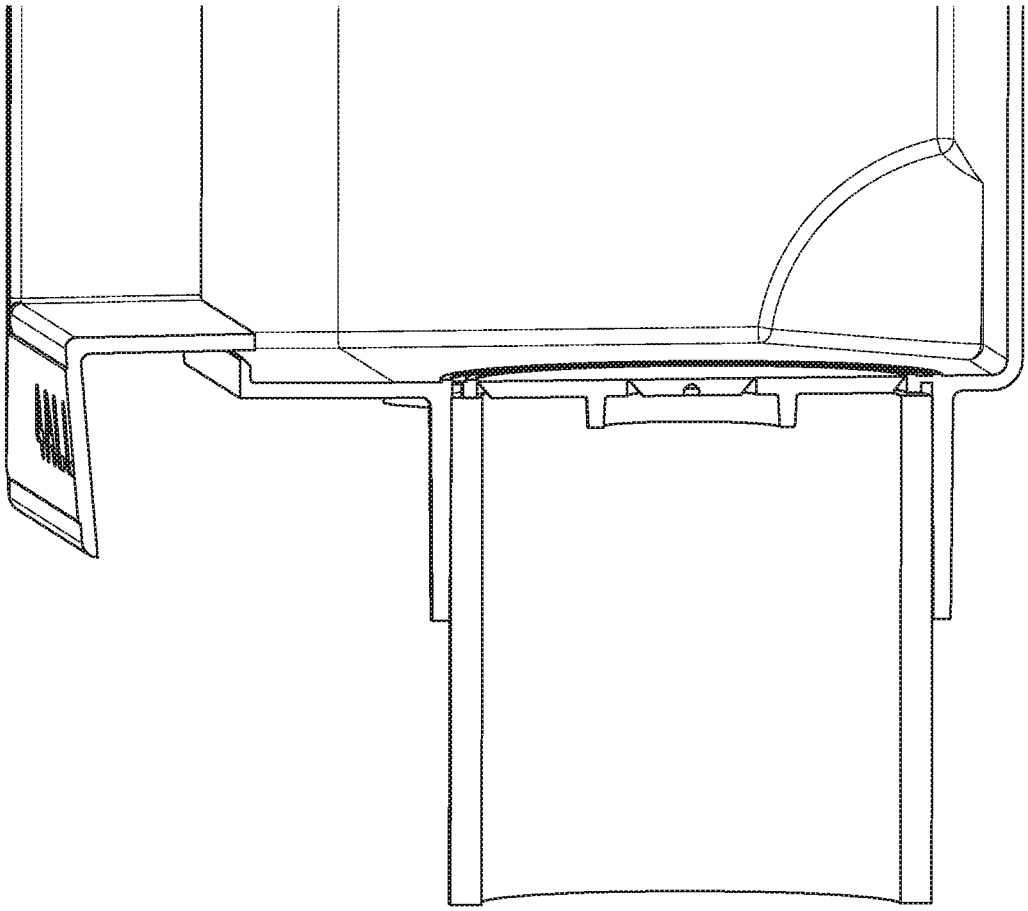
Figure 62:
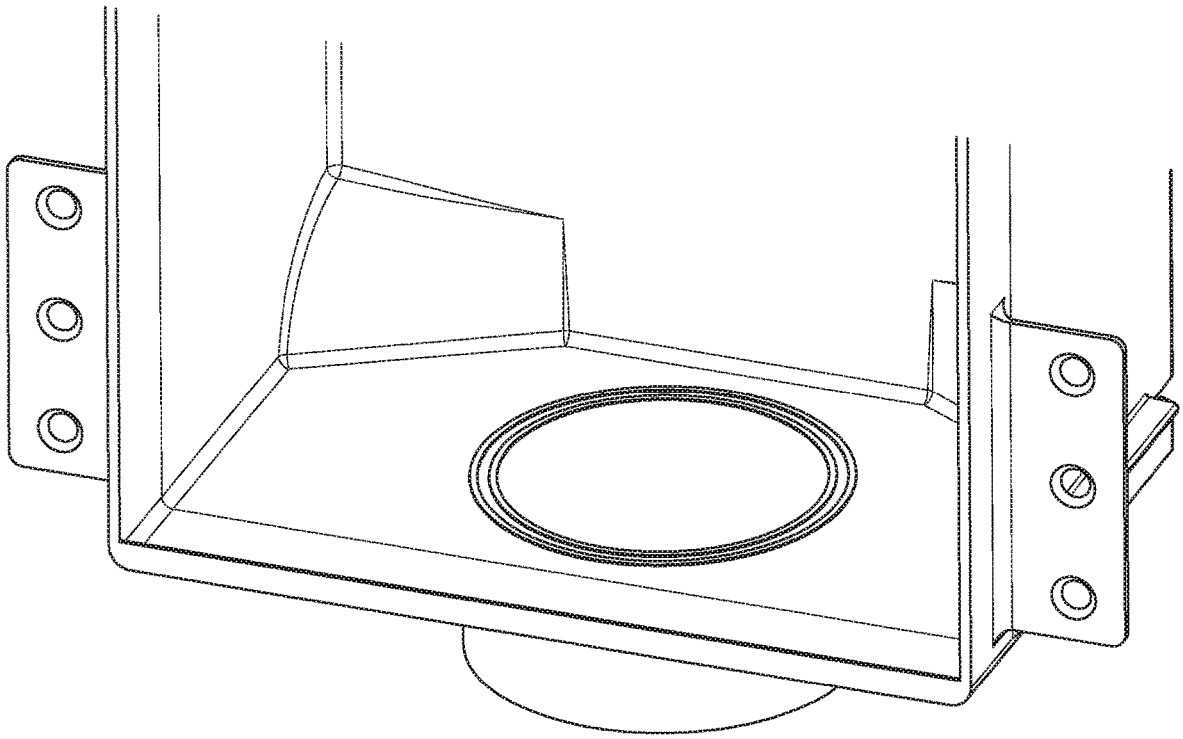
Figure 63A:
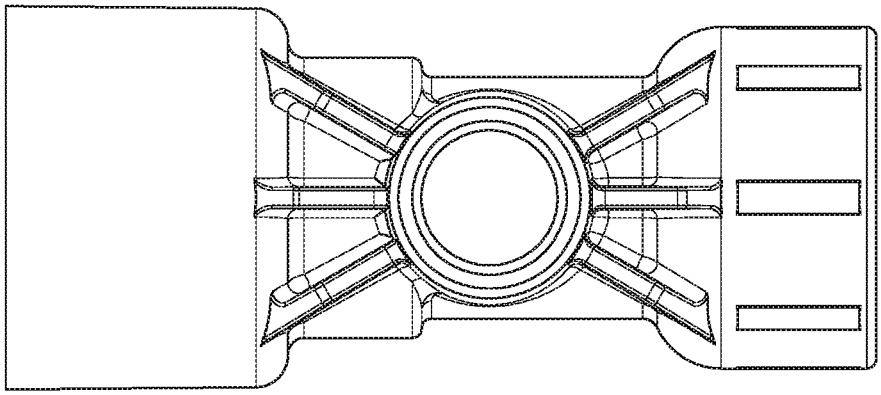
Figure 63B:
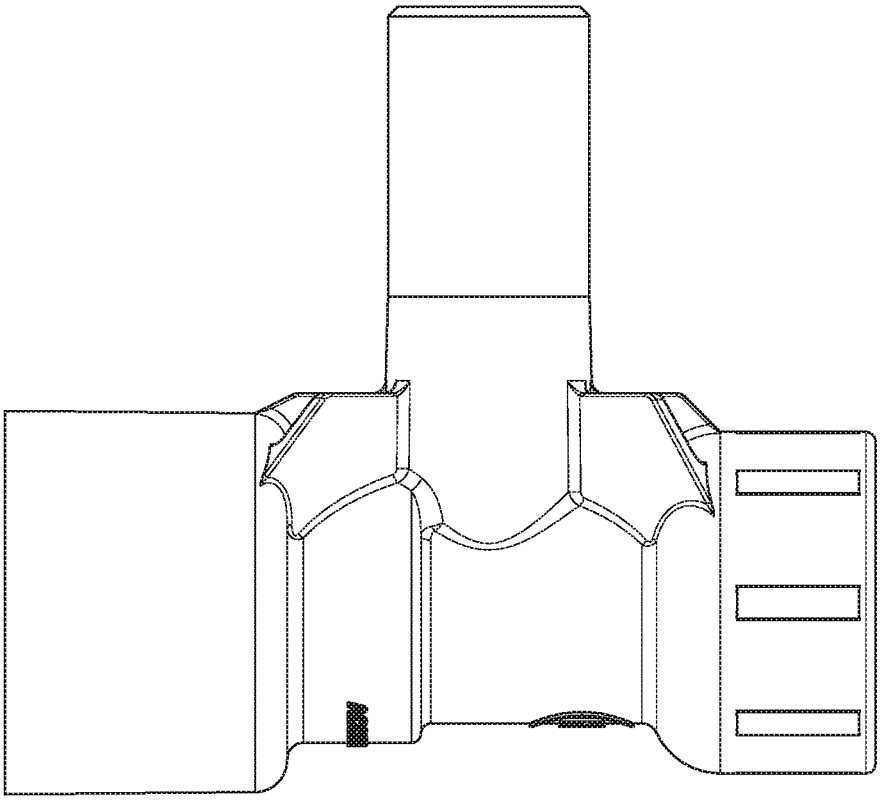
Figure 64:
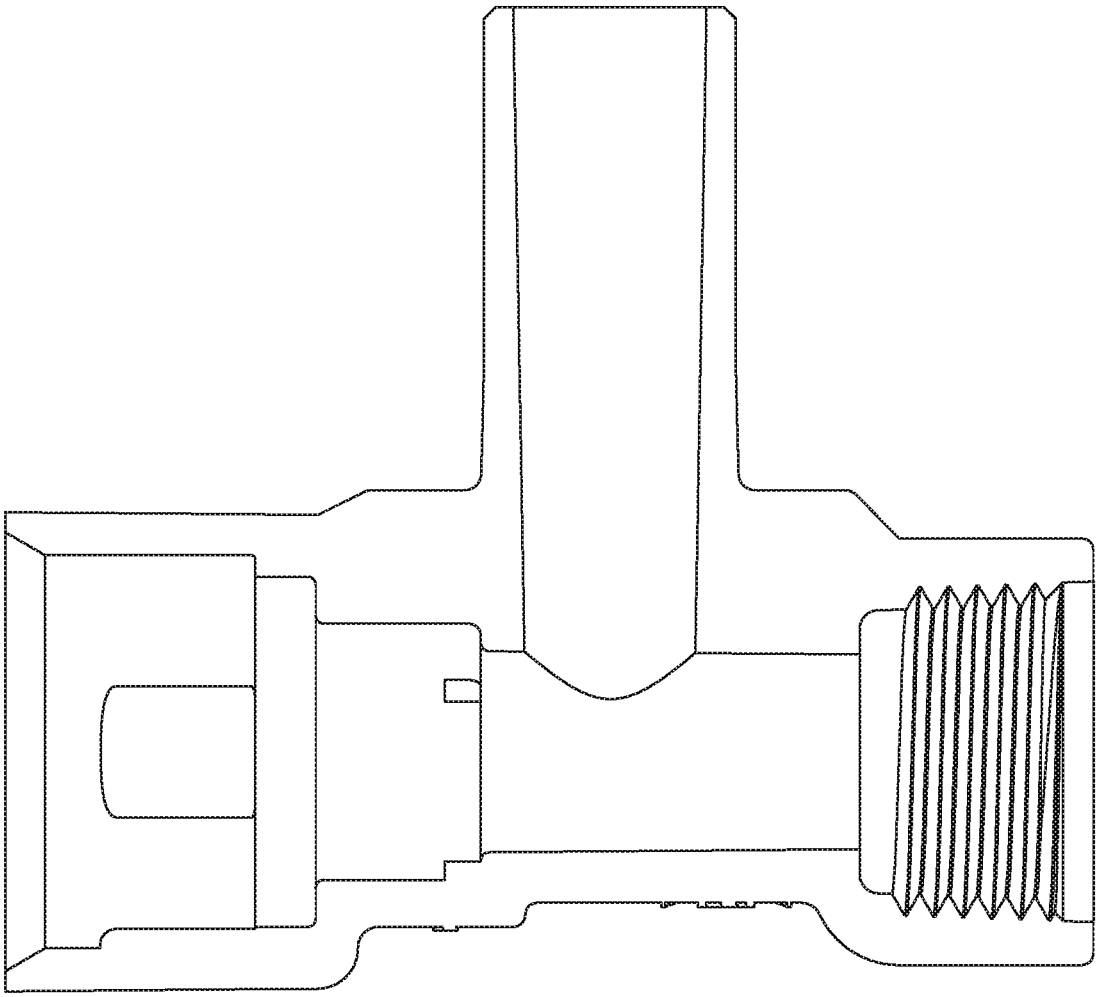
Figure 65A:
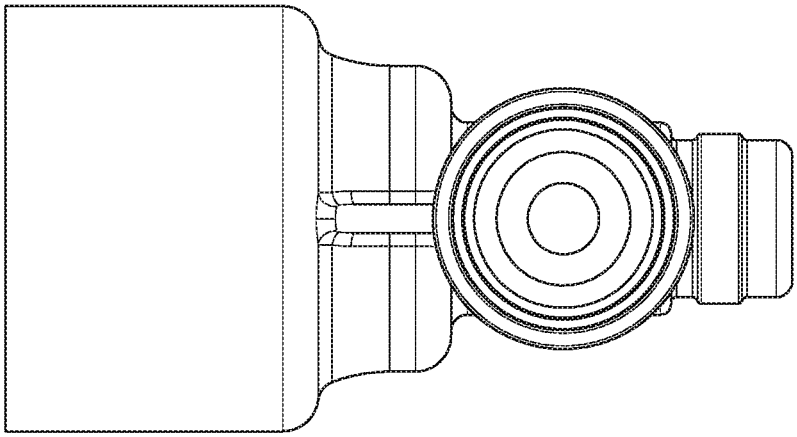
Figure 65B:
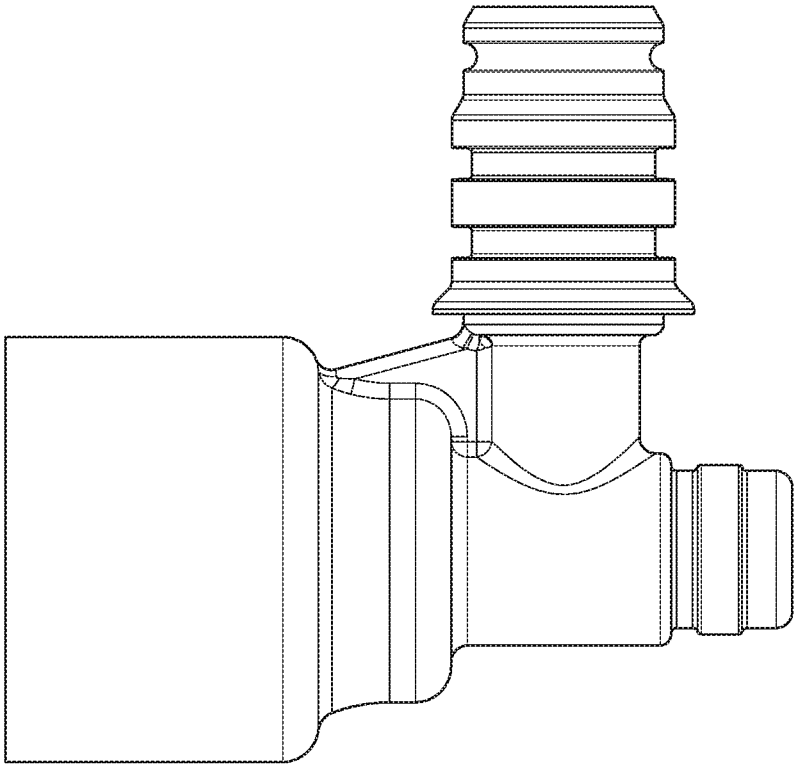
Figure 66:
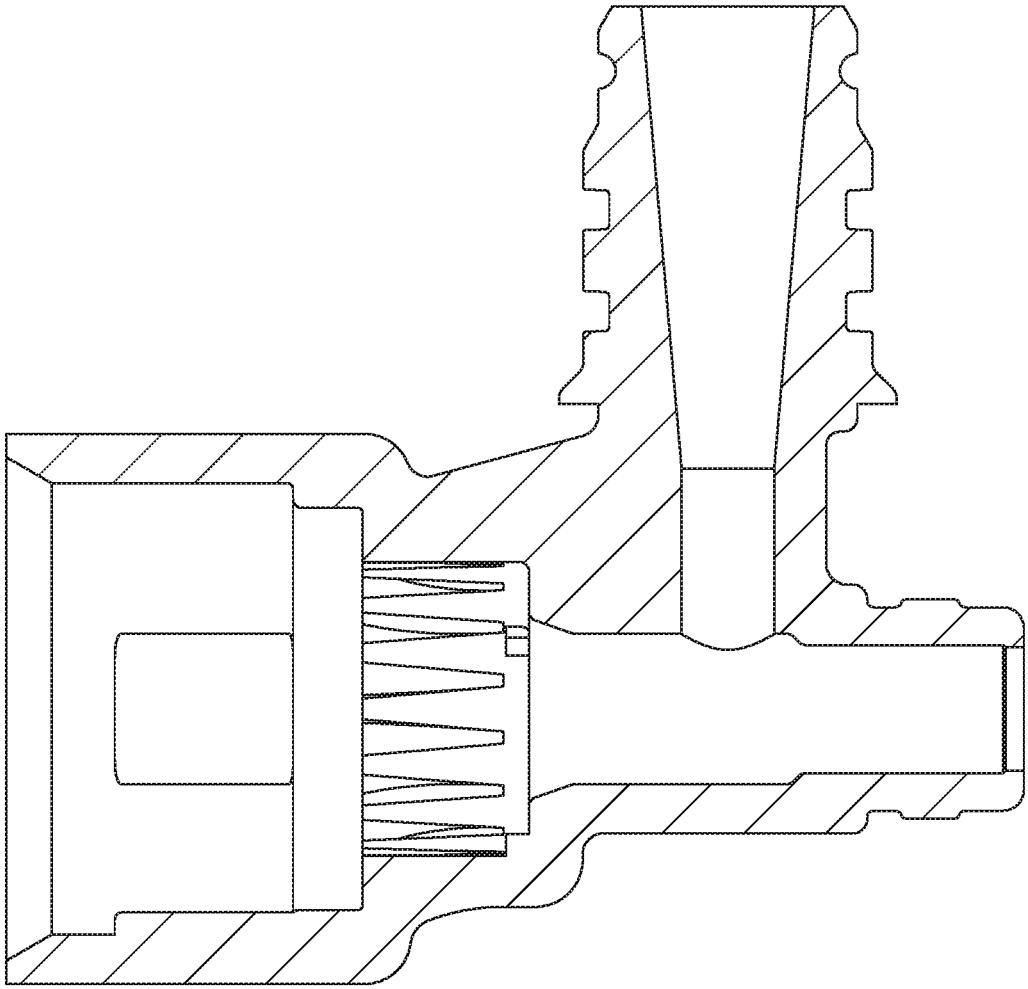
Figure 67:
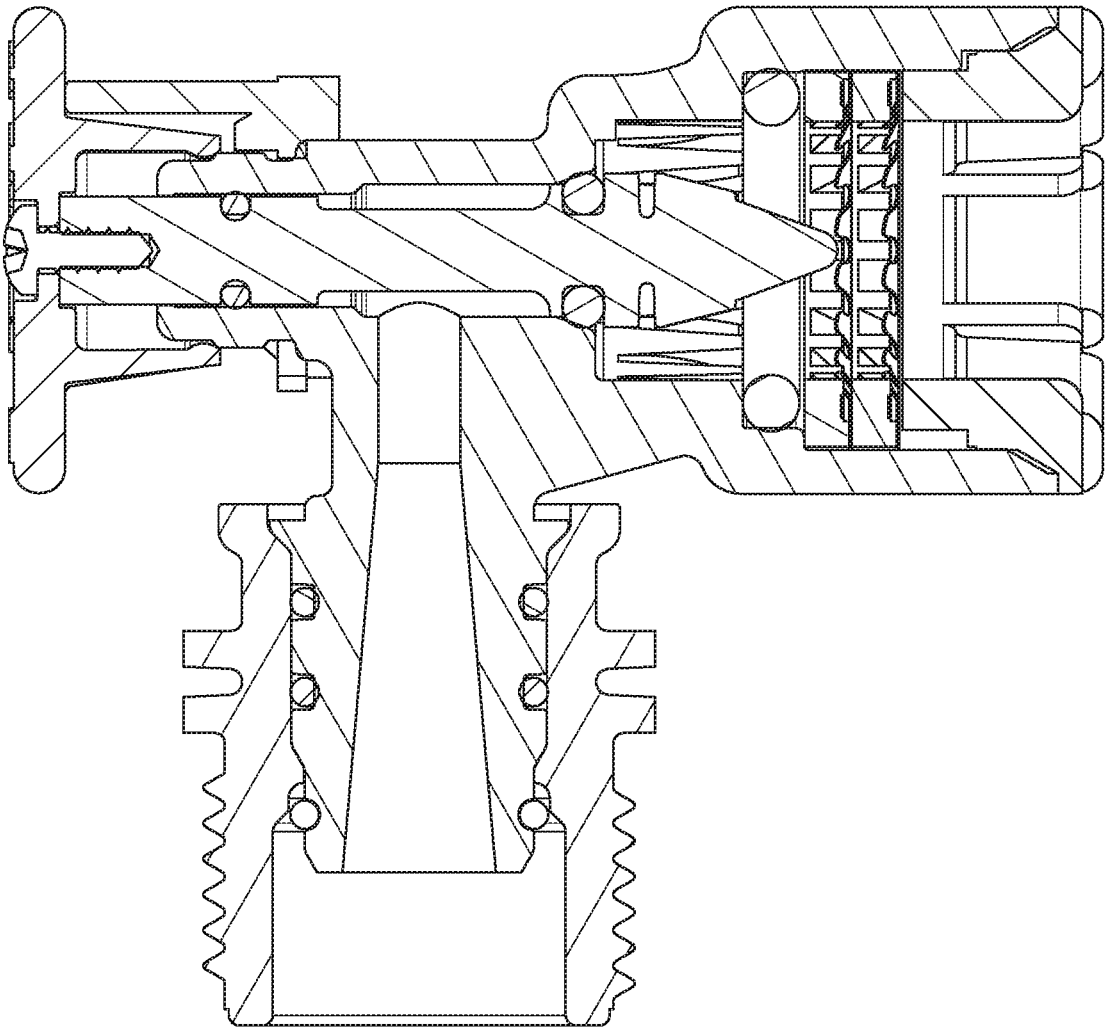
Figure 68:
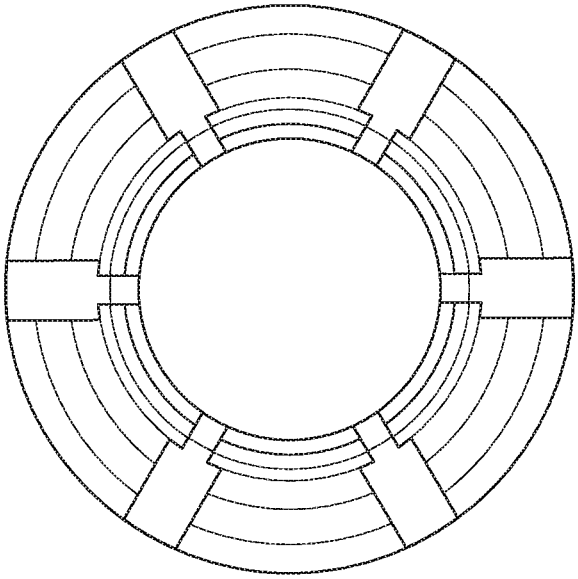
Figure 69:
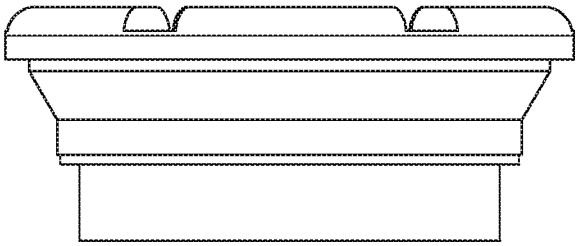
Figure 70:
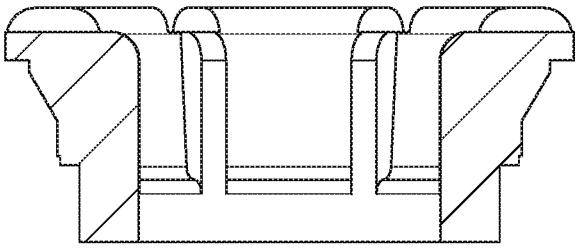
Figure 71:
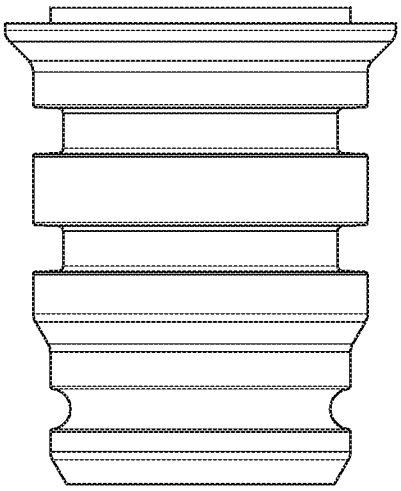
Figure 72:
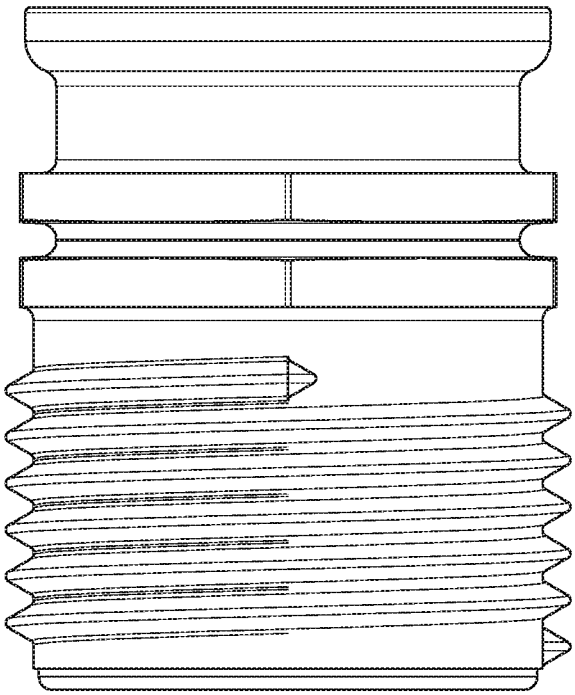
Figure 73:
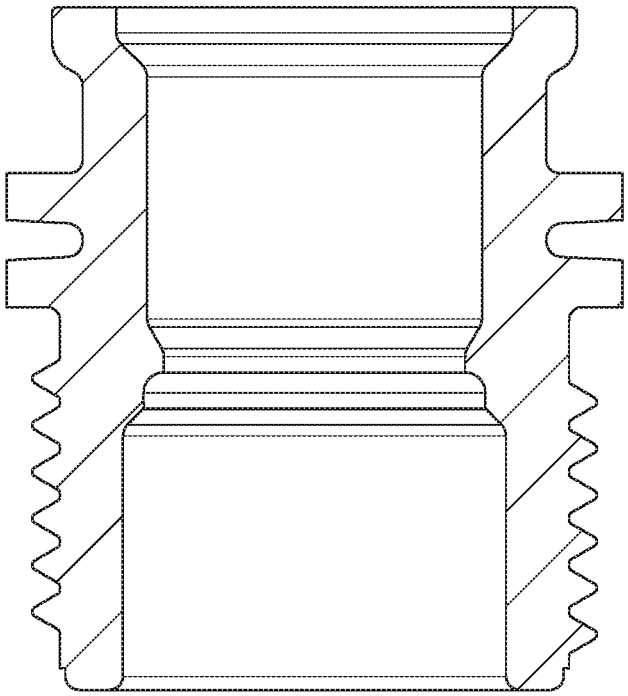
Figure 74:
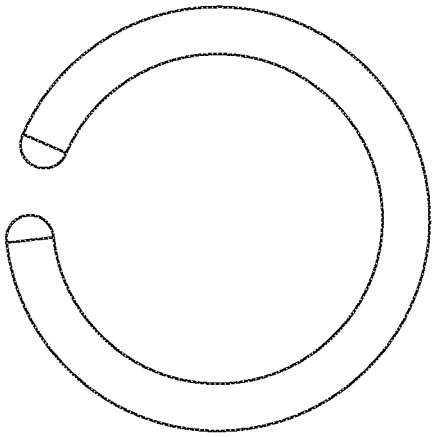
Figure 75A:
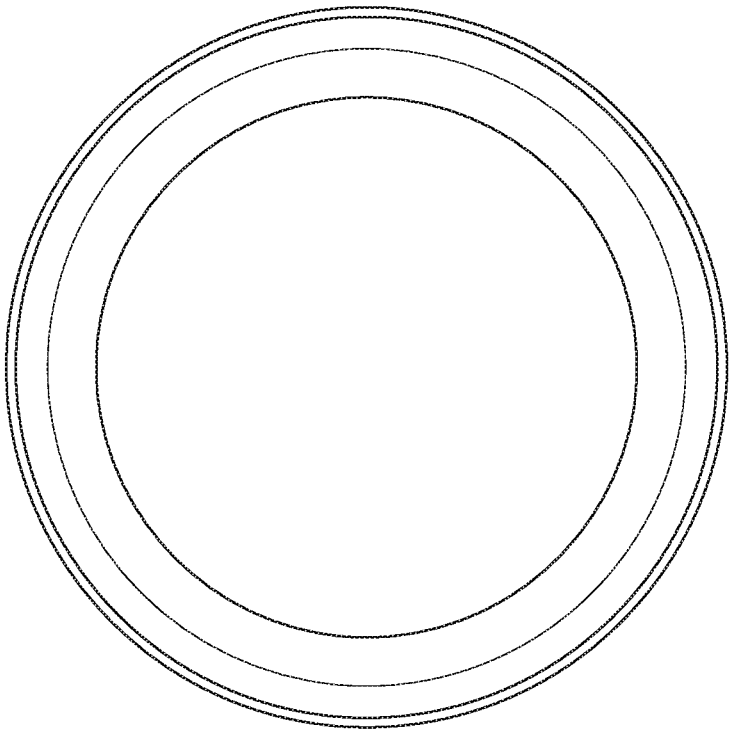
Figure 75B:
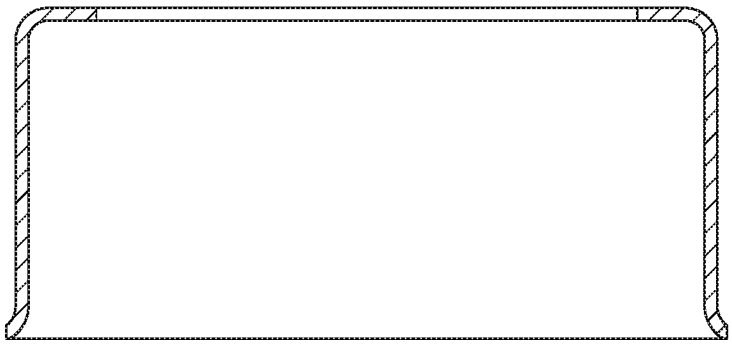
Figure 76:
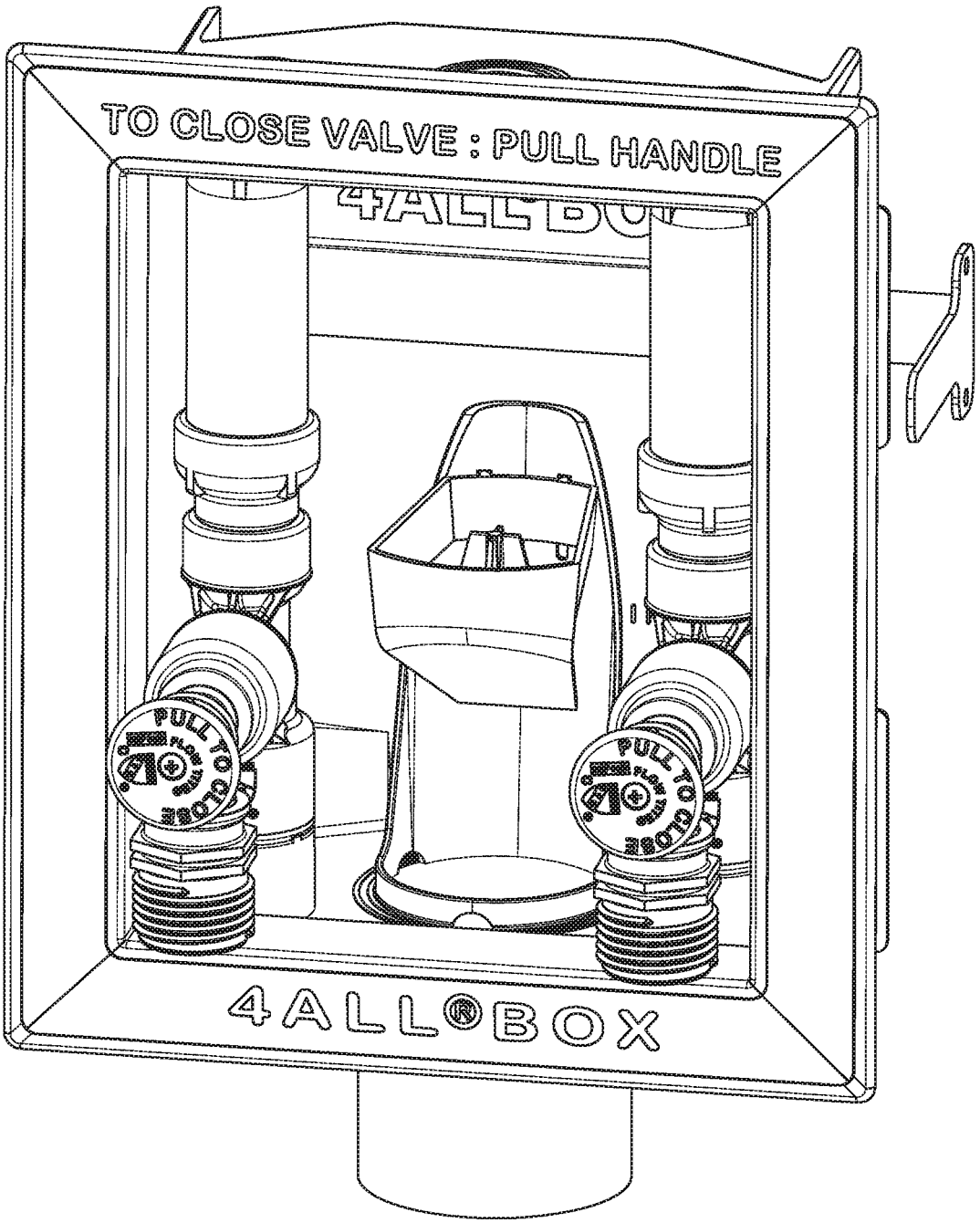
Figure 77:
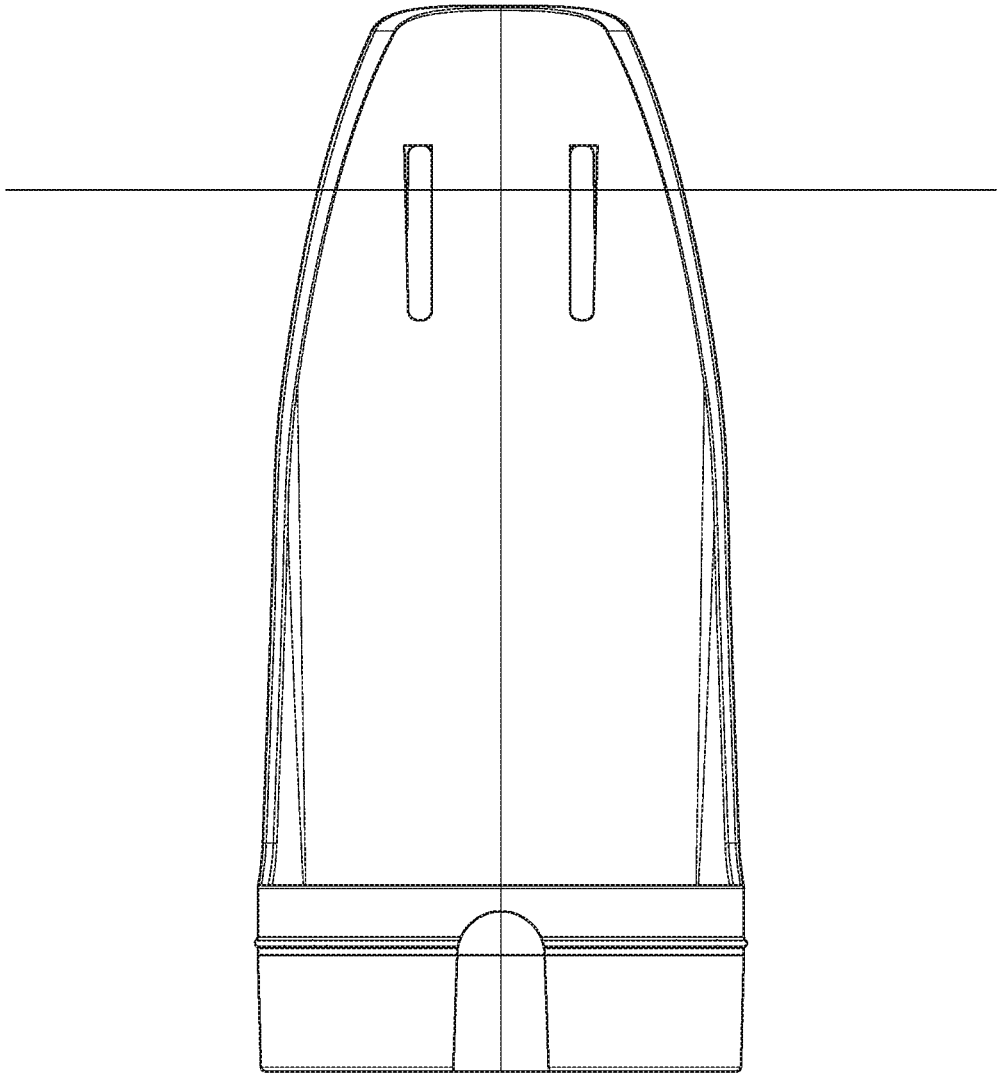
Figure 78:
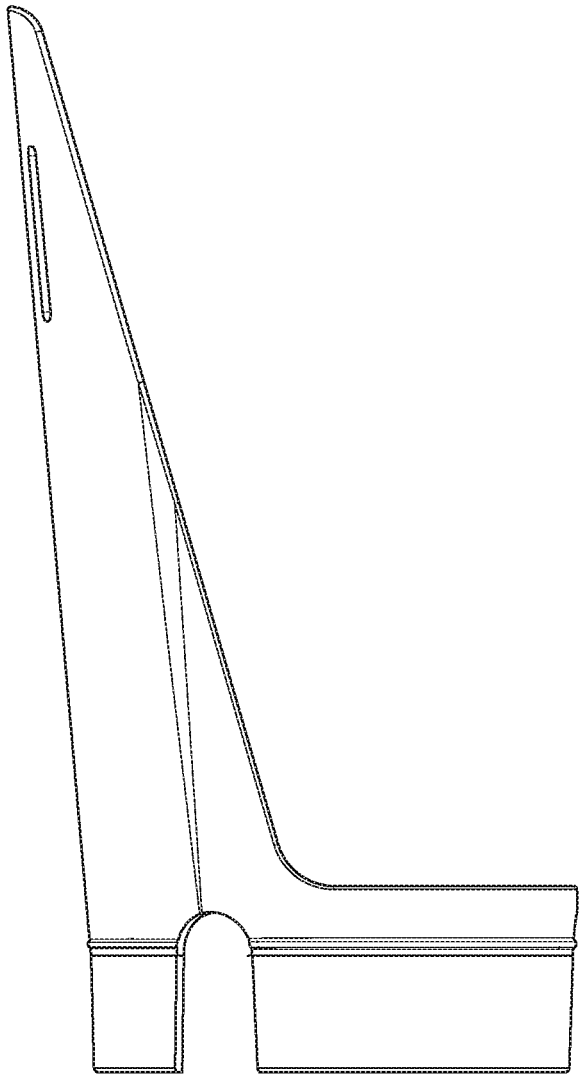
Figure 79:
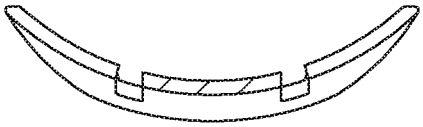
Figure 80:
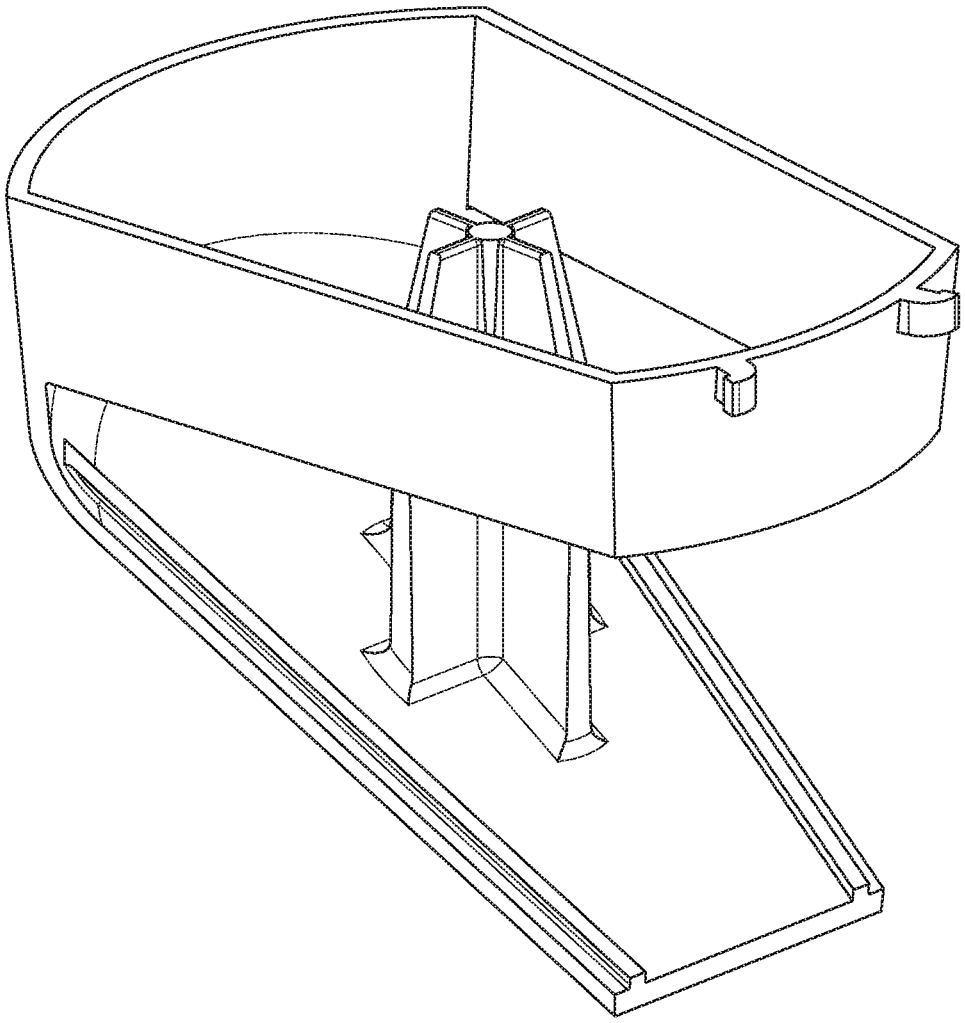
Figure 81:
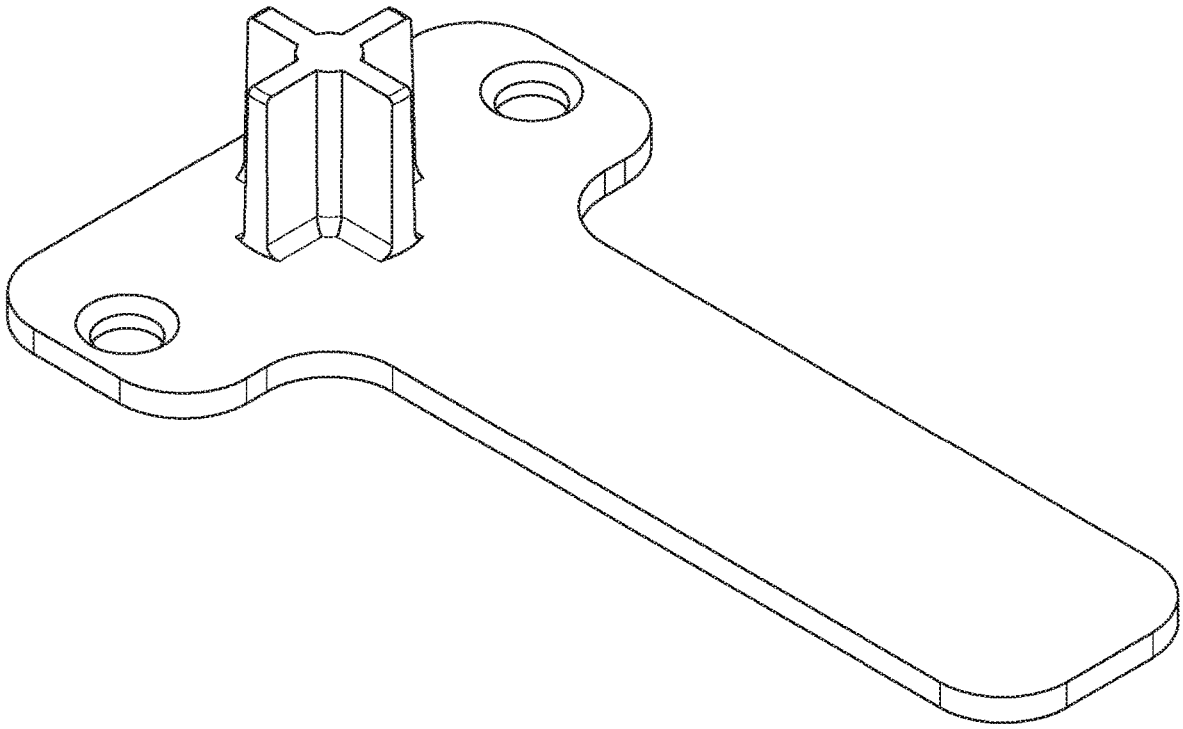
Figure 82:
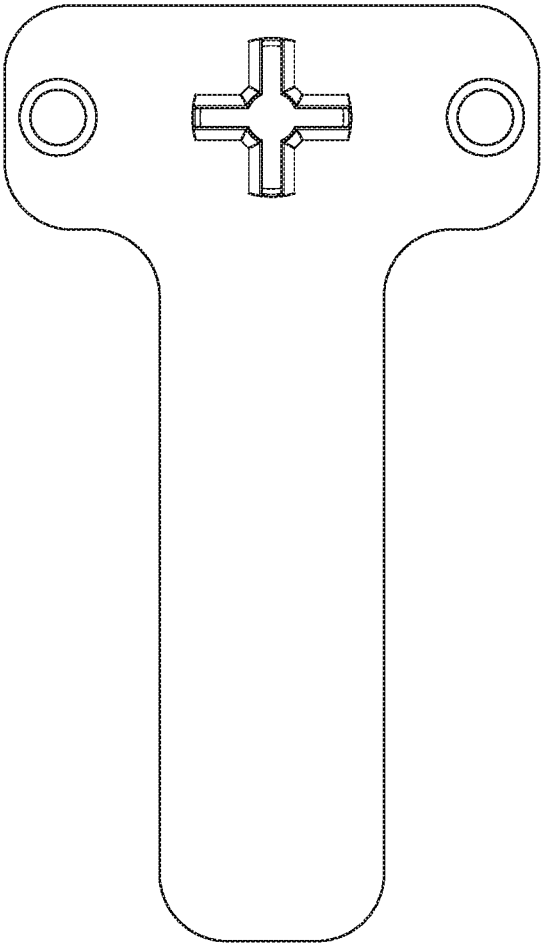
Figure 83:
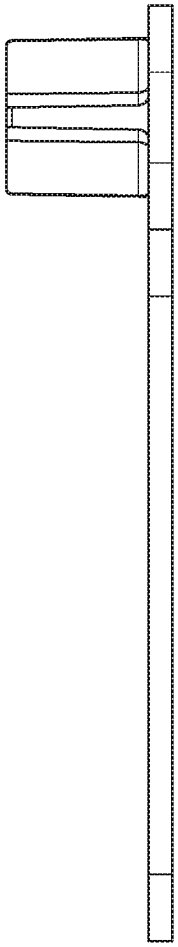
Figure 84:
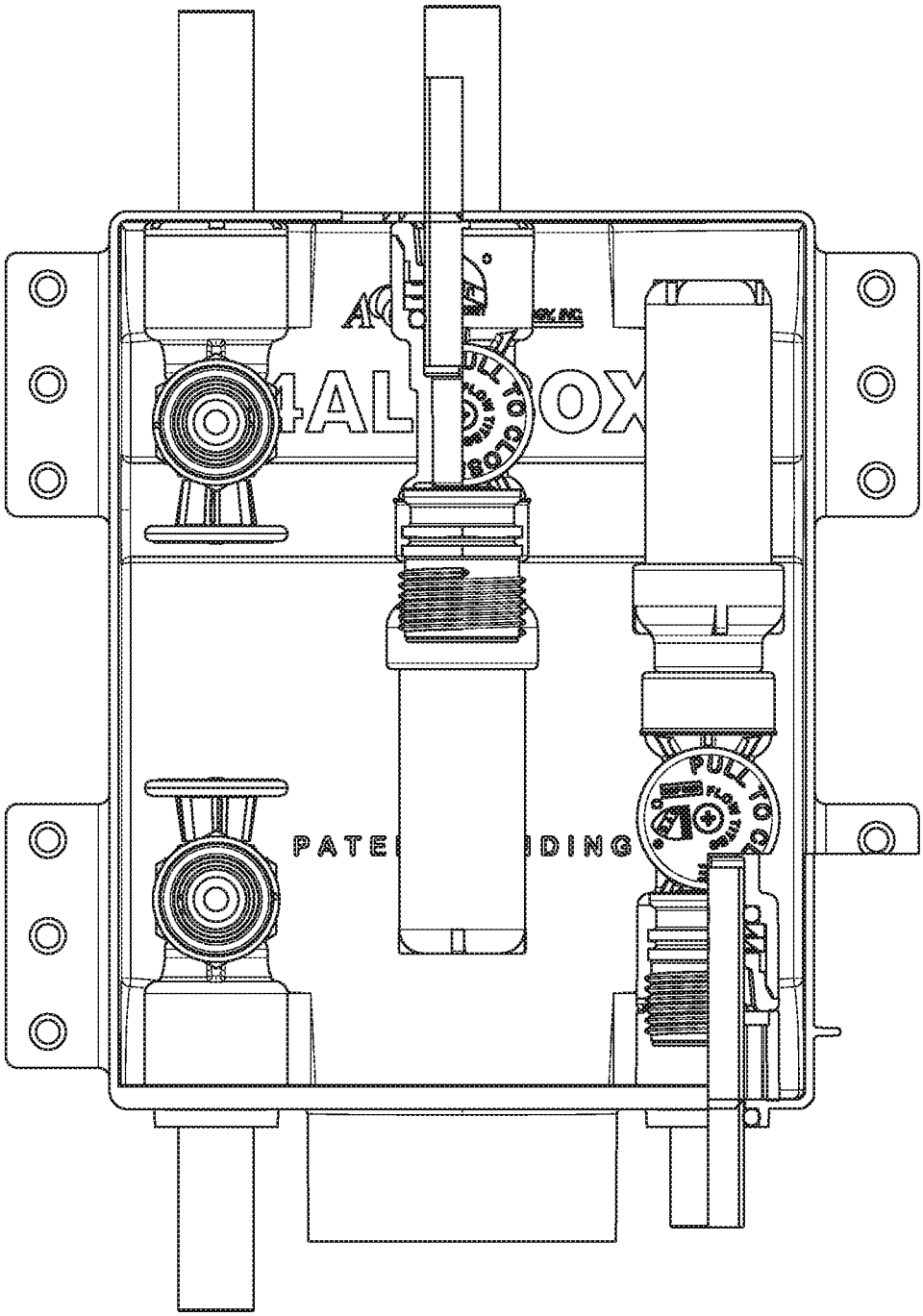
Figure 85:
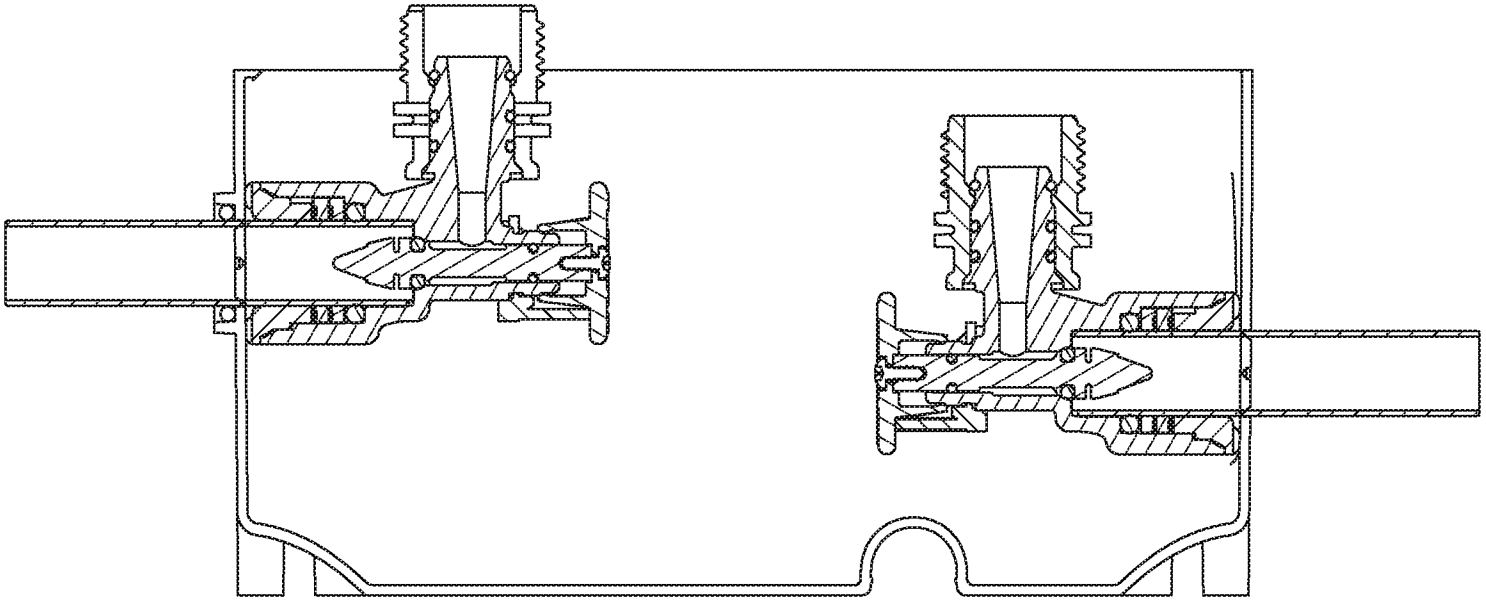
Figure 86:
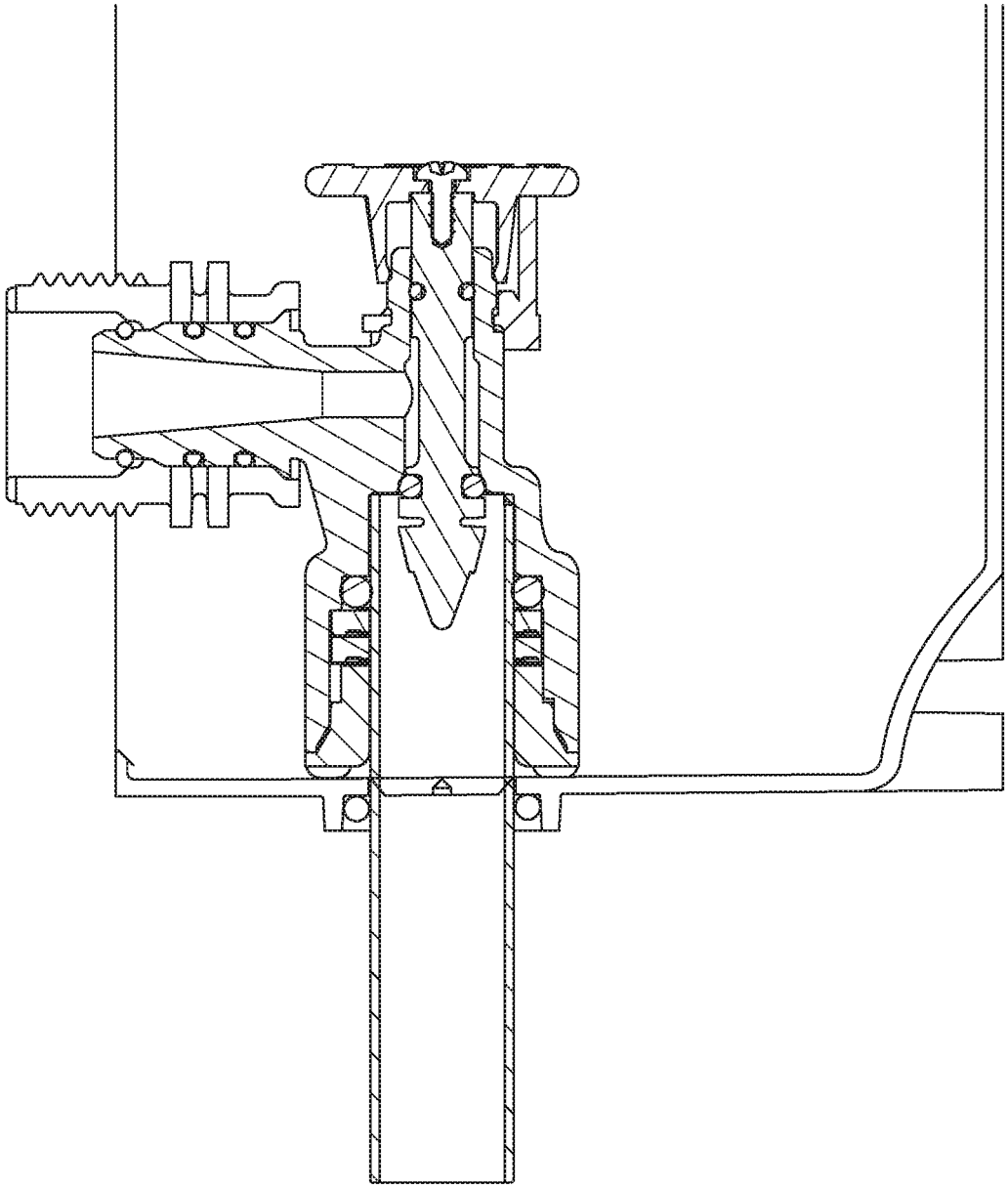
Figure 87A:
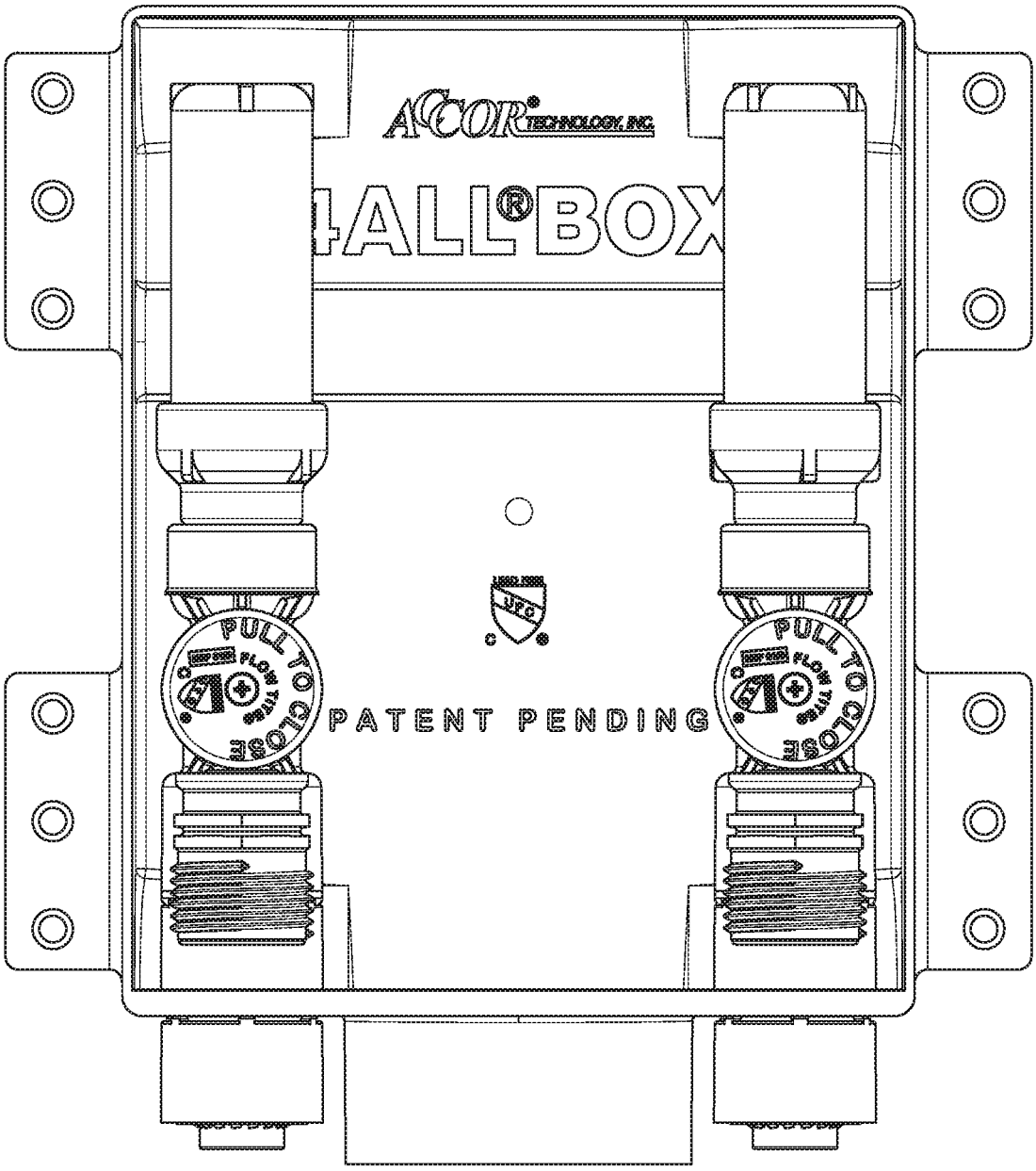
Figure 87B:
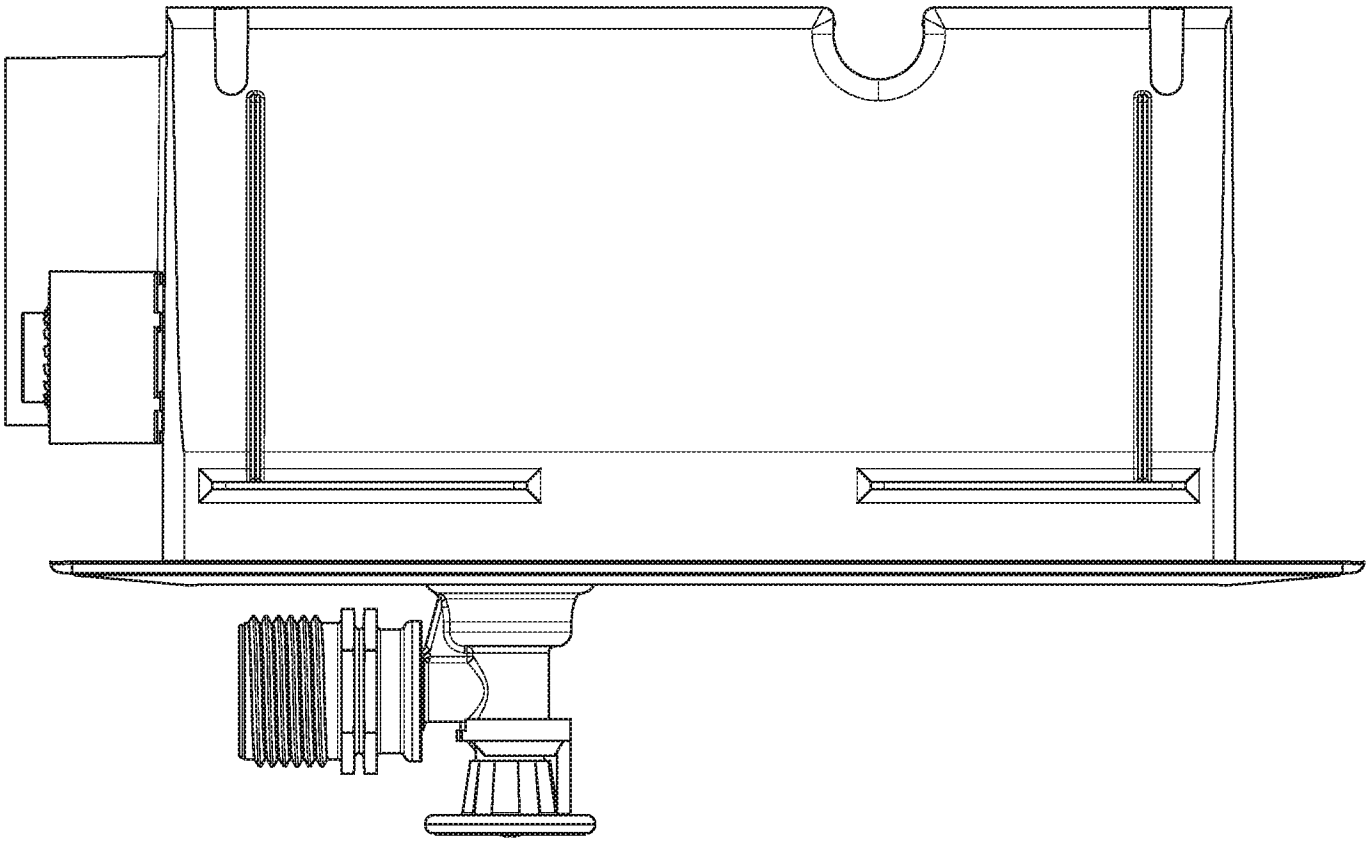
Figure 87C:
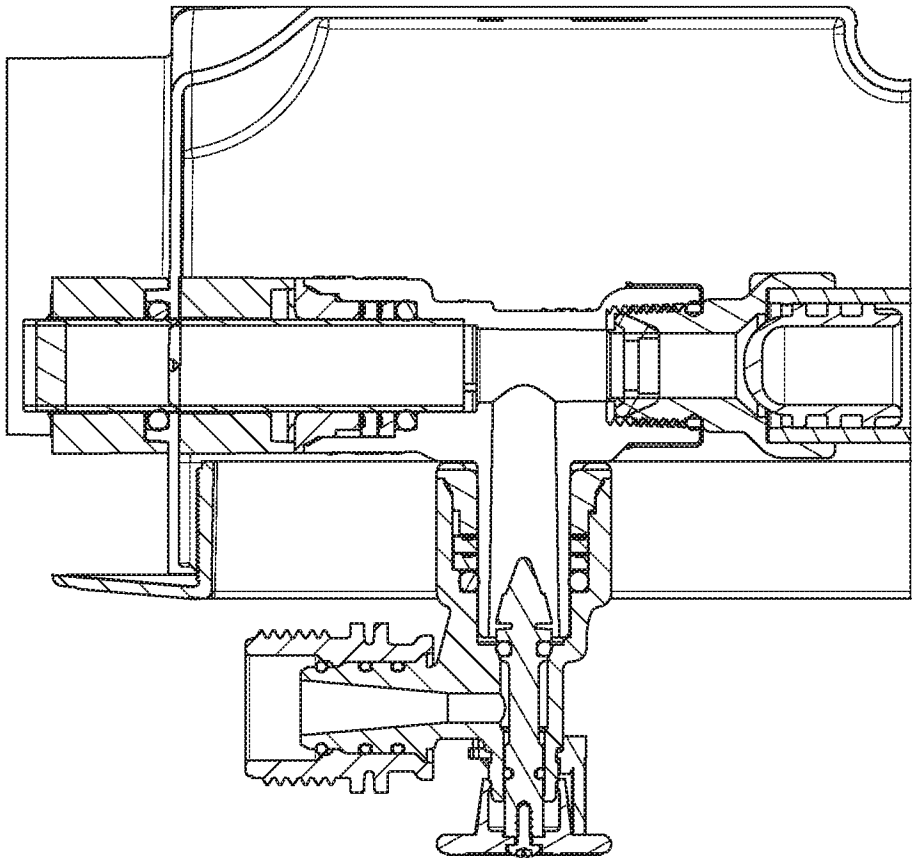
Figure 88A:
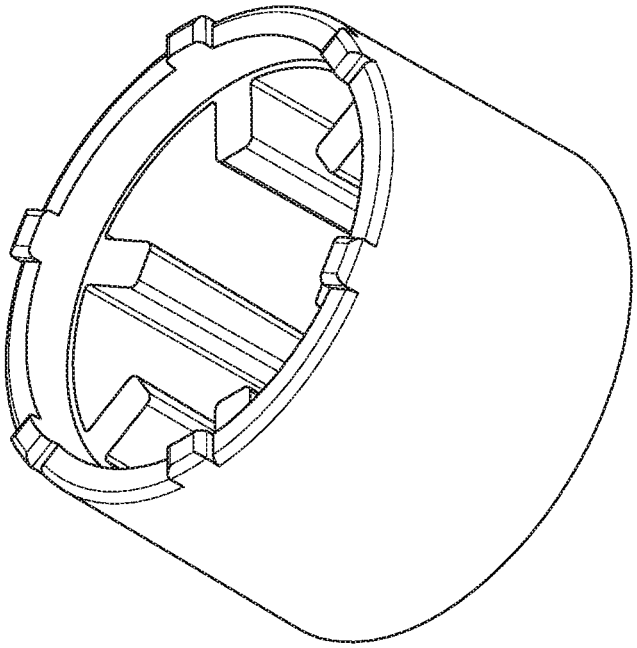
Figure 88B:
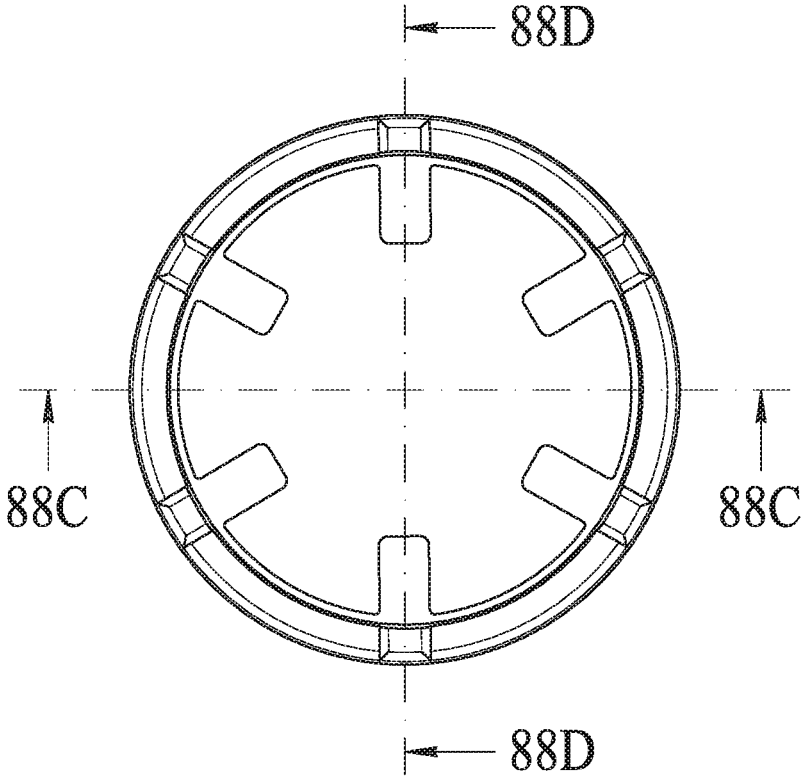
Figure 88C:
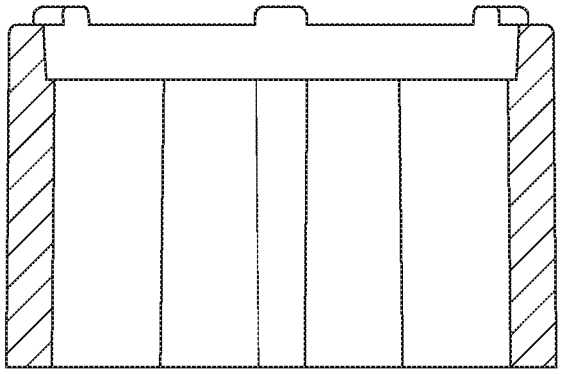
Figure 88D:
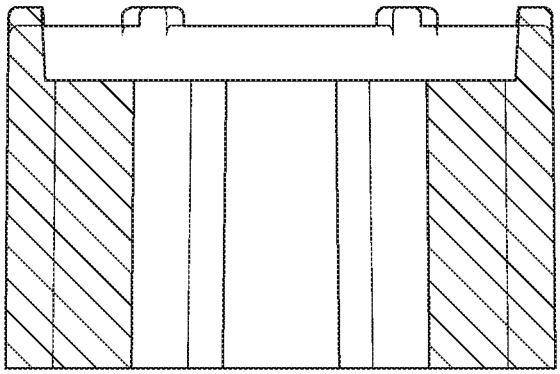
Figure 89:
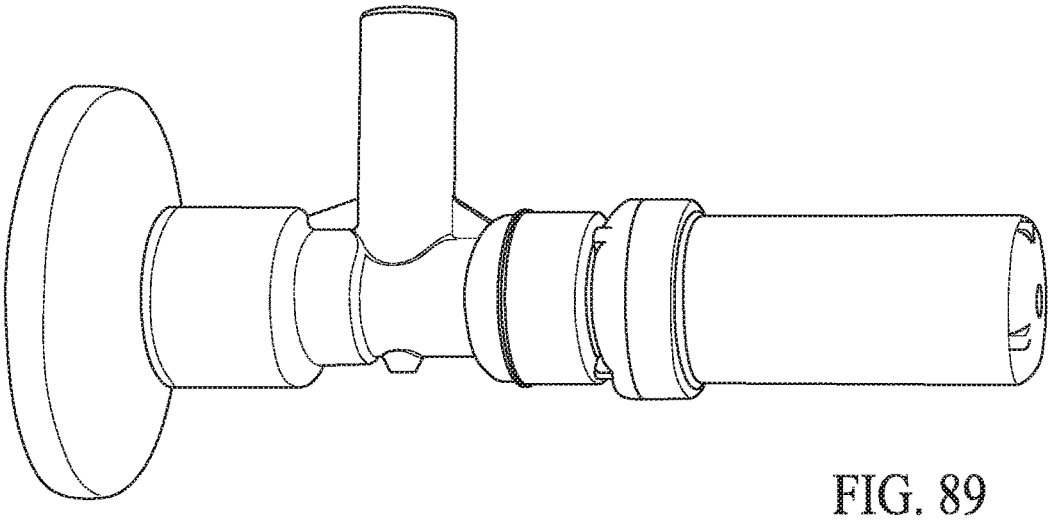
Figure 90:
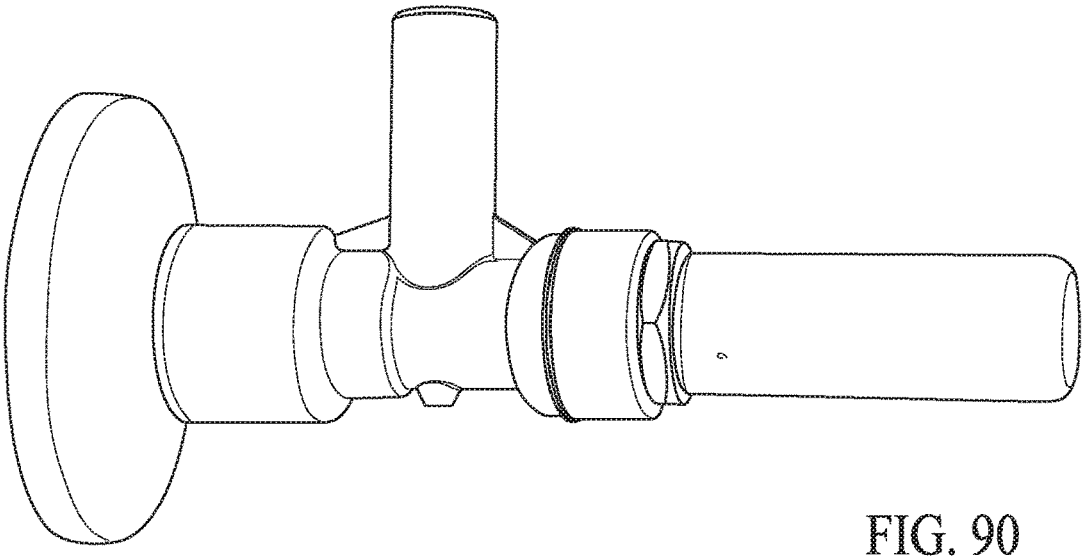
Figure 91:
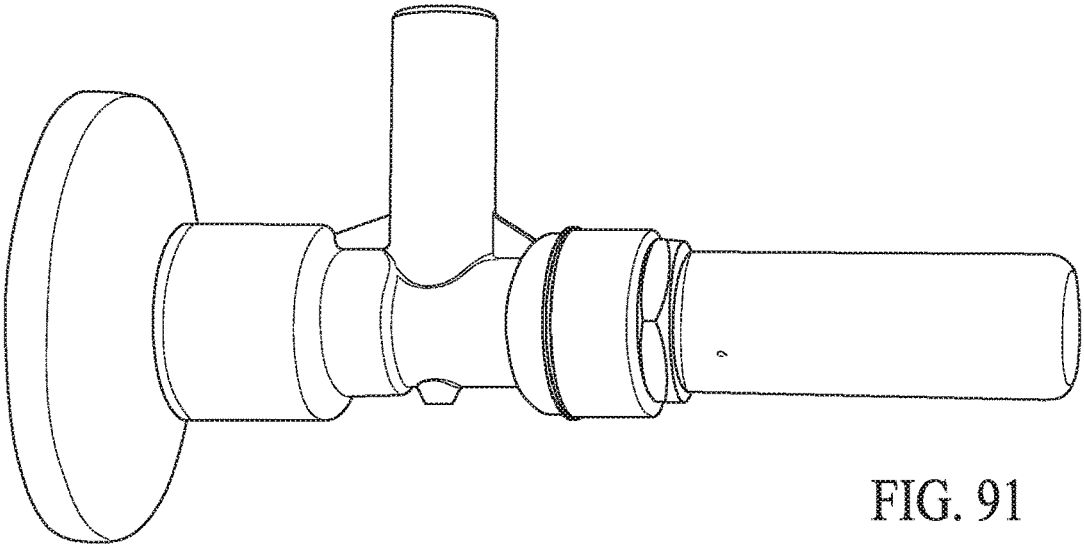
Figure 92:
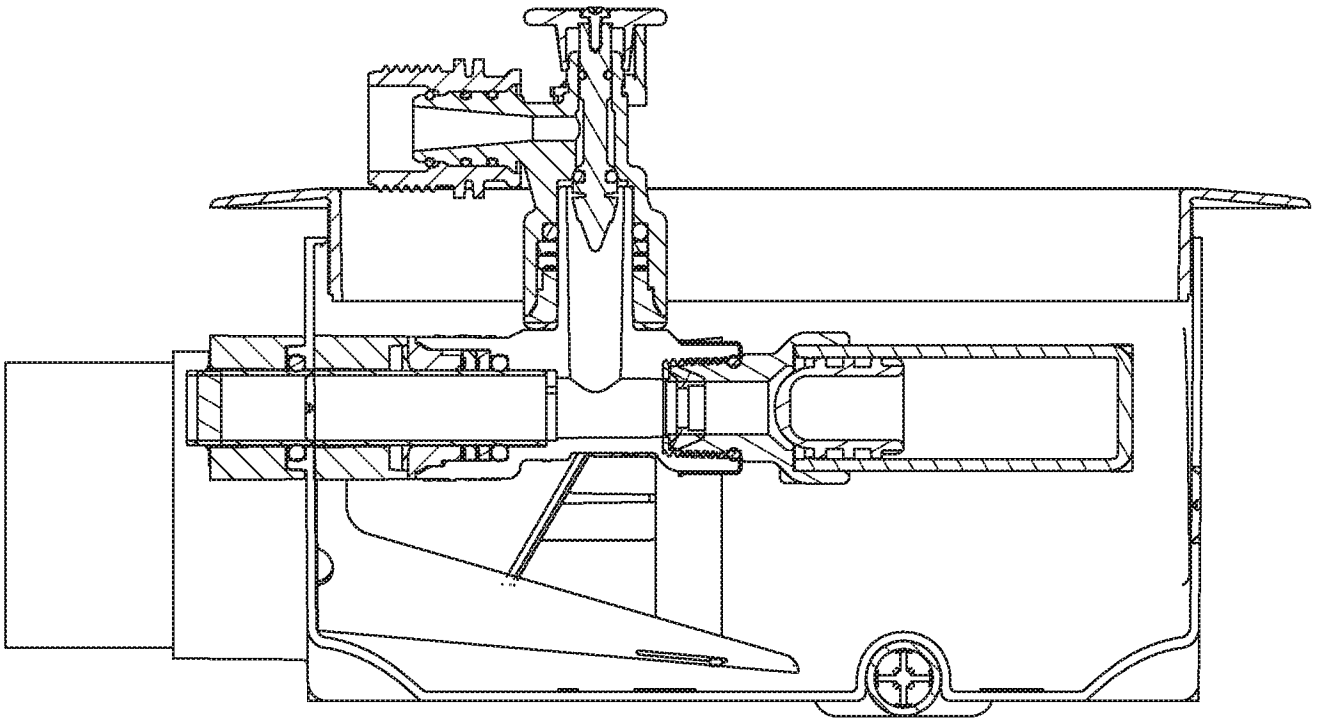
Figure 93:
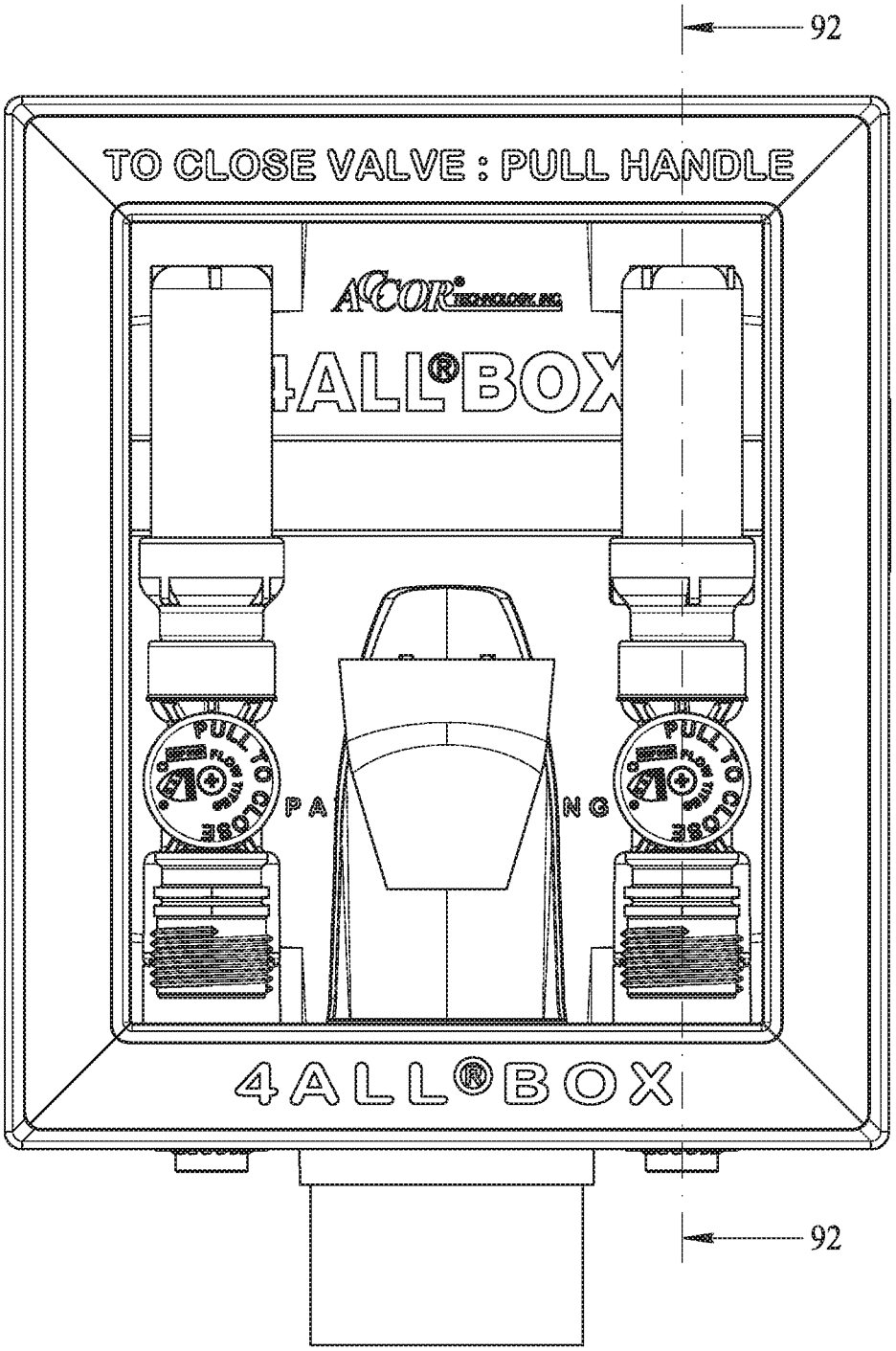

In one aspect, water supply valves 28 may be installed in the first lower receptacles 30, as shown in FIGS. 1, 31, 48, 49 and 50. During installation of the utility box 10 in a building wall, the knockout portions 34 are removed leaving an aperture through which the pipe 35 may be inserted. Referring to FIGS. 2 and 50, an upper end of the pipe 35 may be inserted through a metallic gripper ring 48 having circumferentially spaced axially and radially inwardly protruding teeth described in U.S. Pat. No. 6,464,266, which is incorporated herein in its entirety by reference. The upper end of the pipe 35 may then be inserted through the O-ring 46 and through the aperture of the lower first receptacle, positioning the upper end of the pipe 35 above the lower wall 22 within the cavity portion 14 of the housing main box 12. The O-ring 46 is positioned within the cylindrical sidewall 40 near or against the lower surface 42 of the lower wall 22. Thereafter, the valve assembly 28 may be installed over the upper end of the pipe 35 in the cavity portion 14. The valve assemblies may be installed in the upper receptacles of the box main housing 12, as shown in FIG. 48, for example.

Figure 31:
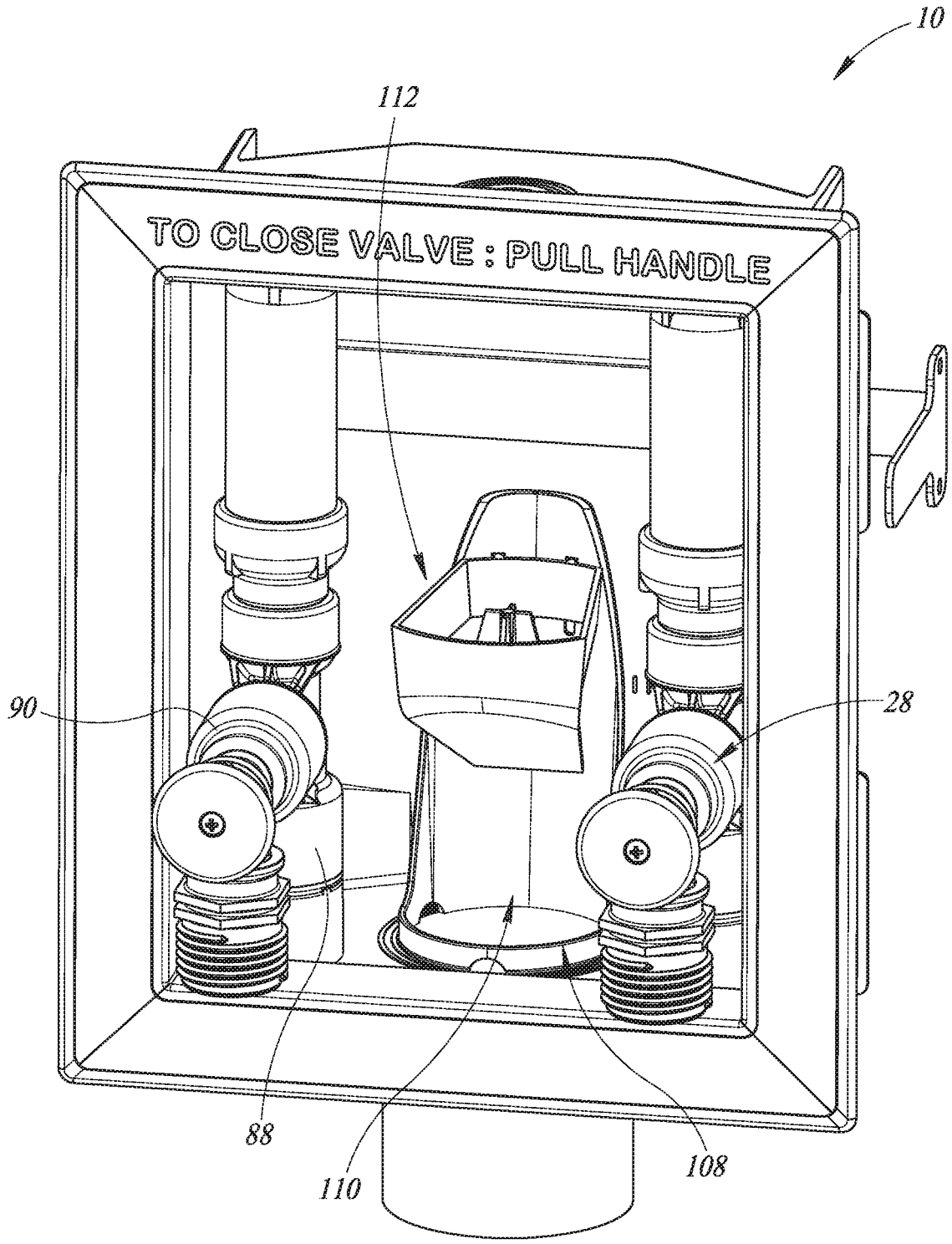
FIG. 31 illustrates the utility box of FIG. 1 equipped with a pair of valve assemblies and a drain assembly.

The valve assembly 28 is a "push-fit" assembly comprising components that lock into place when a male component is pushed or inserted into a female component without threaded attachment. The valve assembly 28 includes a substantially L-shaped hollow outlet 90 with a rearwardly extending receiving tube 90T for sealably connecting with a push-fit tube 88T of a manifold 88, as shown in FIG. 2, 3, or 31, or sealably connecting with a pipe 35, as shown in FIGS. 48, 49, and 50.

Figure 16A:
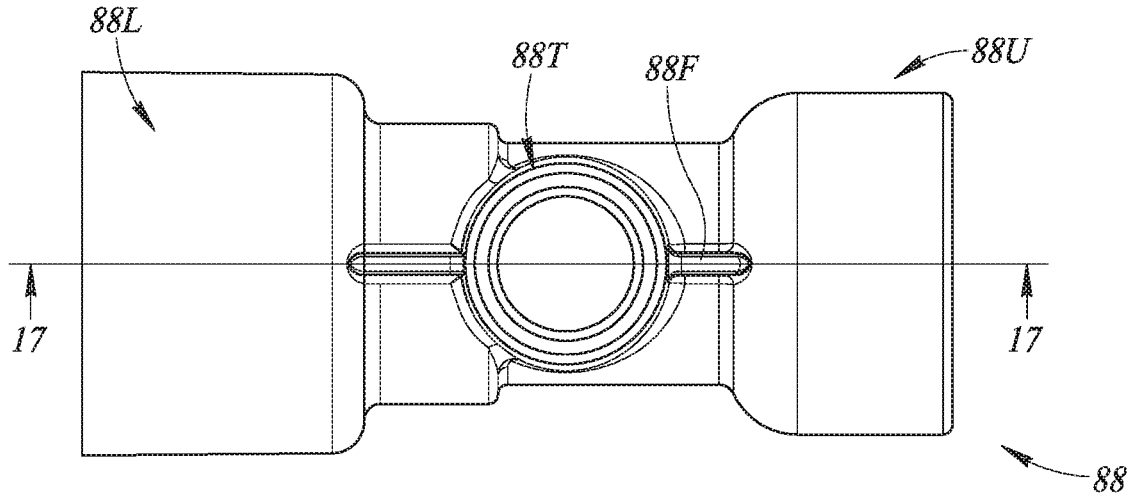
FIG. 16A illustrates a front view of a first manifold body of a valve assembly.
Figure 16B:
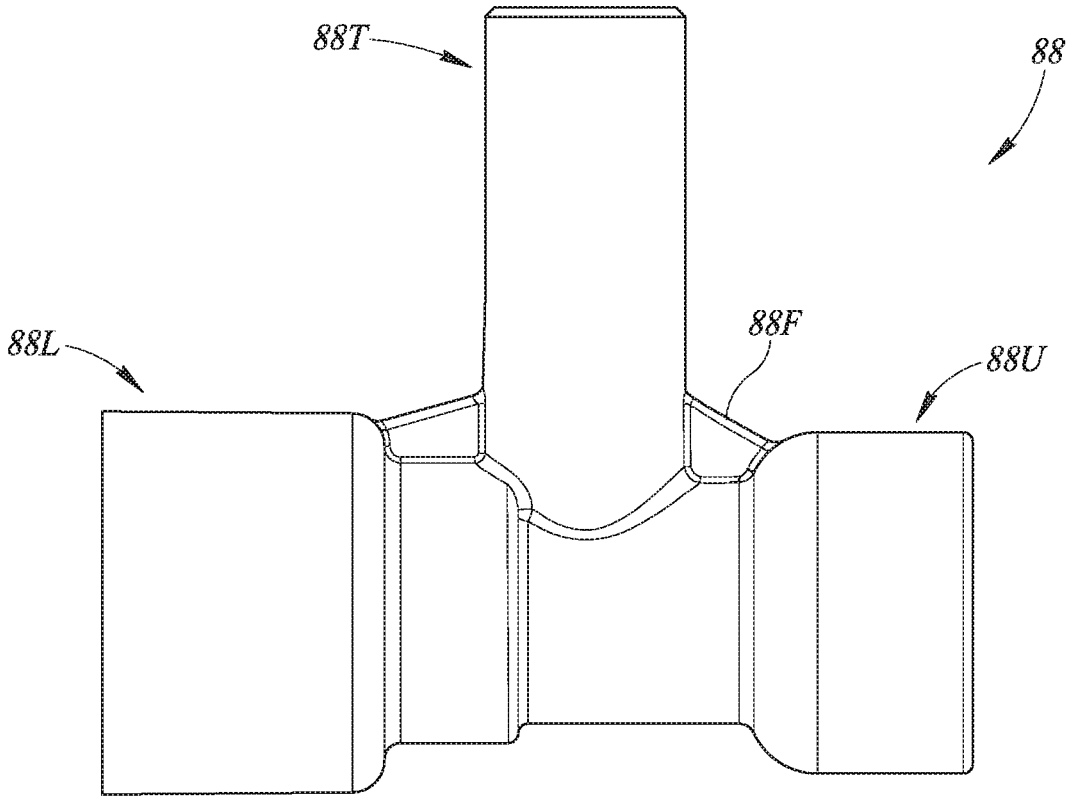
FIG. 16B illustrates a left side view of the first manifold body of FIG. 16A.
Figure 17:
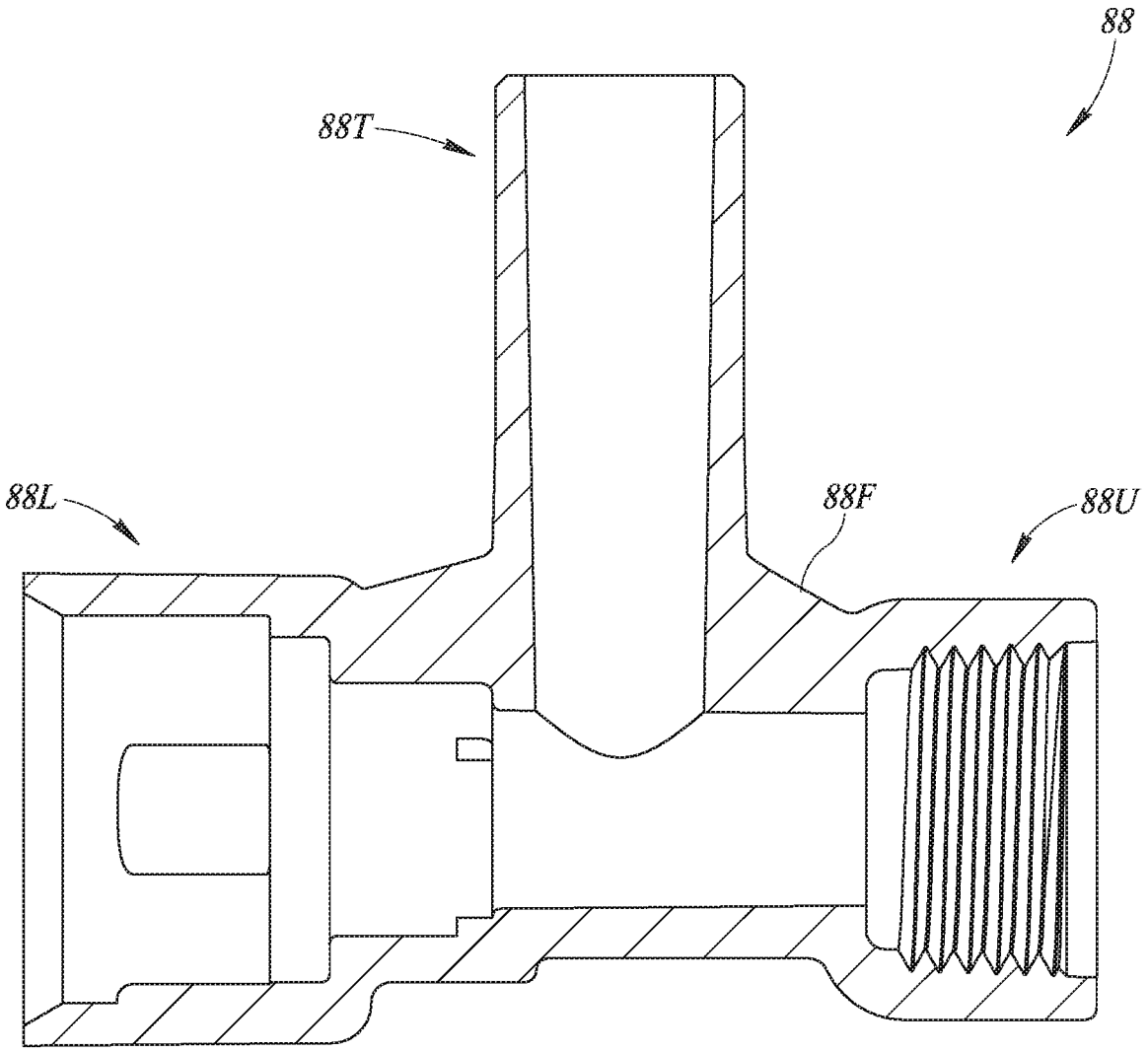
FIG. 17 illustrates a cross-sectional view of the first manifold body of FIG. 16A substantially along line 2-2.

The manifold 88 may be a component of the valve assembly 28 comprising a substantially T-shaped or L-shaped hollow body having a lower connecting portion 88L, as shown in FIGS. 16A, 16B, 17. The manifold 88 and/or outlet 90 may be push-fit components that are monolithically formed by an injection molding process using a polymer material, such as chlorinated polyvinyl chloride (CPVC) or PVC. An upper end of the manifold 88 may include an upper connecting portion 88U for threadably attaching a water arrestor assembly, as described below. The tube 88T extends outwardly from a side of the manifold 88 providing a push-fit connection point for attaching the outlet 90. The single-piece injection-molded manifold 88 eliminates joints or seams that may leak or fail in other devices, and provides a monolithic attachment point for connecting different outlets in a push-fit manner.

Figure 18:
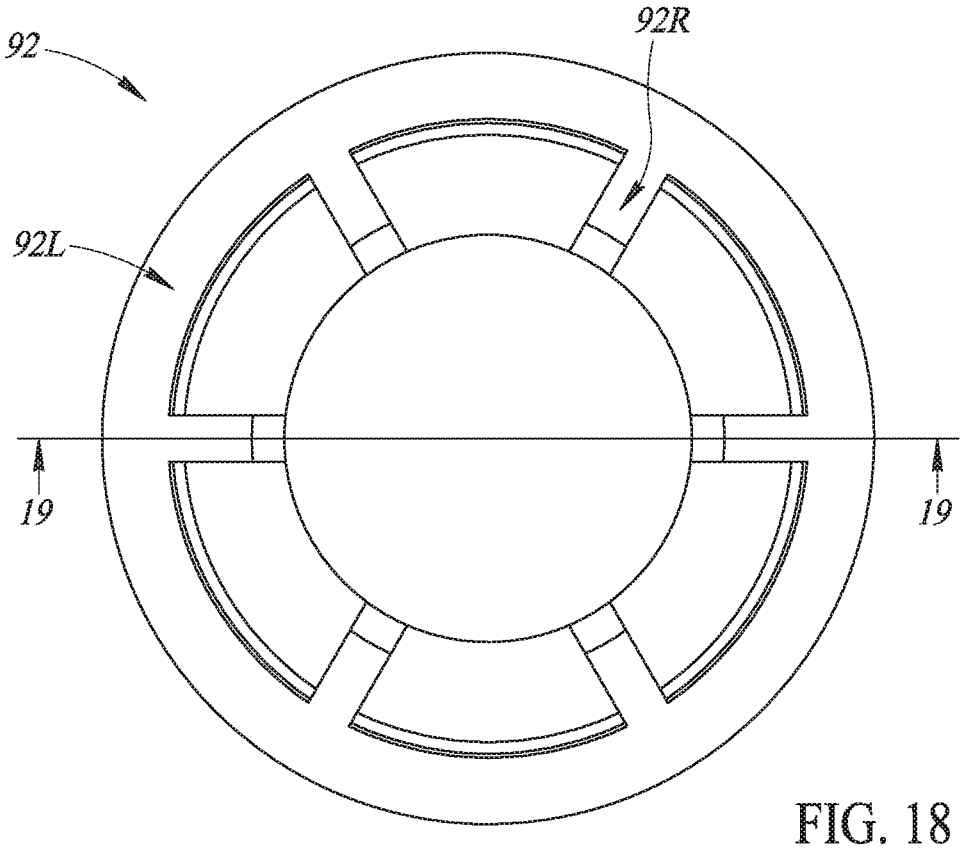
FIG. 18 illustrates a bottom view of a manifold spacer.
Figure 19:
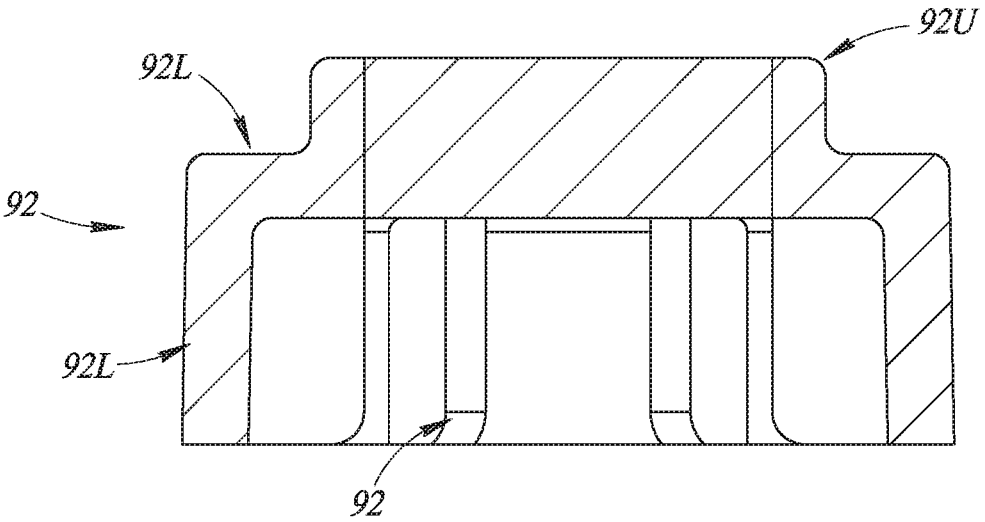
FIG. 19 illustrates a cross-sectional view of the manifold spacer of FIG. 18 substantially along line 3-3.

A manifold spacer 92 may be installed within the cavity portion 14 between the lower wall 22 and the lower connecting portion 88L to space them apart at an appropriate distance according to the length of the end of the pipe 35. As shown in FIGS. 18 and 19, the manifold spacer 92 has an annular upper portion 92U having an outer circumference sized to snuggly fit into the lower end of the lower connecting portion 88L, and a cylindrical lower portion 92L having a circumference larger than the upper portion 92U and sized equal to or larger than the bottom of the lower connecting portion 88L. An upwardly facing ledge 92L of the manifold spacer 92 abuts a lower surface of the lower connecting portion 88L of the manifold 88 when the upper portion 92U is inserted therein. The cylindrical lower portion 92L has a plurality of axially offset and radially inwardly extending guide ribs or ridges 92R for guiding the end of the pipe 35 through the manifold spacer and into the manifold 88.

Figure 22:
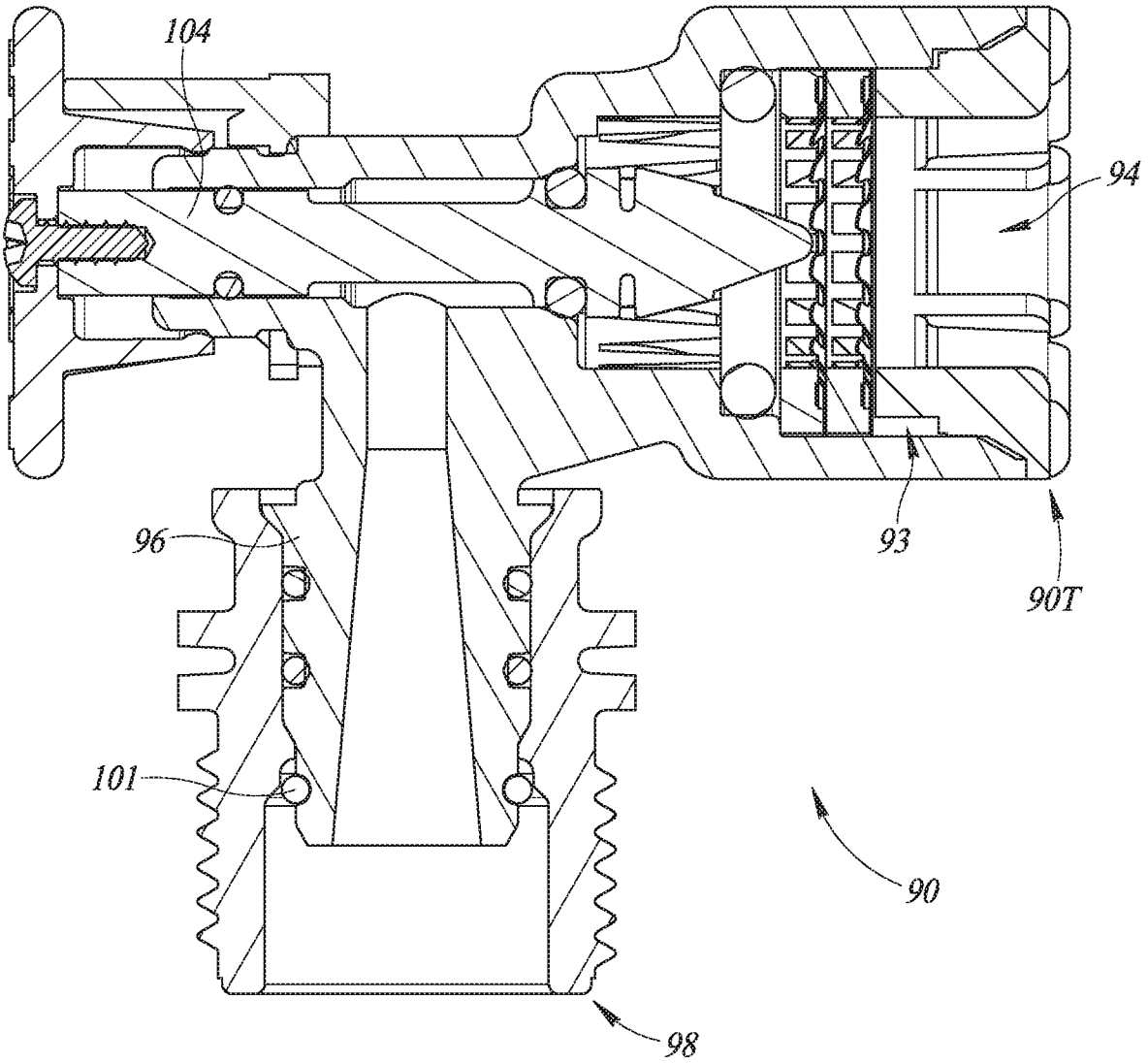
FIG. 22 illustrates a cross-sectional view of a liquid flow switch and a bushing assembly installed in the second manifold body of FIG. 20A substantially along line 4-4, and having a port interface and a C-clip attached to the second manifold body.
Figure 23:
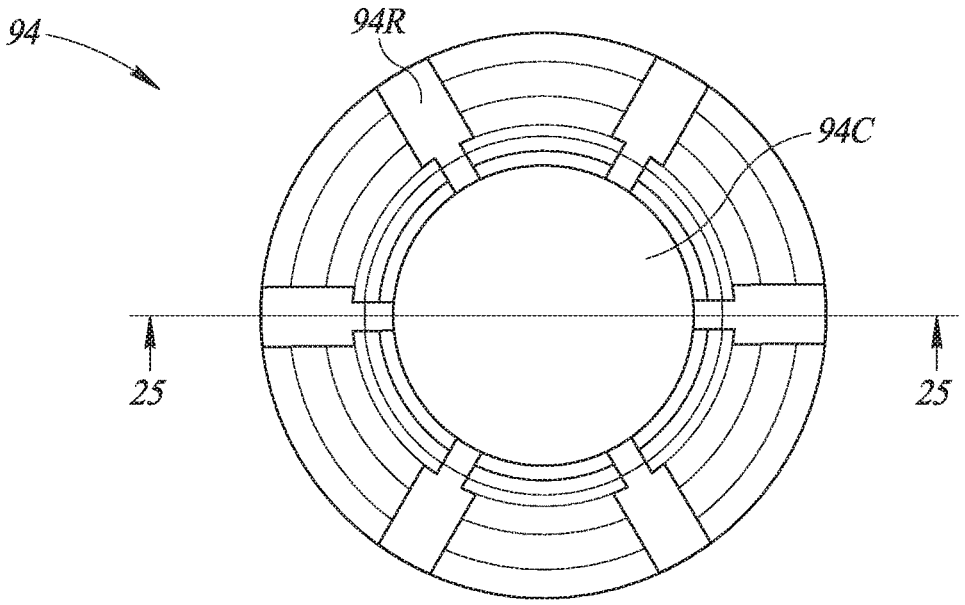
FIG. 23 illustrates a bottom plan view of an end bushing of the bushing assembly of FIG. 22.
Figure 24:
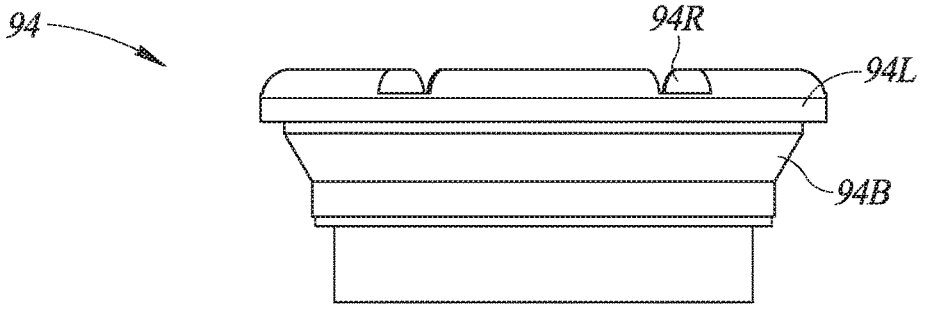
FIG. 24 illustrates a side view of the end bushing of FIG. 23.
Figure 25:
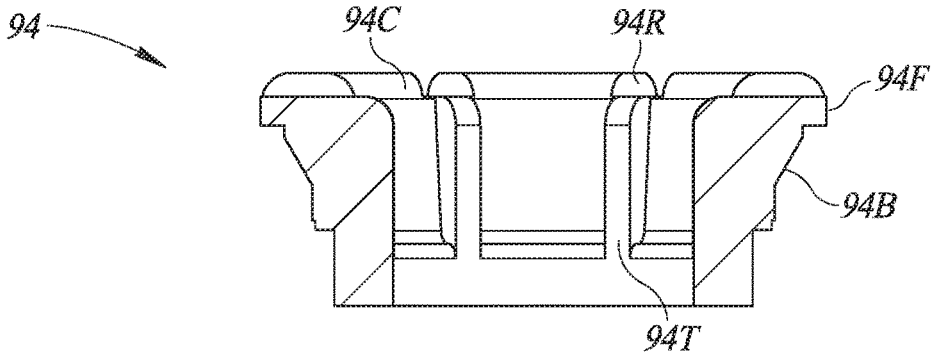
FIG. 25 illustrates a cross-sectional view of the end bushing of FIG. 23 along the line 5-5.

A length of the tube 88T of the manifold 88 may be inserted into a cavity 90A of the receiving tube 90T of the outlet 90 to connect the manifold 88 and the outlet 90. A bushing assembly 93 may be nested or installed at least partially within the cavity 90A of the receiving tube 90T to facilitate water-tight fluid communication between the manifold 88 and the outlet 90, as shown in FIG. 22. The bushing assembly 93 allows for a push-fit assembly of the outlet 90 (or other similar outlet) to the manifold 88 (or the pipe 35). The bushing assembly 93 may include one or more O-rings, one or more gripper rings, and an end bushing 94. The end bushing 94 has a body portion 94B sized and shaped to fit against inner surfaces within the cavity 90A, an inner cavity extending axially through the end bushing 94, and a rear flange portion 90F that abuts a rearward surface of the receiving tube 90T, as shown in FIGS. 23, 24 and 25. The flange portion 94F may include a plurality of recesses 94R axially offset and radially positioned along a rearward surface of the flange portion 90F. One or more of the recesses 94F may engage with a thin fin portion 88F projecting forwardly from and extending vertically along a forward surface of the manifold 88 (see FIGS. 16B and 17) to allow secure rotational movement between the manifold 88 and the outlet 90 without failure of the fluid-tight seal therebetween. The end bushing 94 may further include a plurality of axially offset ridges or ribs 94T projecting radially inward in the inner cavity 94C to guide the tube 88T within the cavity 90A.

Figure 20A:
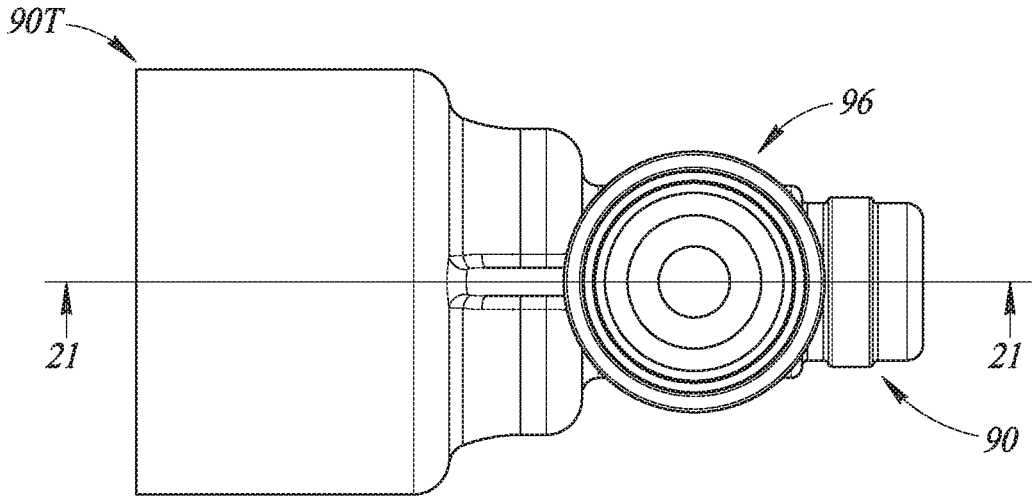
FIG. 20A illustrates a front view of a second manifold body of the valve assembly.
Figure 20B:
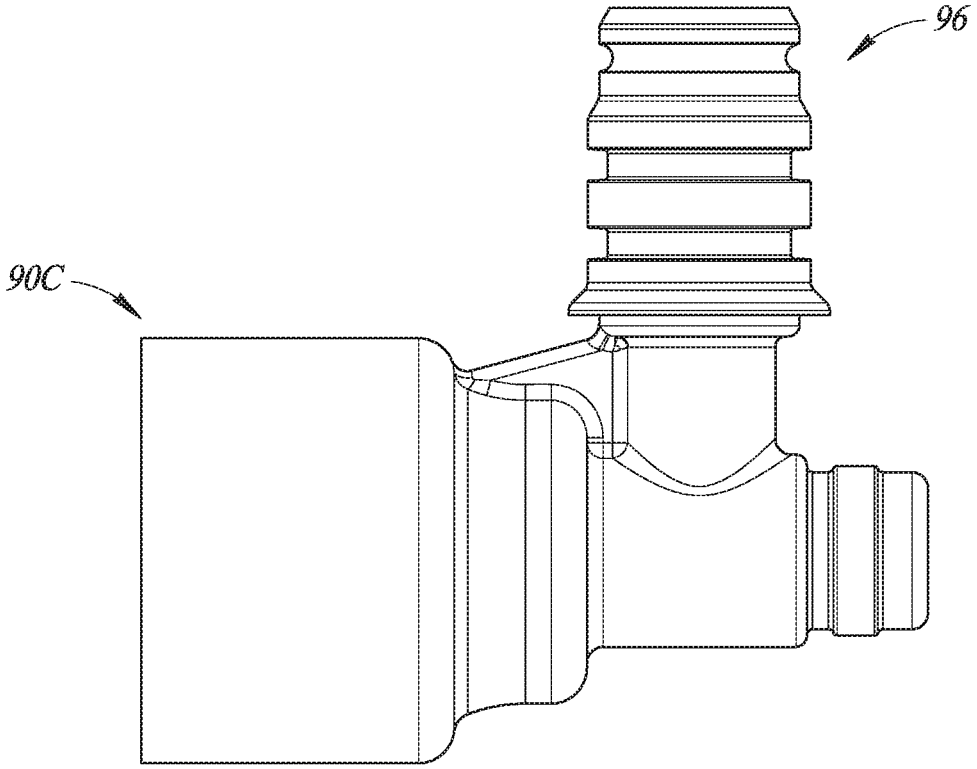
FIG. 20B illustrates a left side view of the second manifold body of FIG. 20A.
Figure 21:
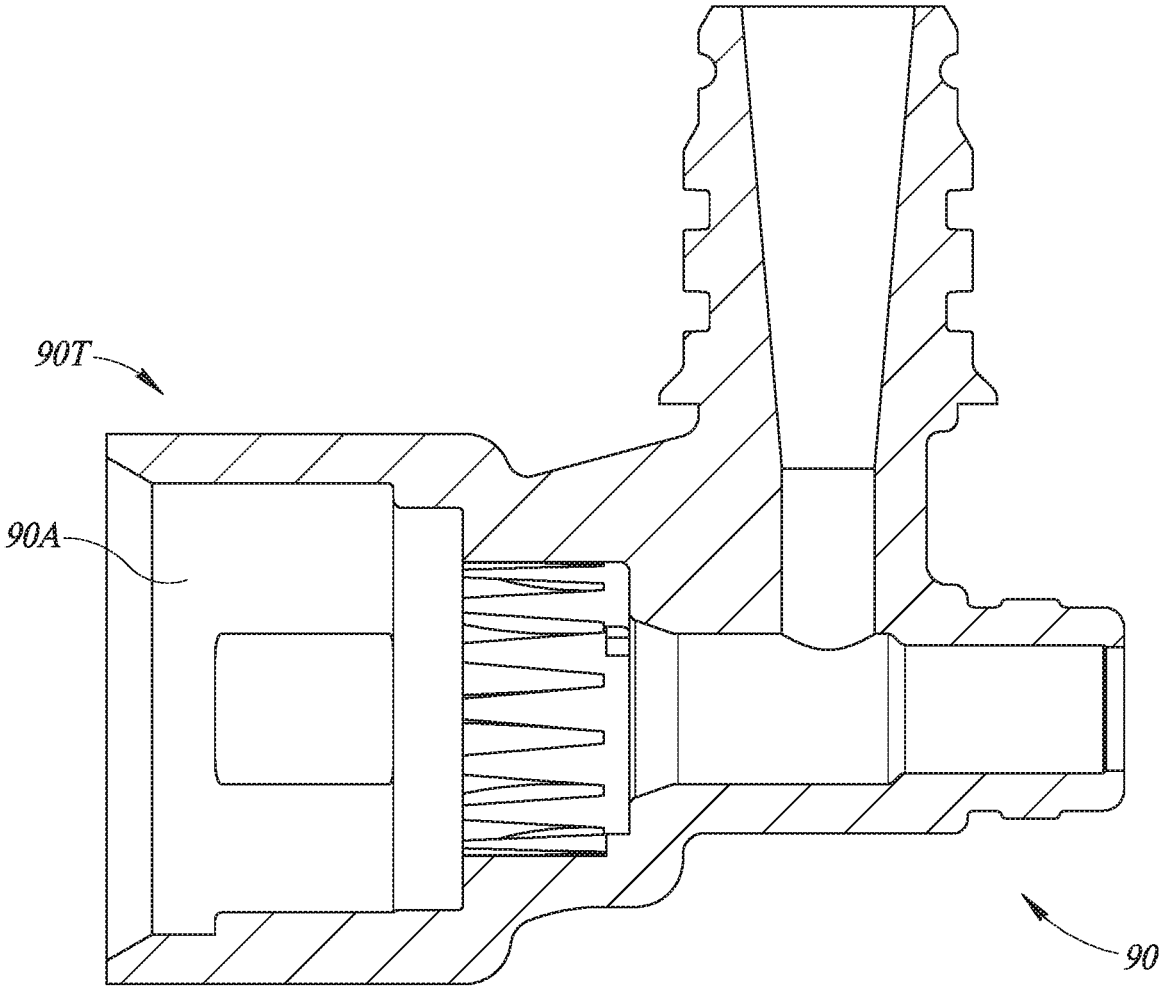
FIG. 21 illustrates a cross-sectional view of the second manifold body of FIG. 20A substantially along line 4-4.
Figure 26:
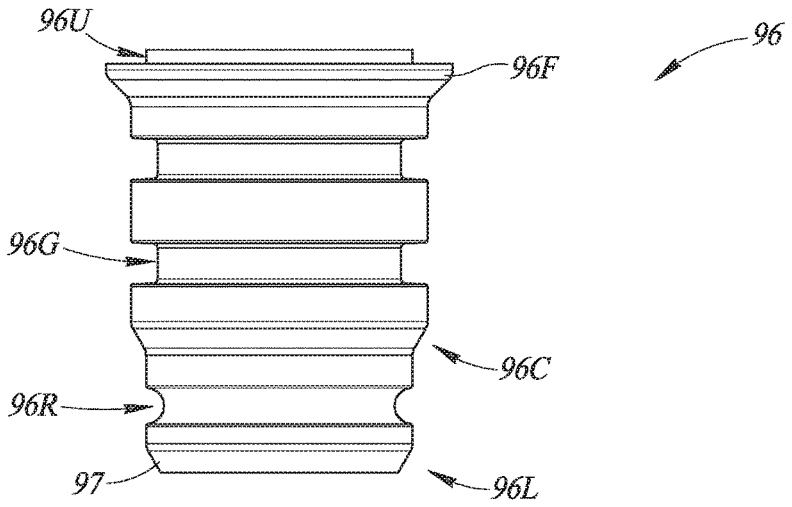
FIG. 26 illustrates a side view of a port of the second manifold body of FIG. 20A.

The outlet 90 has an elongated downwardly extending port 96 extending downwardly from the receiving tube 90T, as shown in FIGS. 20A, 20B, and 21, for sealably connecting and supplying water to a hose of an appliance. The port 96 has a substantially cylindrical shape extending in an axial direction, and an inner conduit portion in fluid communication with the receiving tube 90T and terminating at the lower end, as shown in FIG. 26. An upper portion 96U of the port 96 may have a flared portion 96F flaring outward circumferentially and upwardly. An exterior surface of the cylindrical shape of the port 96 may have one or more circumferentially extending grooves 96G positioned axially along the length of the port 96 for receiving and retaining one or more O-rings. The grooves 96G may have a square cross-sectional shape for securely retaining the O-ring. A lower end portion 96L of the port 96 may include a tapered portion 97 narrowing or tapering inwardly toward the lower end of the port 96. A lower groove or annular recess 96R having a rounded concave cross-sectional shape is provided axially below the grooves 96G for receiving a C-shaped ring described below. The port 96 includes a center portion 96C between the grooves 96G and the recess 96R, which narrows or tapers downwardly toward the lower end portion 96L. In other embodiments, the exterior surface of the port 96 may include a threaded portion to facilitate direct connection of the hose of the appliance to the valve assembly 28.

Figure 27:
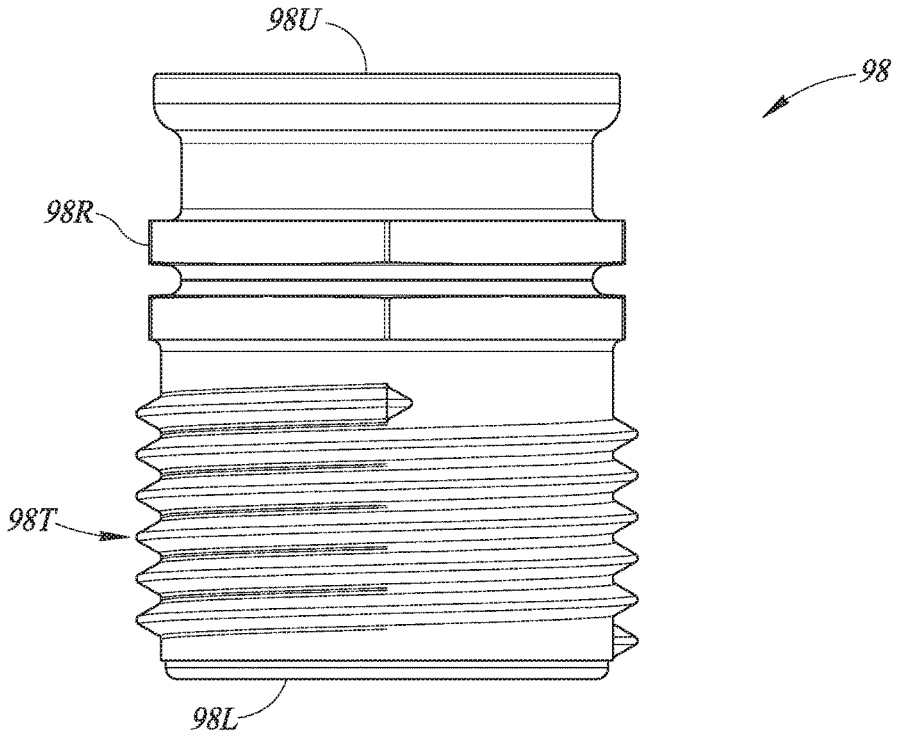
FIG. 27 illustrates a side view of the port interface of FIG. 22.
Figure 28:
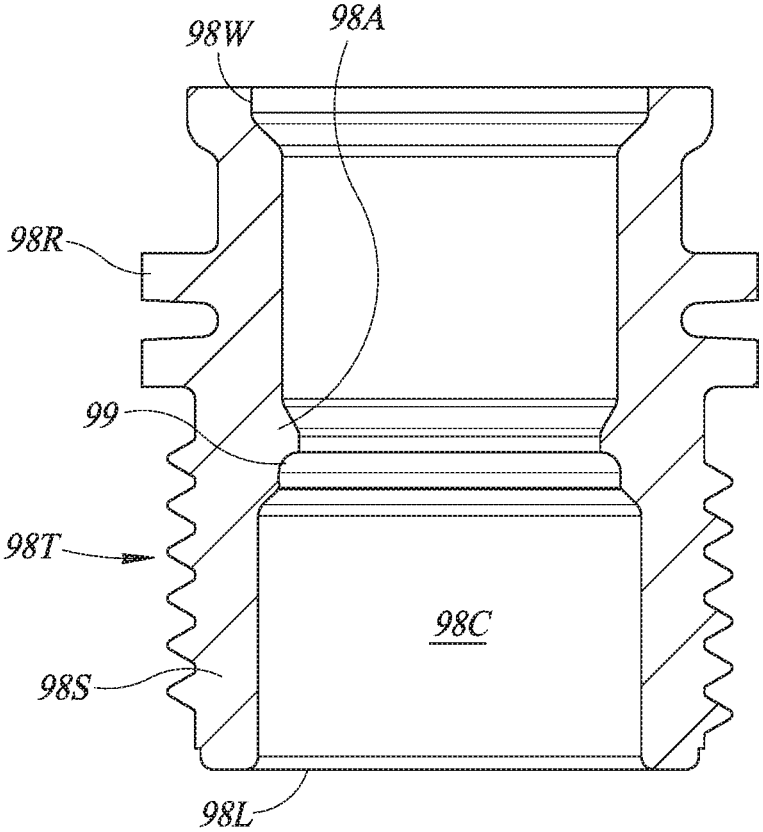
FIG. 28 illustrates a cross-sectional view of the port interface of FIG. 27.
Figure 29:
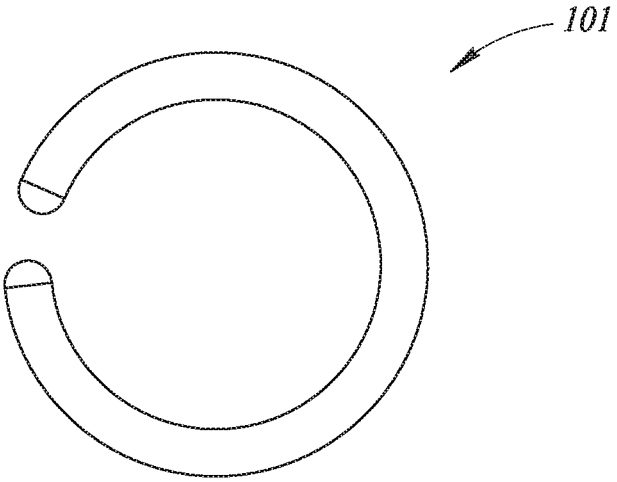
FIG. 29 illustrates a plan view of the C-clip of FIG. 22.

In one aspect, a port interface 98 may be provided for attaching to the hose of an appliance to the port 96, as shown in FIGS. 22 and 27. The port interface 98 may be positioned over the port 96 and attached thereto, allowing for attachment of the hose of the appliance to the valve assembly 28. The port interface 98 has an inner conduit 98C defined by downwardly extending sidewalls 98S extending axially therethrough from an upper end 98U to a lower end 98L of the port interface, a threaded attachment portion 98T for threadably attaching to the hose, and one or more rings 98R projecting circumferentially from an exterior surface of the sidewalls 98S at an axial position above the threaded portion 98T. The inner conduit 98C has a section with an inner contour sized and shaped to snuggly engage with the exterior surface shape of the port 96. Specifically, the inner conduit 98C includes an inwardly projecting annular portion 98A projecting radially inwardly from the inner surfaces of the sidewall 98S. The annular portion 98A may have an angled or tapered upwardly facing surface configured to engage with a downwardly facing surface of the tapered portion 97 of the port 96 when inserted into the inner conduit 98C. The bottom side of the annular portion 98A may have a curved or flat shaped lower portion 99 for retaining a retaining ring, as described below. A resiliently compressible C-shaped clip or retaining ring 101 (see FIG. 29) may be installed in the recess 96R to supportably attach the port interface 98 the port 96, as shown in FIG. 22. Different port interfaces 98 having different outer sidewall diameters may be provided to allow for hoses of different sizes to the valve assembly 28. Moreover, the port interface 98 helps to prevent over-torqueing and/or cracking of the outlet 90 of the valve assembly 28.

To attach the port 96 to the port interface 98, the lower end of the port 96 is first inserted into the upper end of the inner conduit 98C of the port interface. The port interface 98 is moved axially upward over the exterior surface of the sidewalls 98S of the port 96 until the annular portion 98A of the port interface 98 is positioned snuggly against a downwardly facing surface of the center portion 96C. O-rings positioned in the grooves 96G axially above center portion 96C may compress against the inner surface of the sidewalls 98S to seal the inner conduit 98C against the outer diameter of the port 96 in a fluid-tight manner. The flared portion 96F of the port fits snuggly against an outwardly opening portion 98W at an upper end 98U, thereby preventing further downward movement of the port 96 within the port interface 98. The c-shaped ring 101 may then be inserted upwardly into the inner conduit 98C of the port interface 98 and installed within the recess 96R. The c-shaped retaining ring 101 installed within the recess 96R abuts the lower portion 99 of the annular portion 98A, preventing separation of the port interface 98 from the port 96. After the port interface 98 is attached to the port 96 in the manner described above, water supplied from a water source attached to the pipe 35 may flow through the valve assembly 28, out of the lower end of the port 96, and through a hose attached to the lower end 98L of the port interface 98.

The valve assembly 28 may include other features, such as an arrestor assembly 102 at the upper connecting portion 88U of the manifold 88, and a push-pull liquid flow valve stem 104 at a front of the outlet 90. The flow valve stem 104 may be user-actuated to a first position (e.g., rearward "on" position) that allows fluid flow through the second manifold body 88, and a second position blocking fluid flow through the second manifold body 88 (e.g., forward "off" position). The arrestor assembly 102 is a dampening mechanism that absorbs kinetic energy of fluid flowing into the valve assembly 28 when the flow valve stem 104 is transitioned from the first position to the second position. Specifically, when the flow valve stem 104 is transitioned from the first position to the second position, a sudden pressure change of fluid flowing through the valve assembly may cause vibration in the valve assembly 28 or the pipes in the wall leading to the valve assembly due to overshoot in the system (i.e., "water hammer"). The arrestor assembly 102 has a sliding piston mechanism for absorbing the kinetic energy of the fluid during the transition between positions, thereby reducing or preventing vibration in the system. A cylindrical arrestor lower portion 102L of the arrestor assembly 102 threadably engages with the upper connecting portion 88U to allow fluid communication between the piston of the arrestor assembly 102 and the tube 88T of the manifold 88.

Figure 4:
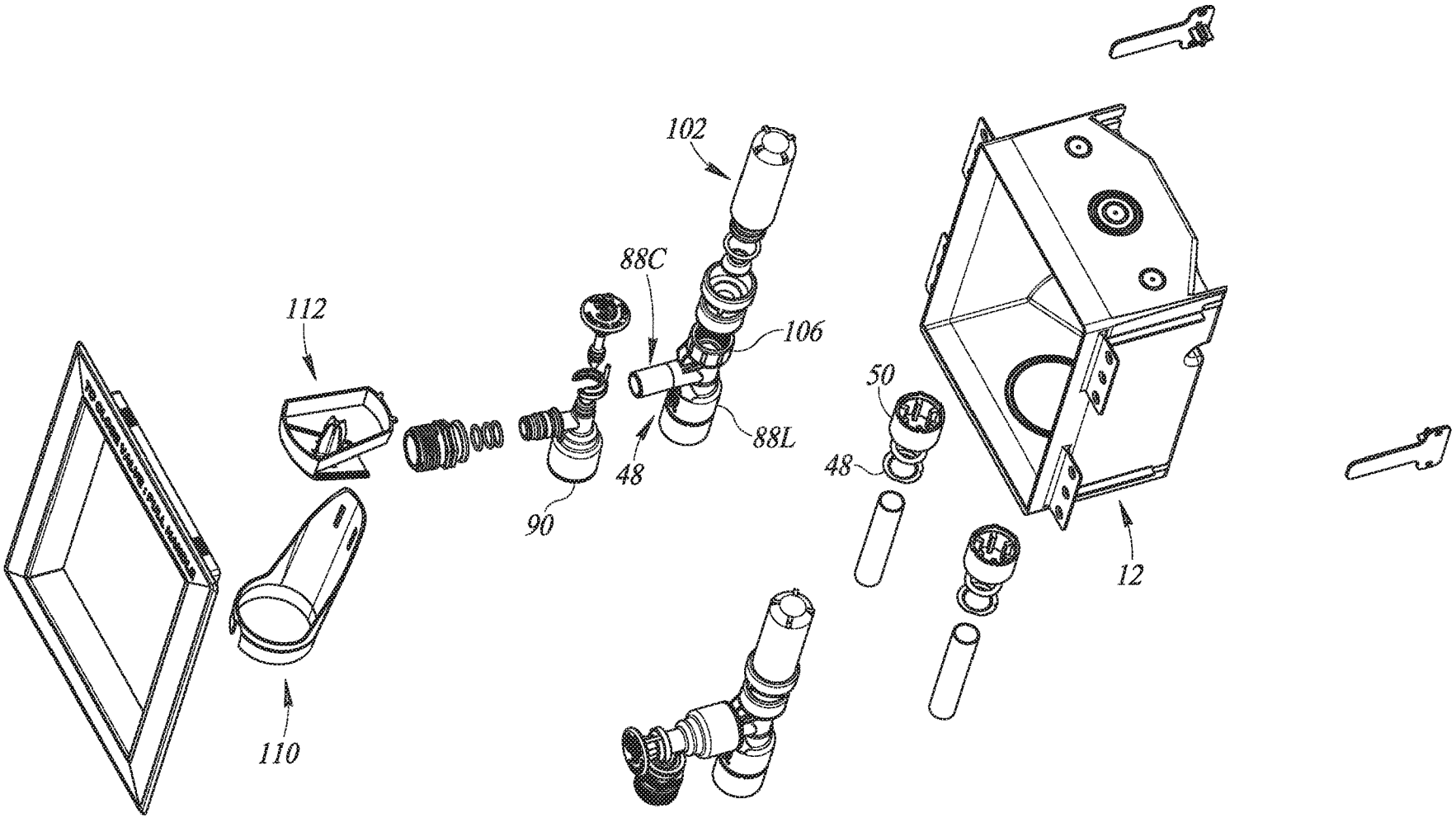
FIG. 4 illustrates a third exploded view of the utility box of FIG. 1.
Figure 30A:
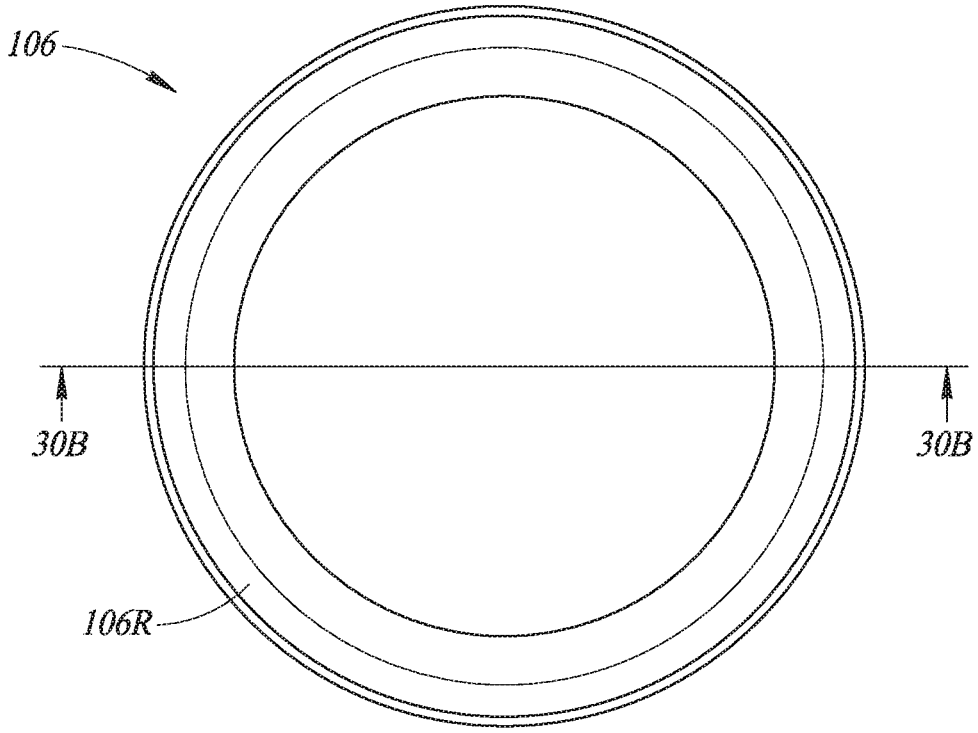
FIG. 30A illustrates a top plan view of a manifold support ferrule.
Figure 30B:
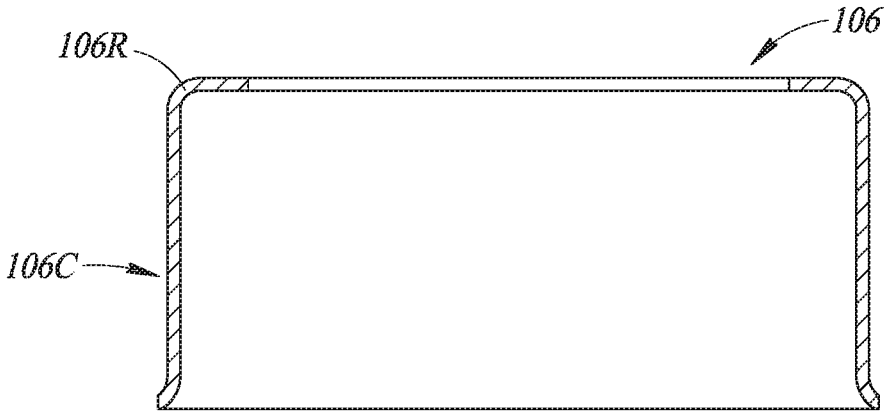
FIG. 30B illustrates a cross-sectional view of the manifold support ferrule of FIG. 30B along the line 6-6.

According to one aspect, the valve assembly 28 may further include a metallic manifold support ferrule 106 configured to fit over an outer cylindrical portion of the upper connecting portion 88U of the manifold 88 to reduce hoop stresses on the manifold 88 and prevent over-torqueing of the arrestor lower portion 102L against the manifold 88, as shown in FIGS. 2, 3, and 4. The support ferrule 106 includes a cylindrical portion 106C extending in an axial direction, and an upper annular portion 106R extending radially inward from an upper end of the cylindrical portion 106C, as shown in FIGS. 30A and 30B. The cylindrical portion 106C has an outer cylindrical portion 106C with an inner diameter slightly larger (~1.10") than an outer diameter of the upper connecting portion 88U (~1.06"). The plastic or polymer material (e.g., PVC) of the manifold 88 may experience significant hoop or cylinder stresses induced by fluctuations of water pressure flowing therethrough to and from the arrestor assembly 102, which may cause the manifold 88 to crack and/or fail over time. The metallic material (e.g., aluminum, copper, steel) of the support ferrule 106 has significantly higher tensile strength than the plastic or polymer material of the manifold 88. The cylindrical portion 106C absorbs at least some of the hoop or cylindrical stresses induced on the manifold 88 by pressure differentials of water flowing therethrough, thereby reducing cracks and/or failures in the manifold 88 and improving its longevity.

When the support ferrule 106 is assembled with the manifold 88, the cylindrical portion 106C of the support ferrule 106 is positioned over the cylindrical outer body of the upper connecting portion 88U and the annular portion 106R is positioned against the upper surface of the manifold 88. The lower portion 102L of the arrestor assembly 102 may then be inserted through the annular portion 106R and threadably engaged with the upper connecting portion 88U of the manifold 88. The annular portion 106R has an inner diameter approximately equal to or slightly larger than the diameter of an uppermost opening of the inner tube 88T at the upper connecting portion 88U. The arrestor assembly 102 may abut an upper surface of the annular portion 106R when the lower portion 102L is threadably engaged with the upper connecting portion 88U of the manifold 88. In some embodiments, an O-ring may be positioned between and abutting the upper surface of the annular portion 106R and the arrestor assembly 102 to help create a fluid-tight seal for fluid communication between the manifold 88 and the arrestor assembly 102.

Figure 32:
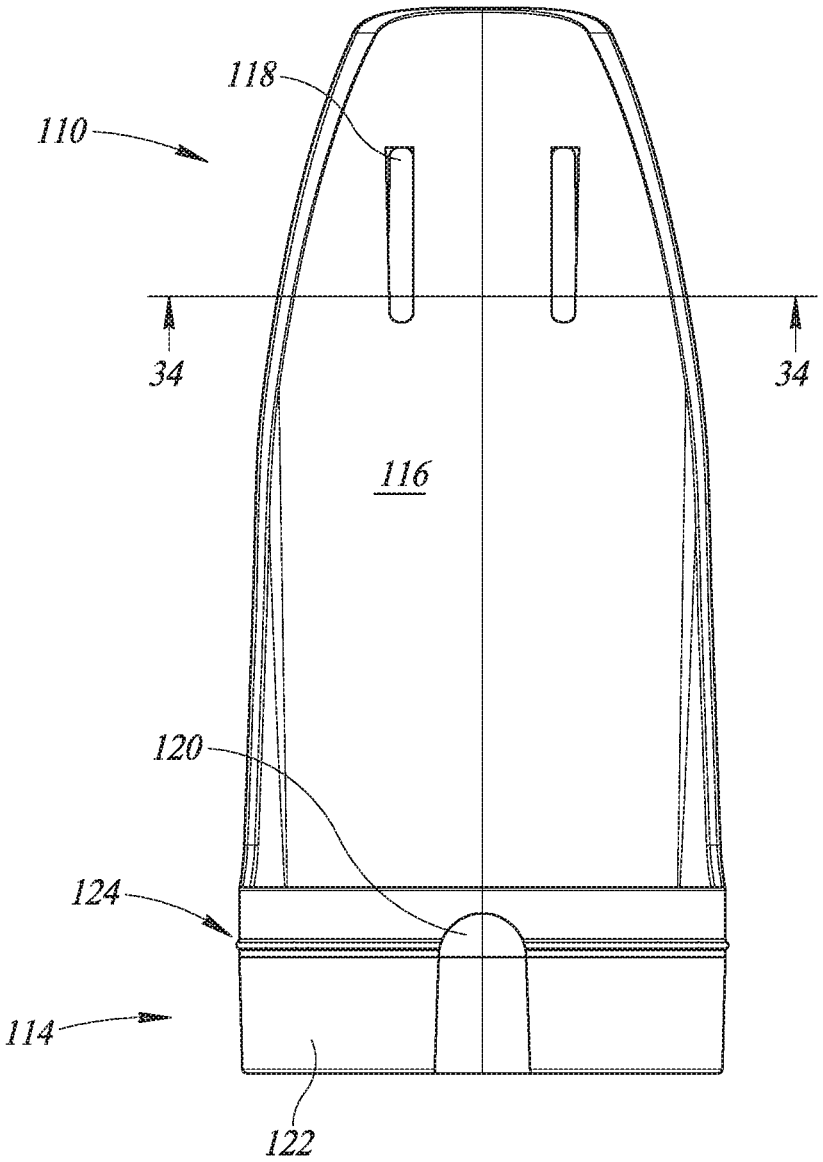
FIG. 32 illustrates a front view of a drain base of the drain assembly of FIG. 31.
Figure 33:
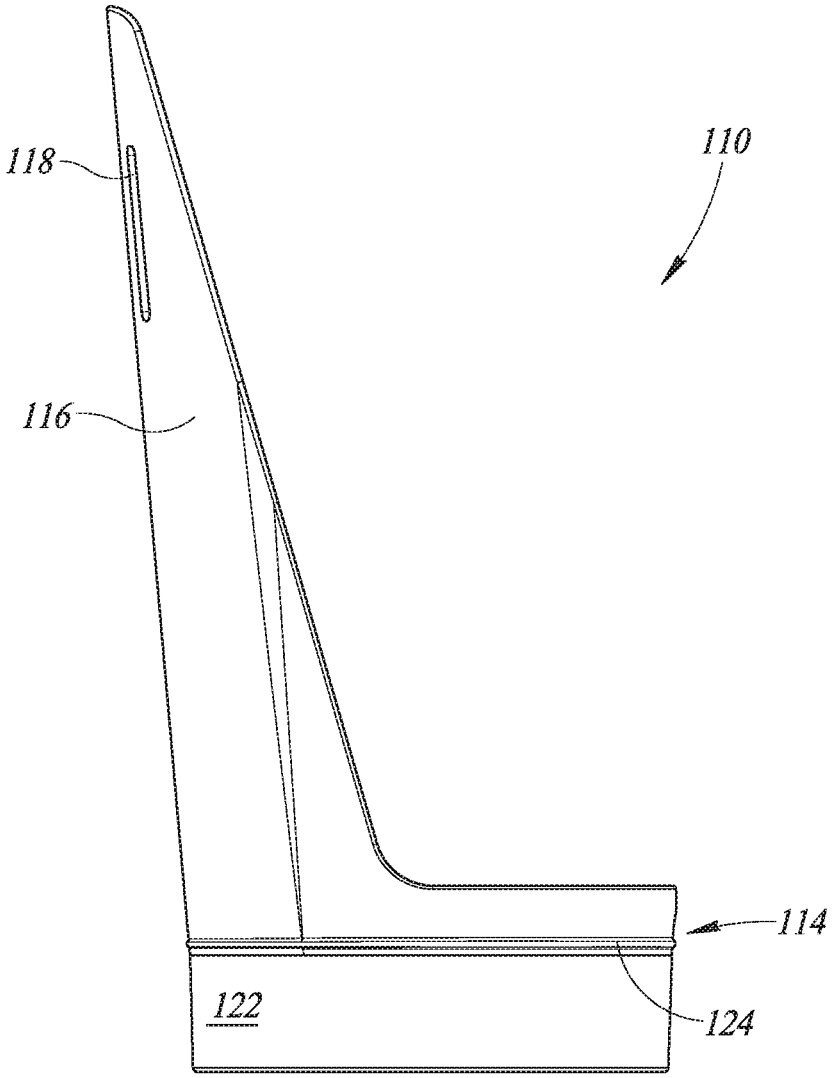
FIG. 33 illustrates a right side view of the drain base.
Figure 34:
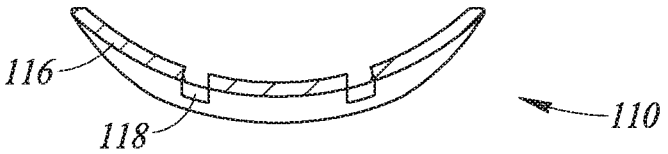
FIG. 34 illustrates a cross-sectional view of the drain base of FIG. 32 substantially along line 7-7.

Fixtures other than the valve assembly 28 may be installed in the utility box 10. In one embodiment, a drain assembly 108 is provided that may be installed in the utility box 10, as shown in FIG. 31. The drain assembly 108 includes a drain base 110 that may be installed in the second lower receptacle 52 of the box main housing 12 and a retaining member 112 for retaining a hose and/or funneling liquid into the drain base 110. The drain base 110 includes a hollow cylindrical base portion 114 defining a drain channel, a curved rear wall portion 116 extending upwardly from the base portion 114, and a pair of laterally offset attachment apertures 118 for removably attaching the retaining member 112 to the drain base 110, as shown in FIGS. 32, 33, and 34. A drain tube or hose, such as a condensation hose from an air conditioning unit, may be inserted through the first upper receptacle 68 or the second upper receptacle 74 and into the cavity portion 14, where the drain tube may be attached to the retaining member 112 or inserted into the drain base 110. Additionally, a drain tube from an appliance, such as a dishwasher or washing machine, may be inserted through the opening 18 of the box main housing 12 and into the drain base 110.

The cylindrical base portion 114 is sized and shaped for insertion into the first knockout portion 58 of the second lower receptacle 52 after the second knockout portion 60 is removed, as described above. Specifically, a recess 120 extends upwardly from a bottom of the base portion 114 along a front side and a rear side thereof. The front and rear recesses 120 create laterally offset curved sidewalls 122 that may flex laterally or radially inward when the cylindrical base portion 114 is inserted into the second lower receptacle 52 to frictionally retain the drain base 110 therein. The cylindrical base portion 114 may have a tapered shape tapering radially inward from an upper end to a lower end thereof. The cylindrical base portion 114 has a diameter sufficient to allow for insertion of one or more drain tubes. A rim portion 124 may protrude radially outward from the outer circumference of the cylindrical base portion 114 and have an outer dimension or radius larger than the inner diameter of the first knockout portion 58. The rim portion 124 may abut with an upper surface of the lower wall 22 when the cylindrical base portion 114 is inserted into the second lower receptacle 52, preventing further insertion of the drain base 110 therein. One or more hoses or tubes may be inserted into the cylindrical base portion 114 for draining fluid into a pipe attached to a lower side of the second lower receptacle 52.

Figure 35:
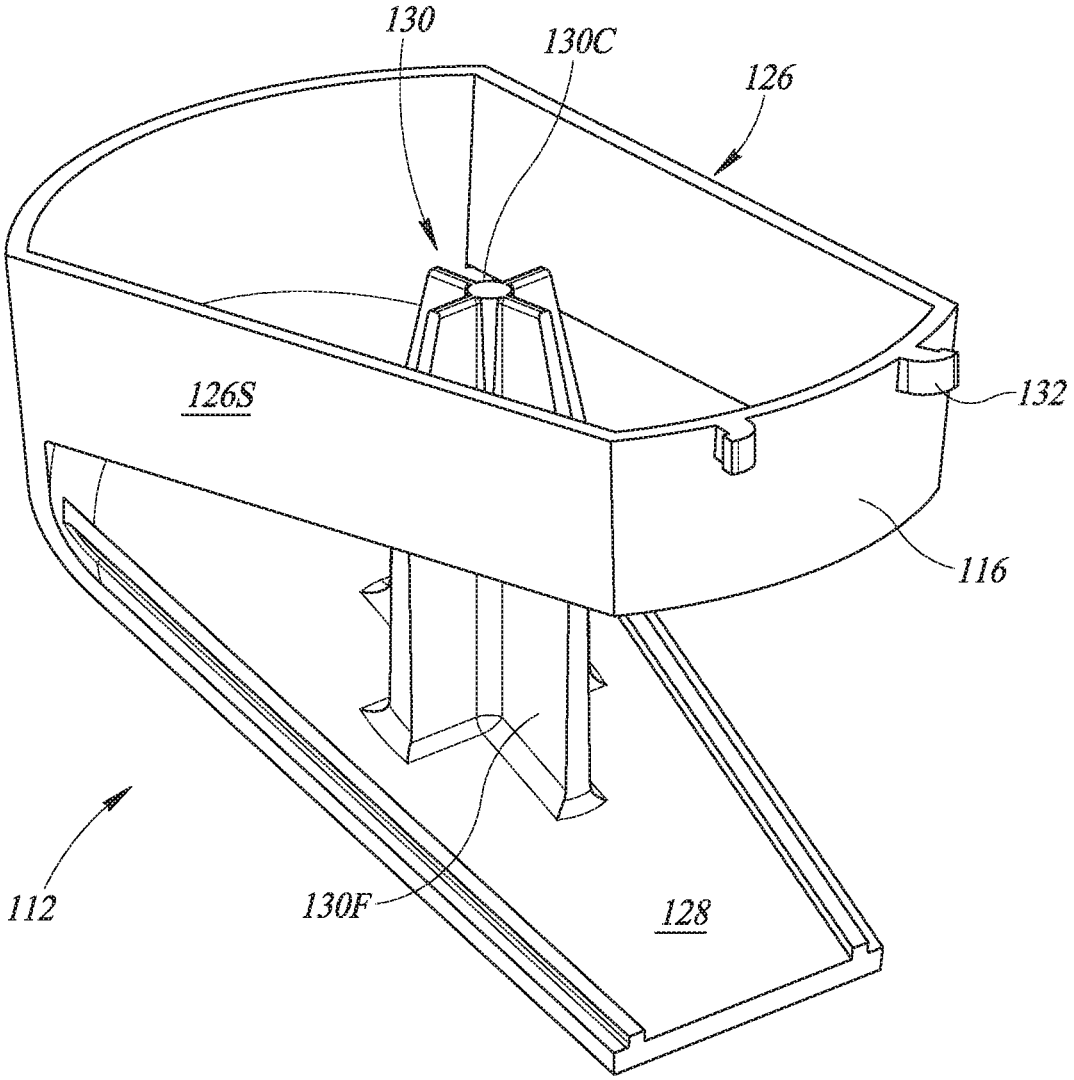
FIG. 35 illustrates a top perspective view of a retaining member of the drain assembly of FIG. 31.

Referring to FIG. 35, the retaining member 112 is configured to retain a hose or tube thereto and drain fluids downwardly into the drain base 110 to which the retaining member is attached. The retaining member 112 includes a bracket portion 126 having bracket sidewalls 126S extending forwardly from a bracket rear wall 126R, a drain conduit 128 having a major surface extending downwardly at an angle from the bracket portion 126, and a hose retention post 130 projecting upwardly from the drain conduit 128 for retaining a drain hose or tube to the retaining member 112. A pair of laterally offset attachment members 132 each project from a rearward facing side of the bracket rear wall 126R. The attachment members 132 may be inserted into corresponding ones of the attachment apertures 118 to removably attach the retaining member 112 to the rear wall portion 116 of the drain base 110. The vertical position of the retention post 130 may be adjusted by moving the retaining member vertically along the rear wall portion 116 according to the length of the hose or tube extending downwardly into the cavity portion 14 from the upper wall 24 of the box main housing 12. Specifically, the attachment apertures 118 may have an elongated shape extending downwardly along the rear wall portion 116 of the drain base 110. The position of the attachment members 132 within the elongated attachment apertures 118 may be adjusted to select the vertical position of the retaining member 112 along the rear wall portion 116 and thereby select the vertical position of the retention post 130. The attachment members 132 may each have a curved shape curving laterally outward toward left and right lateral sides of the retaining member 112. The outwardly curved attachment members 132 press against the lateral outward sides of the attachment apertures 118 when the attachment members 132 are inserted therein to frictionally retain the vertical position of the retaining member 112 within the rear wall portion 116.

The end of a drain hose or tube may be positioned around and snuggly fitted over the retention post 130 to attach the drain tube to the retaining member 112. After the drain tube is attached to the retaining member 112 of the drain assembly 108, liquid draining from the drain hose flows rearward along and drips from the drain conduit 128 onto the rear wall portion 116 and/or into the base portion 114 to drain from a drain pipe attached to the second lower receptacle 52. The retention post 130 has a conical or tapered shape tapering inwardly and upwardly from the drain conduit 128 to allow for snug attachment of drain hoses having different inner diameters. The retention post 130 comprises a plurality of fin members 130F (e.g., four) extending radially outward from a central portion 130C of the retention post 130, which allows liquid to flow freely from the attached drain hose onto the drain conduit 128. The bracket sidewalls 126S may extend downwardly along laterally sides of the drain conduit 128 to help guide liquid flow onto the rear wall portion 116 and/or into the base portion 114 and prevent liquid from spilling into the cavity portion 14.

The utility box 10 may include several features for securely attaching the box main housing 12 within a building wall. For example, a support receptacle 134 on a rear side of the box main housing 12 is provided for supportably attaching the box main housing 12 to a pipe or tube 136, as shown in FIGS. 8, 9, 10, 11, 36, and 37. The support receptacle 134 in the current embodiment is a rearwardly-opening channel or groove extending horizontally along the entire rear side of the box main housing 12. The cross-sectional shape of the support receptacle 134 channel or groove may include opposing parallel upper and lower receptacle walls 134U and 134L leading to a semi-circular front wall portion 134W centered about an axis 134A, as shown in FIGS. 8A and 9. The cross-sectional shape of the support receptacle 134 is sized to receive a pipe 136 having an outer diameter equal to or less than a standard diameter, such as 0.675" (⅜") or less. A protuberance 134P may protrude downwardly from the upper receptacle wall 134U and/or protrude upwardly from the lower receptacle wall 134L to help retain the pipe 136 inserted in the support receptacle 134.

Figure 36:
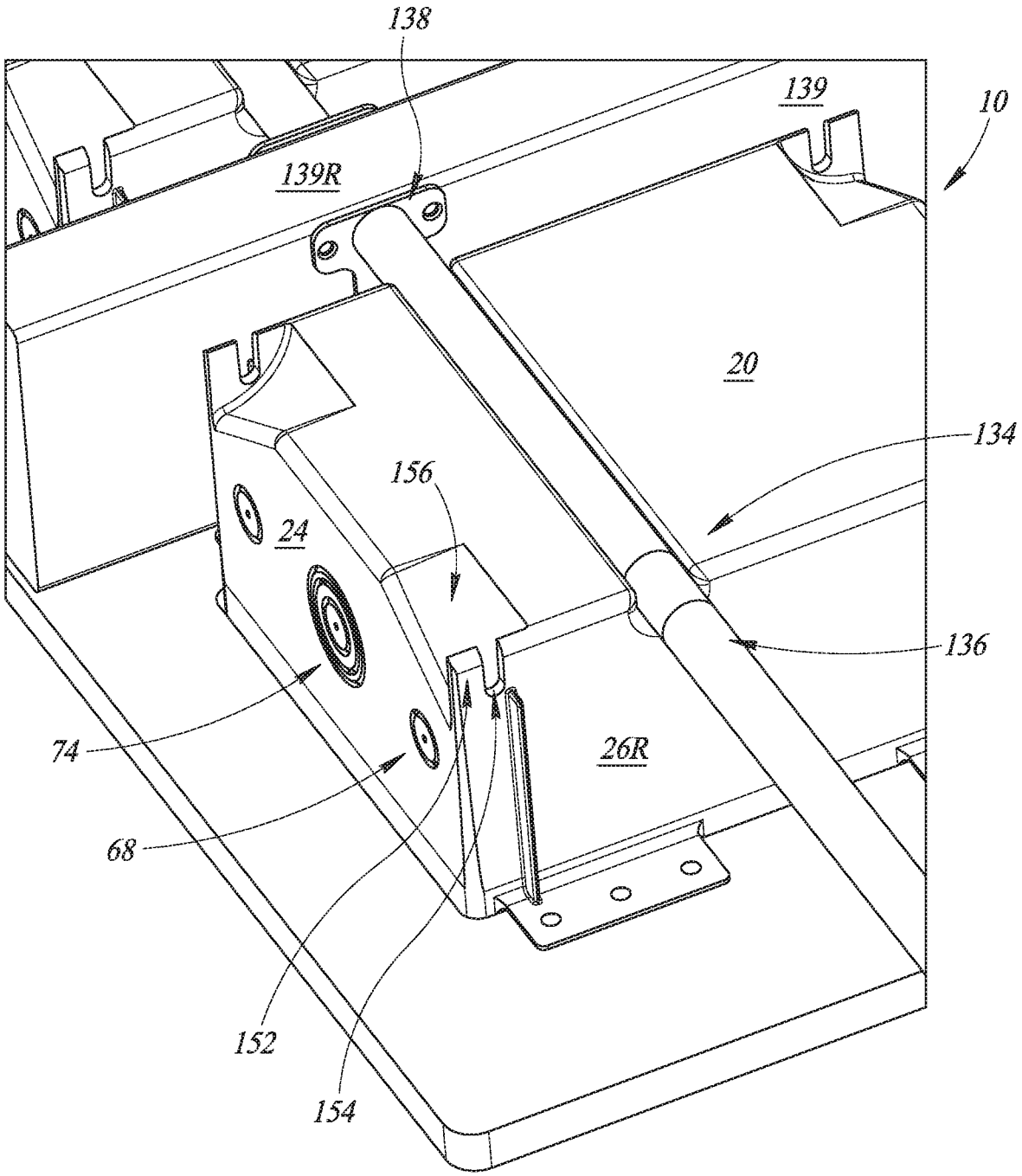
FIG. 36 illustrates a top rear perspective view of a mounting bracket and a pipe supportably attaching the utility box of FIG. 1 to wall studs and an adjacent second utility box.
Figure 37:
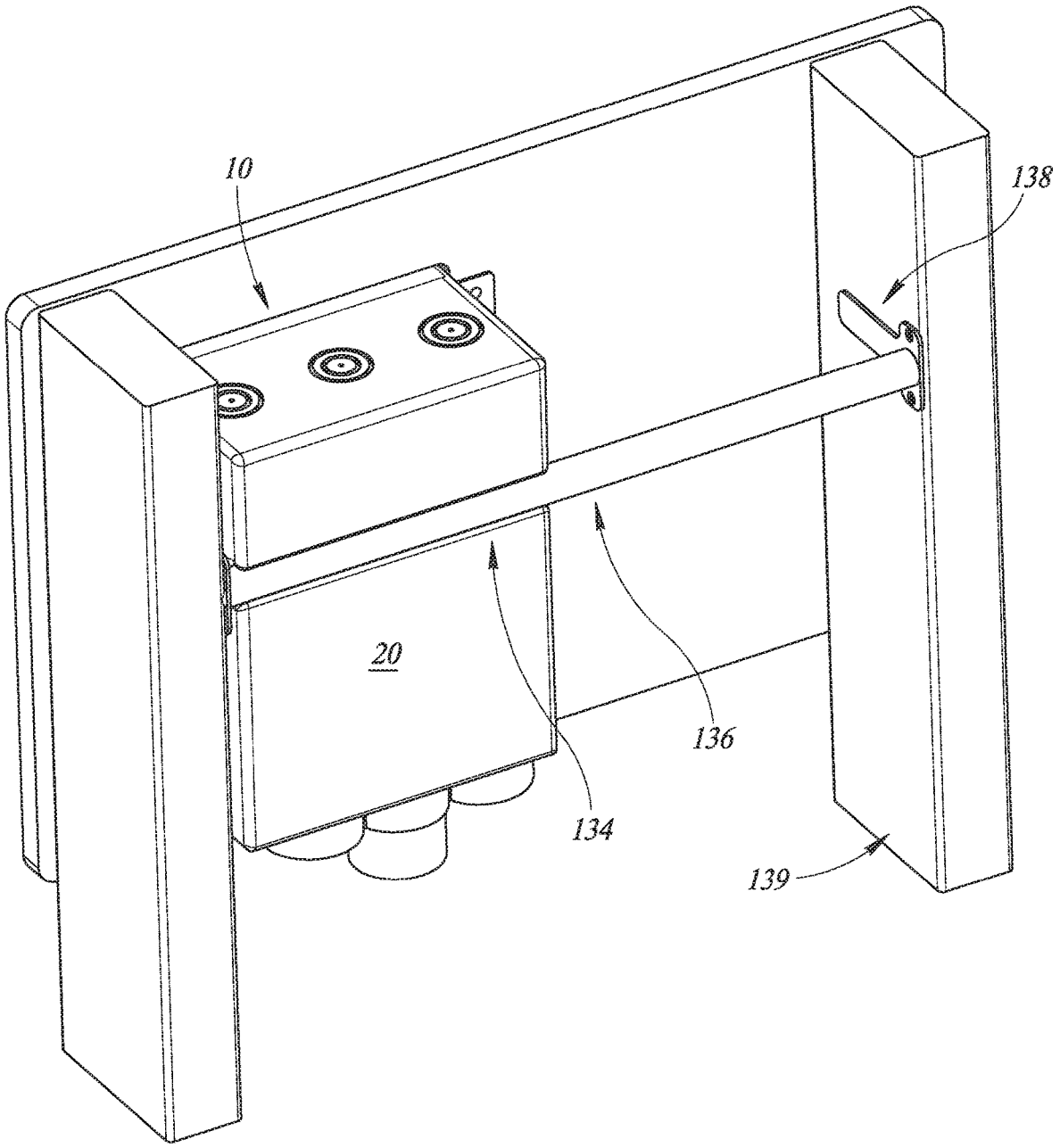
FIG. 37 illustrates a top rear perspective view of the mounting bracket and the pipe of FIG. 36 supportably attaching a utility box according to a second embodiment to wall studs.

The pipe 136 to which the box main housing 12 attaches may be a pre-existing or previously installed pipe in the building wall. However, it is unlikely that a previously installed pipe in the building will be optimally positioned for attachment of the box main housing 12 thereto. A pair of mounting brackets 138 are therefore provided for optimally positioning and installing a length of pipe 136 between opposing wall studs 139 or other opposing surfaces of the building wall, as shown in FIGS. 36 and 37. After the mounting brackets 138 are attached to opposing studs with the length of pipe 136 extending therebetween, the box main housing 12 may be mounted in the wall studs by pressing the housing inward to insert the length of pipe 136 within the support receptacle 134.

Figure 38:
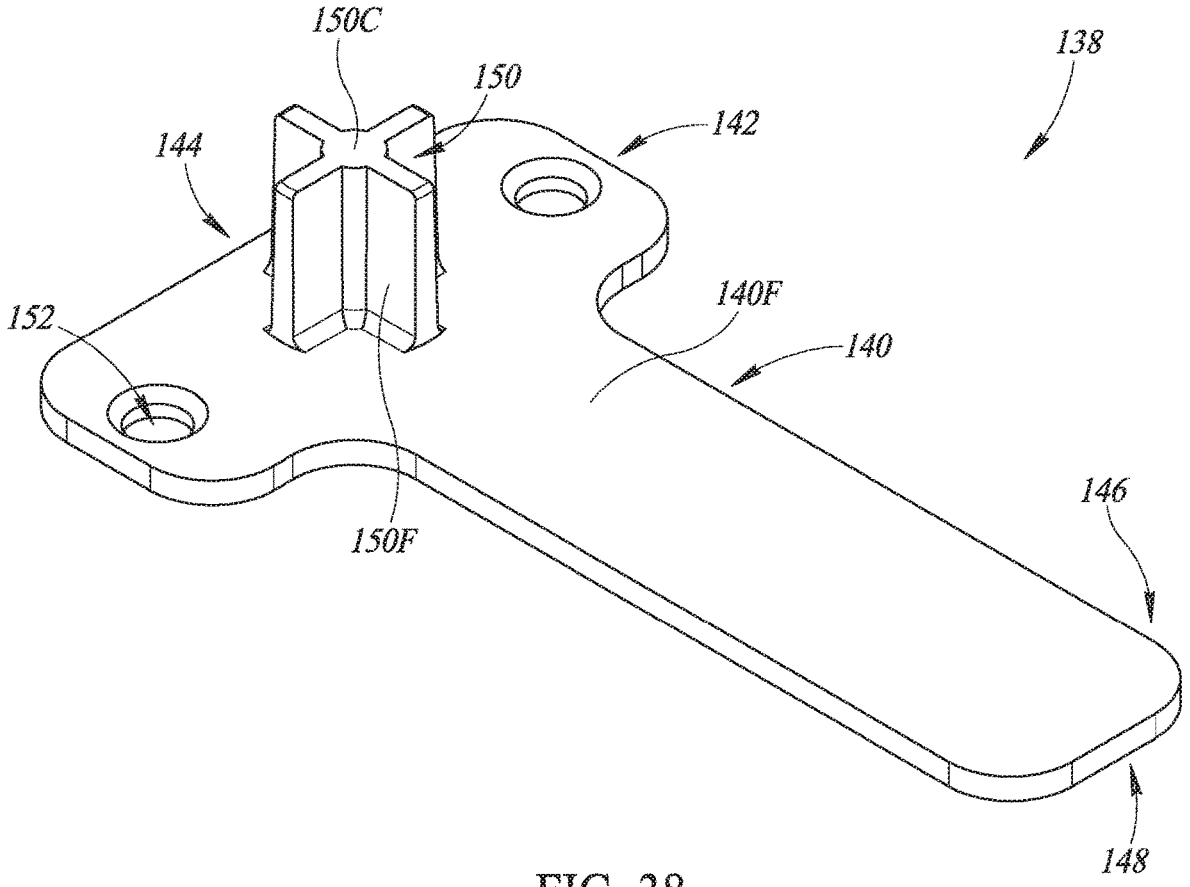
FIG. 38 illustrates a perspective view of the mounting bracket of FIG. 36.
Figure 39:
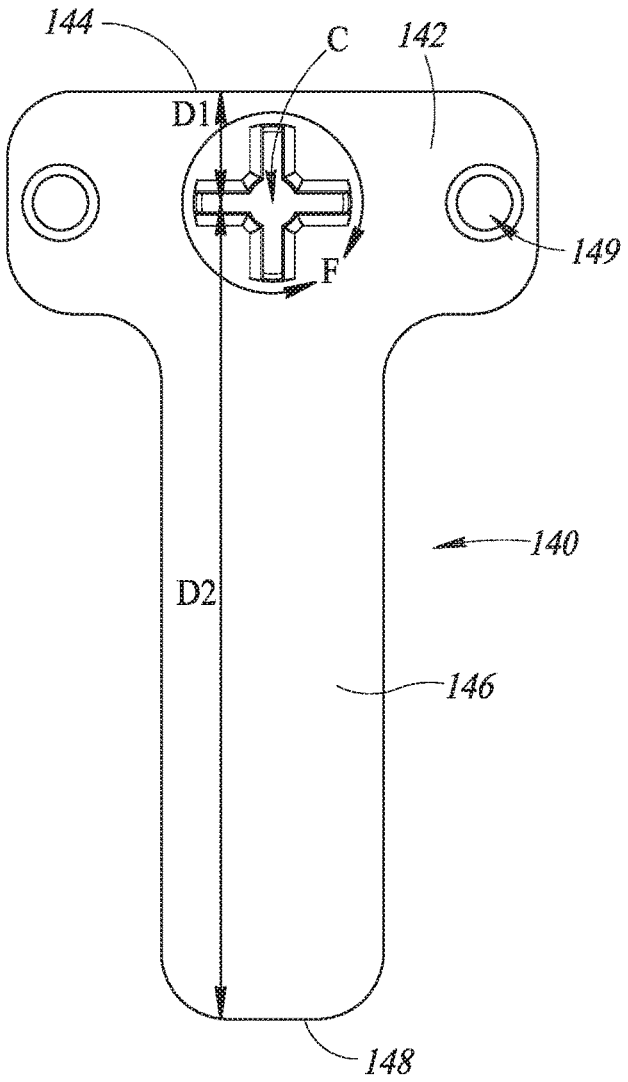
FIG. 39 illustrates a front view of the mounting bracket of FIG. 36.
Figure 40:
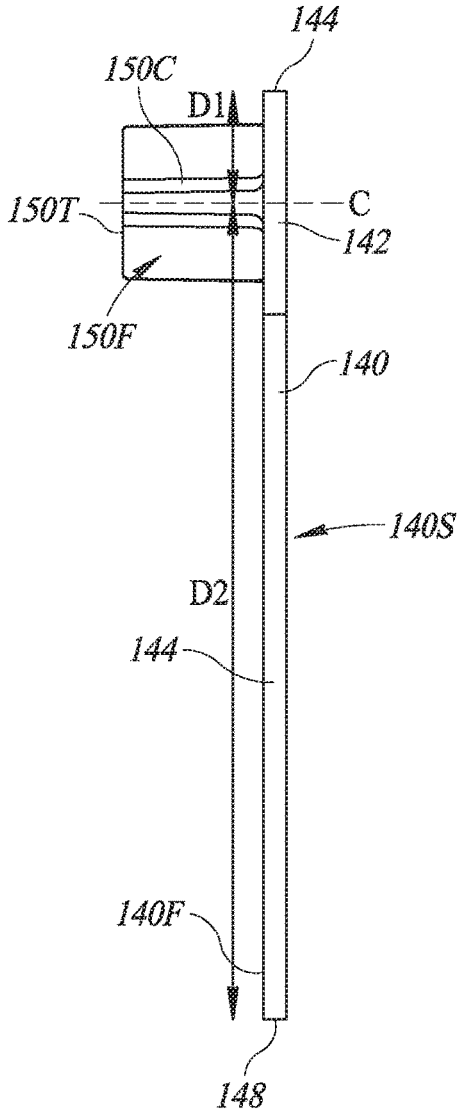
FIG. 40 illustrates a side view of the mounting bracket of FIG. 36.

The mounting brackets 138 have a substantially flat bracket main body 140 having a first section 142 at a first end 144 of the bracket main body 140, a second section 146 extending from a side of the first section 142 opposite to the first end 144 and terminating at a second end 148, and a pipe retaining member 150 for mounting the pipe 136 to the mounting bracket 138, as shown in FIGS. 38, 39, and 40. The first section 142 is a rectangular portion extending in a width direction of the main body 140 and the second section 146 is a rectangular portion extending in a length direction of the bracket main body 140 from a central portion of the side of the first section 142. The first end 144 of the bracket main body 140 has a substantially flat edge with a width wider than a substantially flat edge of the second end 148 opposite to the first end 144. Holes 149 extend through the thickness of the bracket main body 140 for receiving screws or nails therein to supportably mount the bracket main body 140 to a stud. In the present embodiment, there is a pair of holes 149 positioned on lateral sides of the first section 142; however, the position and/or number of holes 149 may vary in other embodiments, such as an additional hole positioned along the second section 146 or at the second end 148.

The retaining member 150 is sized and shaped to be inserted into the open end of the length of pipe 136. The length of pipe 136 extends between the pair of mounting brackets attached to the opposing faces of the two opposing wall studs 136 for supportably mounting the support receptacle 134 of the box main housing 12, as shown in FIG. 40. The retaining member 150 is a support projecting outward orthogonally from a first surface 140F of the flat bracket main body 140. The retaining member 150 in the present embodiment has a plurality of fin members 150F (e.g., four) extending radially outward from a central portion 150C. The cross-sectional area of the retaining member 150 is sized to snuggly fit a pipe 136 having a known inner diameter, such as 0.49 inches. The fin members 150F may each have a tapered or angular shape tapering or angled inwardly from the first surface 140F of the bracket main body 140 to a tip 150T of the retaining member 150. The tapered or angular shape may allow attachment of different sized pipes 136 to the mounting bracket 138. In some embodiments, the retaining member 150 may instead have a cylindrical or conical shape without fin members 150F.

The mounting brackets 138 are configured to allow the user to position the pipe 136 such that the front 21 of the box main housing 12 will be flush with the forward edge of the wall stud 139. Specifically, affixing the mounting brackets 138 to the wall stud 139 in a certain orientation depending on the standard size of the wall stud will ensure that the front of the box main housing 12 will be flush with the forward edge of the wall stud 139, without measuring the position of the mounting brackets 138 or box main housing 12. According to construction industry standards, the dimensions of wall studs 139 dimensions are typically either approximately 1.5 inches thick by 3.5 inches wide (i.e., "2×4 size") or approximately 1.5 inches thick by 5.5 inches wide (i.e., "2×6 size"). A central axis C of the retaining member 150 is offset along a length of the mounting bracket 138 at a first distance D1 from the first end 144 of the mounting bracket and at a second distance D2 from the second end 148 of the mounting bracket, as shown in FIGS. 39 and 40. In the current embodiment, for example, the first distance D1 is approximately 0.315 inches and the second distance D2 is approximately 2.315 inches (for a 0.63 inch outer diameter pipe). The mounting brackets 138 should be installed on the wall studs 139 in a first orientation if the wall stud 139 is of the 2×4 size and in a second orientation if the wall stud 139 is of the 2×6 size. In the first orientation, the first end 144 is positioned flush with the rearward side 139R of the 2×4 size wall studs 139 and the second end 148 oriented facing forward toward the forward side 139F of the wall studs 139 opposite to the rearward side 139R, as shown in FIGS. 36 and 37. In the second orientation, the second end 148 is positioned flush with the rearward side 139R of the 2×6 size wall studs 139 and the first end 144 is oriented facing forward toward the forward side of the wall studs 139 opposite to the rearward side 139R. In either case, the central axis C of the pipe 136 extending between the opposing wall studs 139 will be offset from the forward side of the wall studs 139 at approximately the same distance L. In this instance, the distance L is the distance between the front 21 of the box main housing 12 and the center axis 134A of the support receptacle 134 (see FIGS. 8A and 9). The distance L in the current embodiment may be approximately 3.2 inches, for example.

Figure 11:
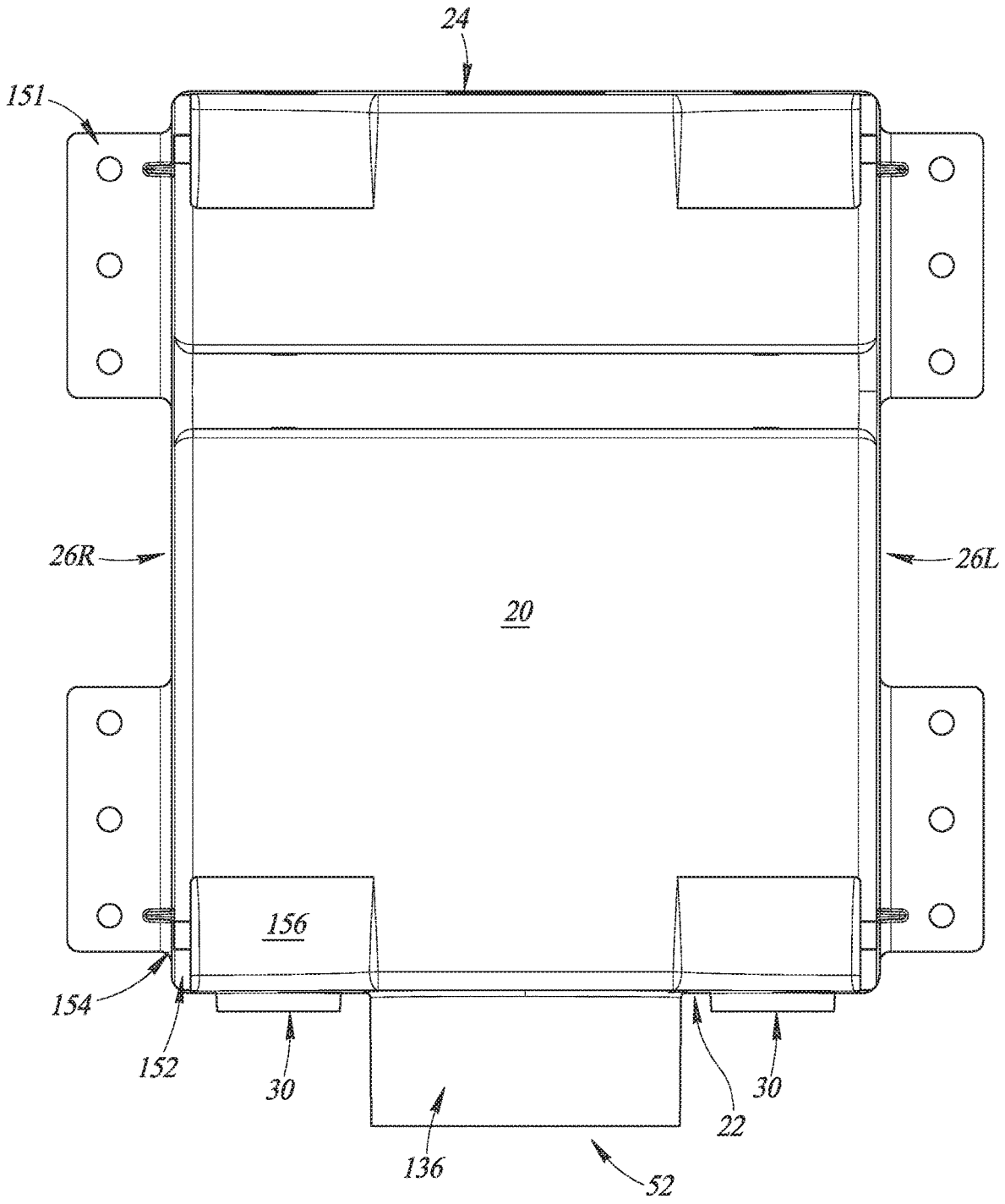
FIG. 11 illustrates a rear view of the box main housing of FIG. 5.

The box main housing 12 may include flanges 151 projecting outwardly from lateral sides 26L, 26R of the box main housing, as shown in FIGS. 6, 7, and 11. A front surface of the flanges 151 may be flush with the front 21 of the main box 12 for abutting inwardly facing surfaces of the building walls. The flanges 151 may have screw or nail holes extending therethrough for affixing the box main housing to the building walls. In some embodiments, the flanges 151 may be spaced at the distance L from the center axis 134A of the support receptacle 134 and rearwardly offset from the front 21 of the box main housing 12. Accordingly, when the box main housing 12 is installed and mounted using the mounting brackets 138 described above, the front 21 of the box main housing 12 may project through a hole in the building wall with the flanges 151 positioned flush against the inwardly facing surfaces of the building walls.

Mounting tabs 152 are disposed on box lateral sides 26L and 26R near or at the rear wall 20 for affixing the box main housing 12 to the wall studs 139, as shown in FIGS. 6, 11, and 36. The mounting tabs 152 are thin, flat portions having a mounting aperture 154 extending therethrough for receiving a fastener, such as a screw or a nail. The mounting apertures 154 in some embodiments may be elongated slots leading to a rearwardly opening mouth portion at a rear edge of the mounting tabs 152 for slideably receiving the shank of a fastener driven into the wall stud 139. If desired, the box main housing 12 may be affixed to the wall studs by driving a fastener through the mounting apertures 154 and into the wall studs 139, or by sliding the shank of a fastener into the rearwardly opening mouth portion of the elongated slot mounting apertures 154. The rearward edge of the mounting tabs 152 may be flush with or may not extend beyond the back surface of the rear wall 20, thereby reducing the amount of space required to affix the box main housing 12 to wall studs 139 within the building wall. A mounting recess 158 may be disposed in the rear wall 20 on an inwardly facing side of the mounting tab 152 for receiving the head and/or the shank of a fastener. The mounting tabs 152 are disposed at corners of the rear wall 20 in the present embodiment, although the mounting tabs may be disposed between corners on lateral sides of the rear wall 20 in other embodiments. The mounting recesses 156 may include a mouth portion opening upwardly along the upper wall 24 or downwardly along the lower wall 22 to facilitate insertion of a fastener therein.

Figure 41:
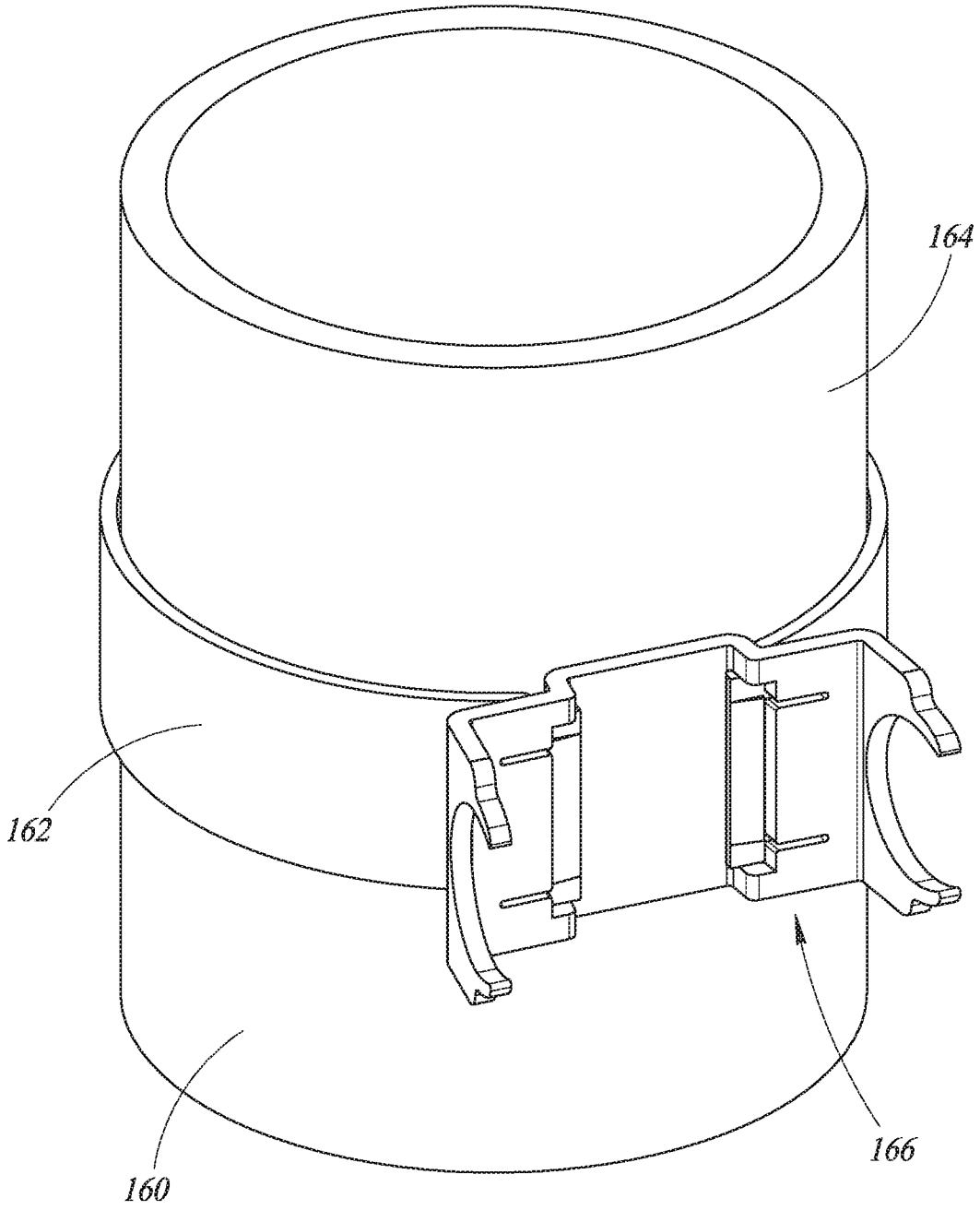
FIG. 41 illustrates a perspective view of a pipe support bracket attached to a pipe according to a first embodiment.
Figure 42:
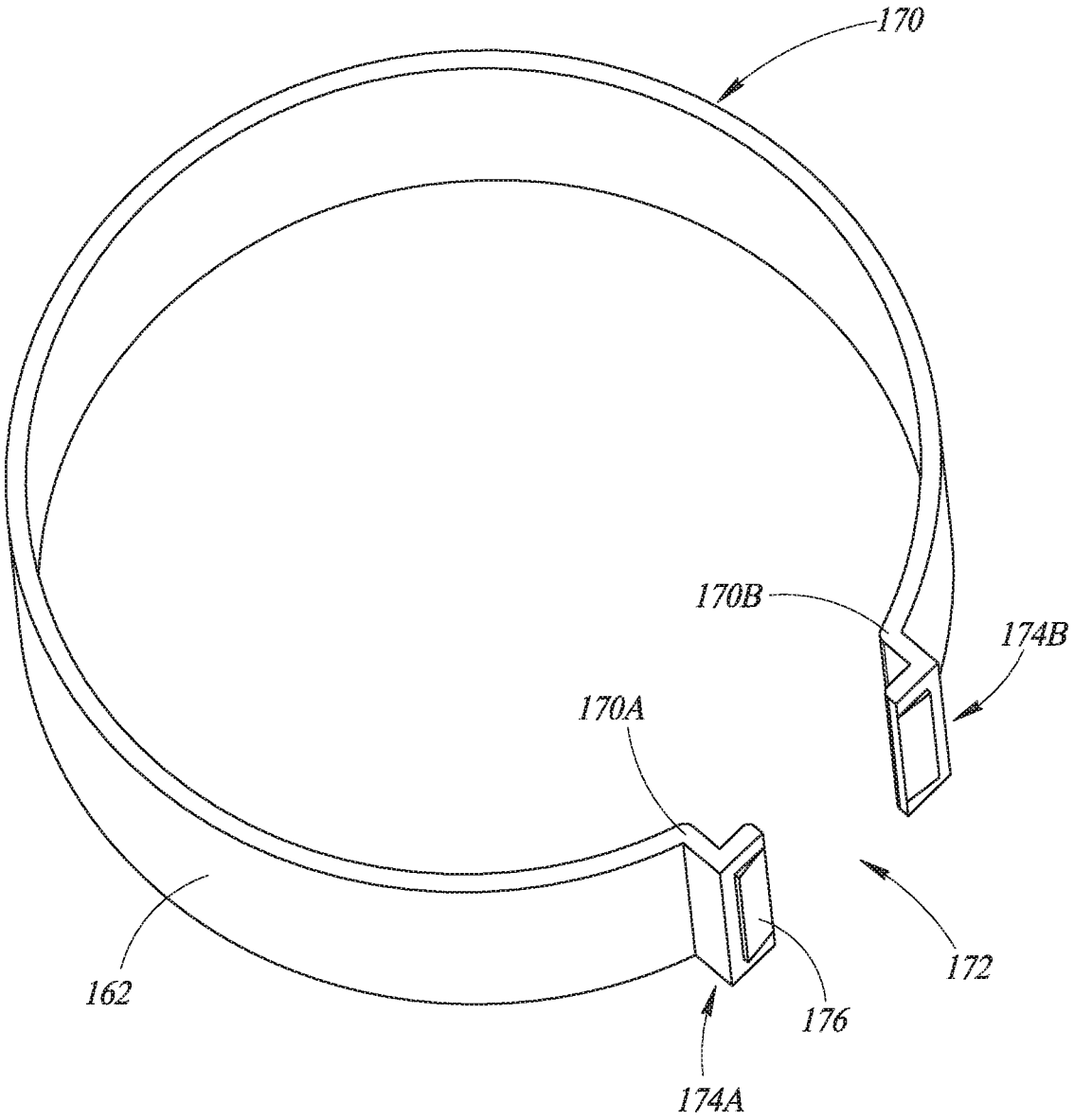
FIG. 42 illustrates a perspective view of a collar of the pipe support bracket of FIG. 41.

Pipe support brackets are provided for supportably attaching one pipe to another pipe. A pipe support bracket 160 includes a first collar 162 attachable to a first pipe 164, and a brace 166 for attaching a second pipe 168 to the first collar 162, as shown in FIG. 41. The first collar 162 has a C-shaped or semi-circular collar body 170 with opposing ends 170A and 170B spaced apart by an opening 172, as shown in FIG. 42. The first collar 162 has first attachment portions 174A and 174B projecting in parallel away from the ends 170A and 1706, then inwardly toward each other. Each first attachment portion has a latch element 176 protruding from an outwardly facing surface thereof. The collar body 170 is comprised of a resilient material, such as metal, PVC or polymer, that is flexible to space the ends 170A and 170B further apart for inserting the first pipe 164 into the collar body though the opening 172.

Figure 43:
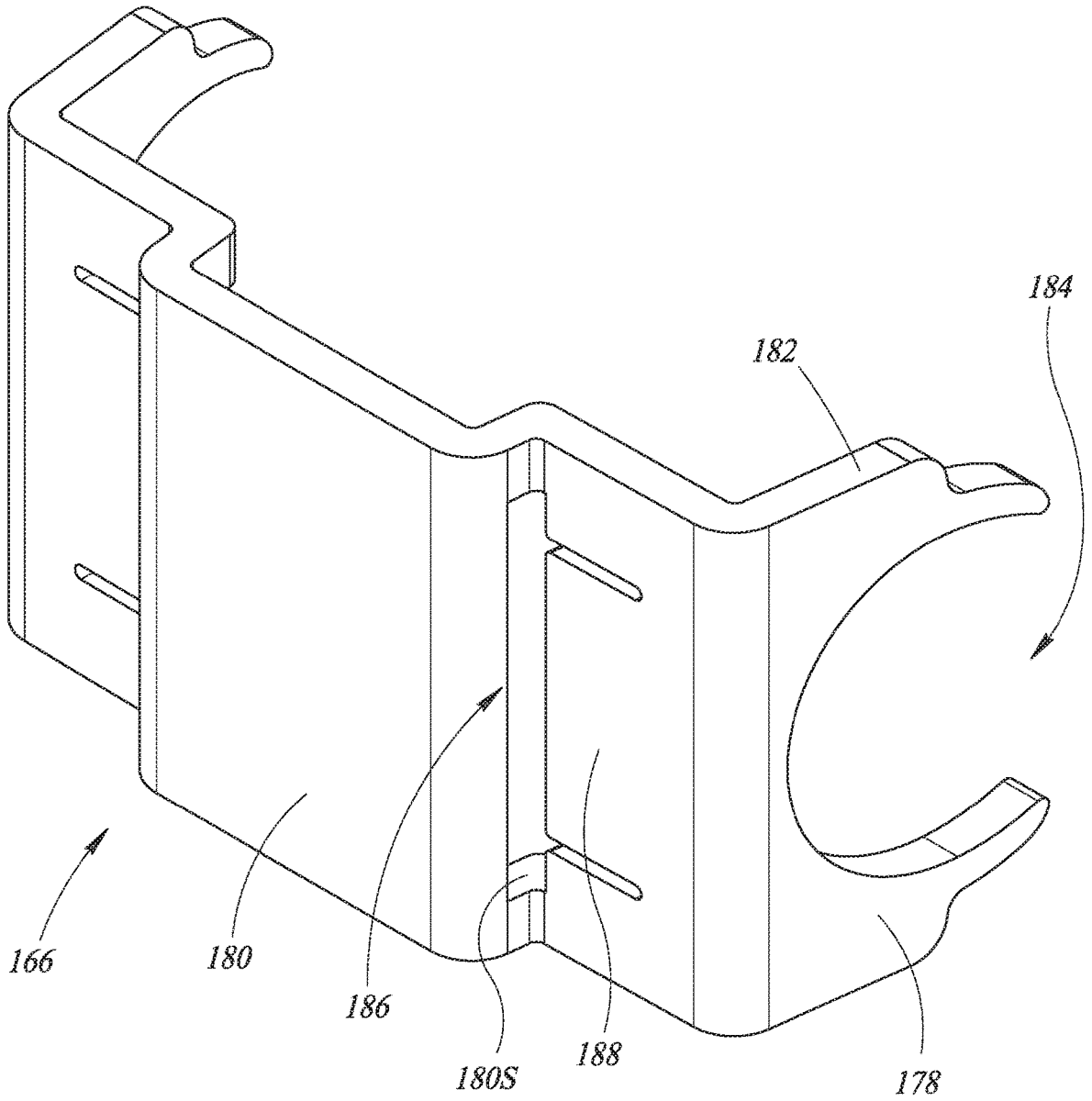
FIG. 43 illustrates a rear perspective view of a brace of the pipe support bracket of FIG. 41.
Figure 44:
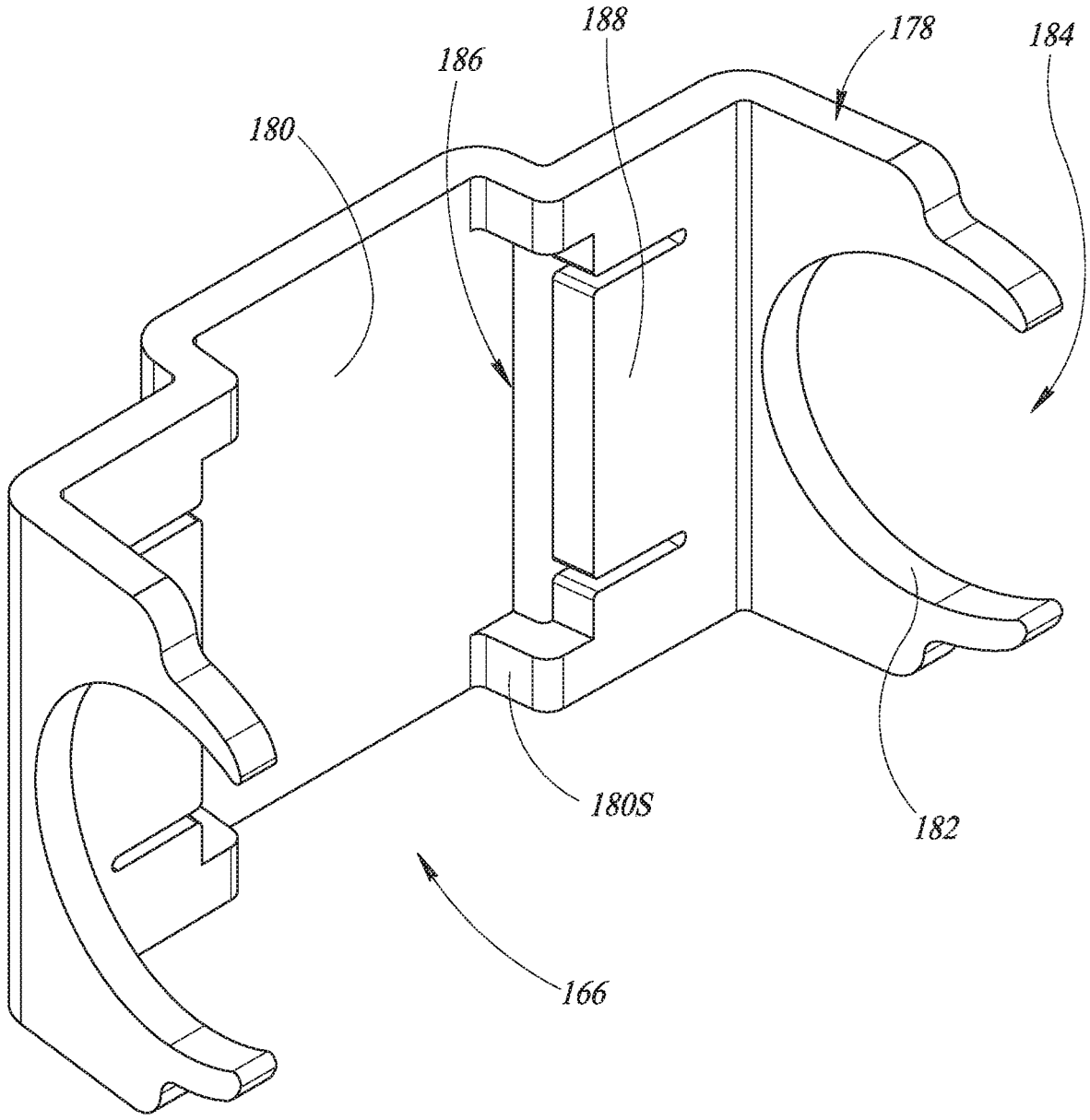
FIG. 44 illustrates a front perspective view of a brace of the pipe support bracket of FIG. 41.

The brace 166 has an elongated U-shape comprising a pair of brackets 178 extending in parallel with each other outwardly from a base portion 180, as shown in FIGS. 43 and 44. Each of the brackets 178 has a semi-circular or C-shaped pipe receptacle 182 having an opening 184 for receiving the second pipe 168 therein. Both of the pipe receptacles 182 are aligned with each other along a first direction (e.g., length) of the base portion 180 to supportably and firmly retain a length of the second pipe 168 in an orientation along the first direction. The base portion has a pair of collar receptacles 186 each sized and shaped for receiving a corresponding one of the first attachment portions 174A and 174B therein. The collar receptacles 186 may be apertures or recesses disposed on sidewall portions 180S of the base portion 180. A catch 188 located outwardly adjacent to each of the collar receptacles 184 is provided for retaining the attachment portions 174A and 174B inserted in the adjacent collar receptacle. Specifically, the catch 188 is a resiliently flexible member configured to be flexed or bent outwardly by the latch element 176 when the first attachment portion 174A and 174B is inserted into the collar receptacle 186. The catch 188 is configured to then rebound inwardly back to its original position when the latch element 176 is inserted beyond an inward edge of the catch 188, thereby helping to block or prevent removal of the attachment portion 174A and 174B from the collar receptacle 186 when inserted therein.

Figure 45:
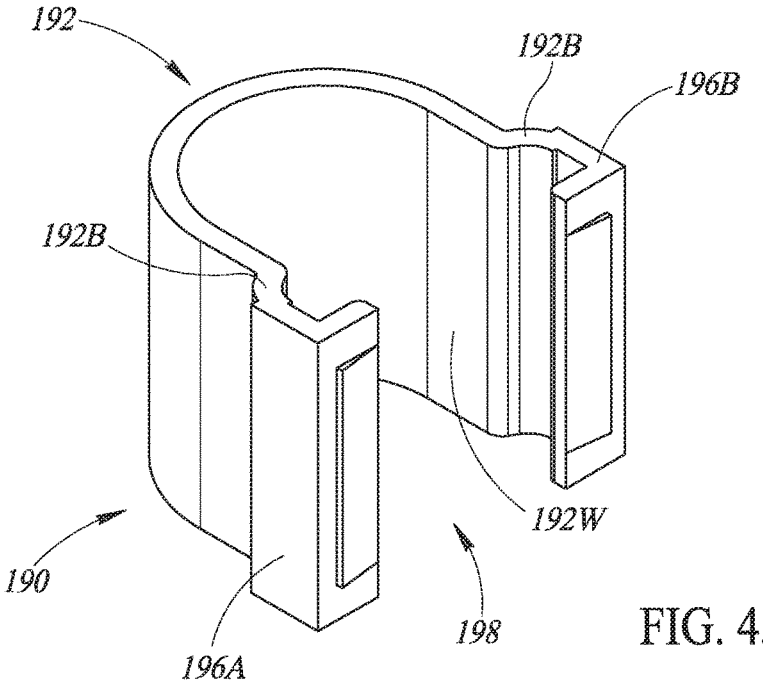
FIG. 45 illustrates a perspective view of a second collar of a pipe support bracket according to a second embodiment of the pipe support bracket.
Figure 46:
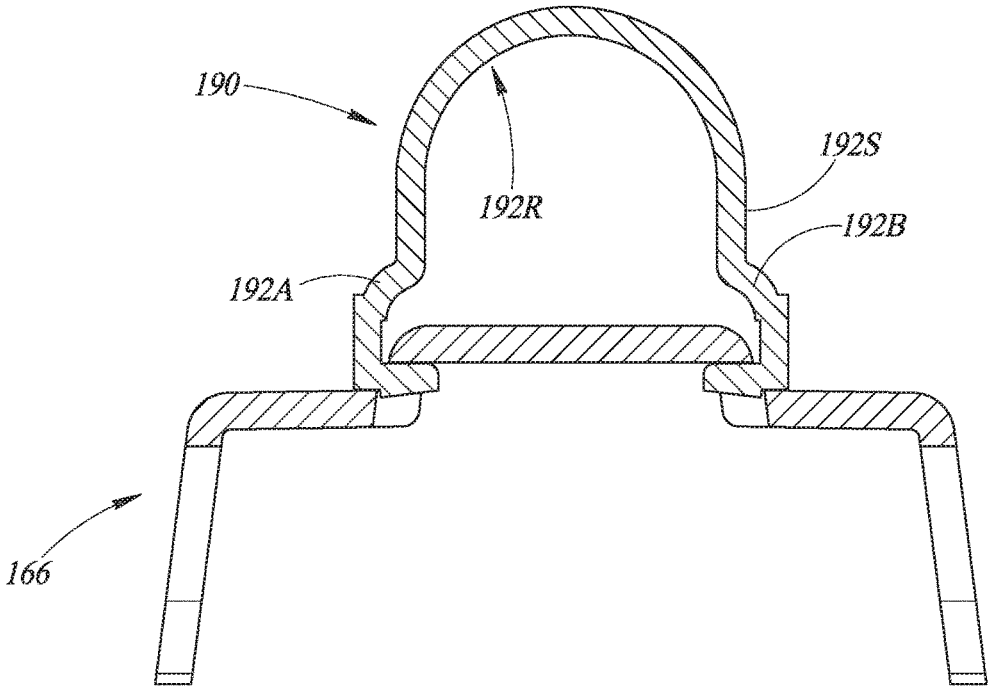
FIG. 46 illustrates a cross-sectional view of the pipe support bracket of FIG. 45.
Figure 47:
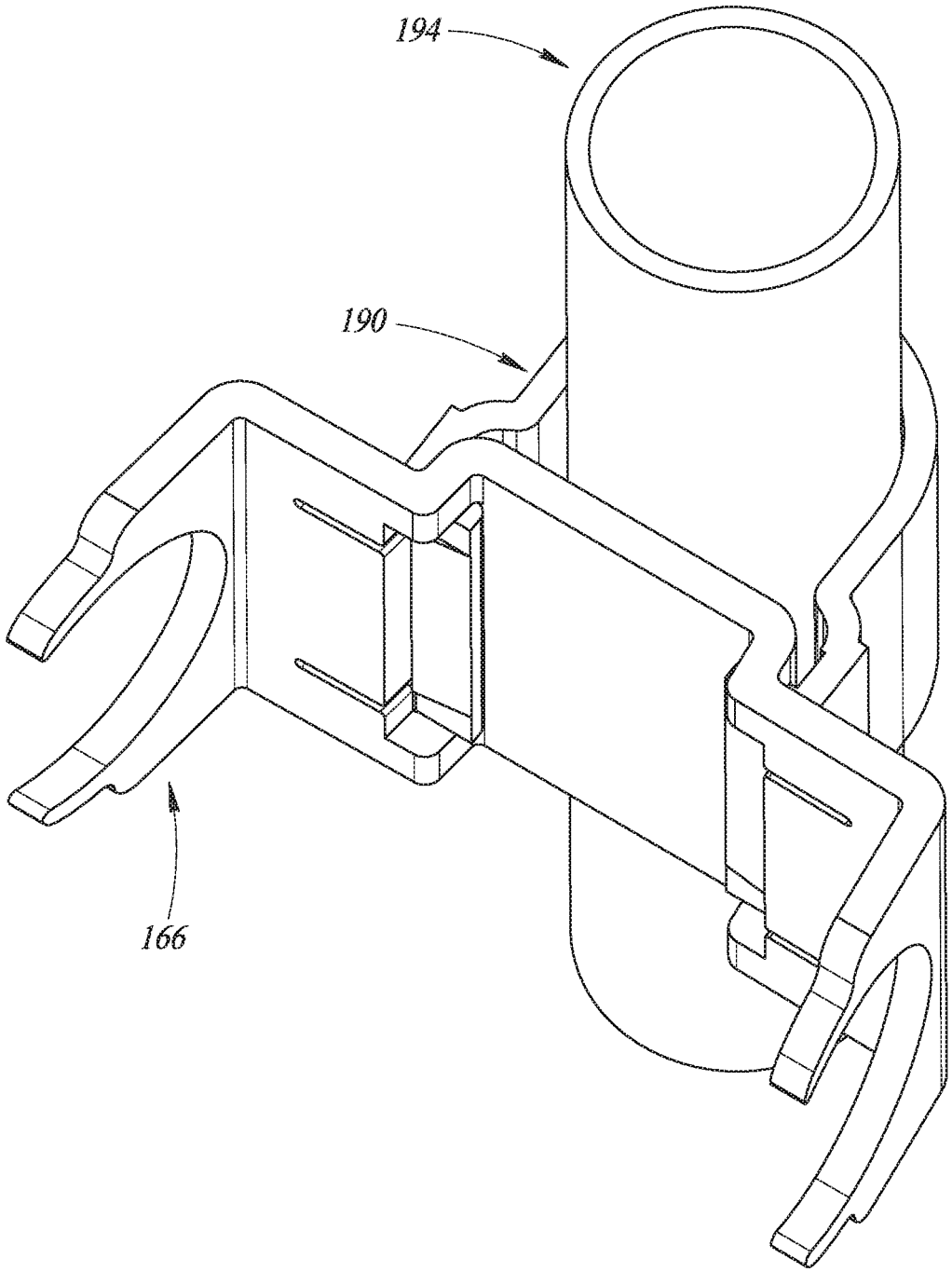
FIG. 47 illustrates a perspective view of the pipe support bracket of FIG. 45.

In another embodiment, a second collar 190 having a different configuration than the first collar 162 is provided for attaching to the brace 166, as shown in FIGS. 45, 46, and 47. The second collar 190 is sized and shaped for attaching, in conjunction with the brace 166, to a pipe 194 having a smaller diameter than the pipe 164. The second collar 190 has a concave or U-shaped collar body 192 extending in an axial direction. The second collar body 192 has a curved or round rear wall 192R, and may have sidewall portions 192S extending in parallel with each other in a direction orthogonal to the axial direction. End portions 192A and 1926 at ends of the second collar body 192 each flare outwardly away from each other. Attachment portions 196A and 1966 project in parallel from the end portions 192A and 192B, then inwardly toward each other. The attachment portions 196A and 196B are spaced apart by an opening 198 for receiving the pipe 194 within the second collar body 192. The second collar 190 is attachable to the brace 166 by engaging the attachment portions 196A and 196B with the openings 184 of the brace 166 in a manner substantially identical to the attachment portions 174A and 1746 described above. The base portion 180 of the brace 166 attached to the second collar 192 opposes the rear wall 192R and may abut a side of the second pipe 194 to help prevent or reduce movement or vibration of the second pipe therein.

FIGS. 51-93 illustrate additional embodiment of the utility box and its component parts similar to those shown in FIGS. 1-50 and described above.

Embodiments of the present disclosure can be described in view of the following clauses:

1. A utility box for mounting at least in part within a wall for use with a fluid carrying supply pipe, the box comprising:

a housing including a top wall, a bottom wall, a first side wall and a second side wall, a back wall and a front opening providing access into an interior of the housing defined by the top, bottom, first side, second side and back walls;

a bottom wall aperture in the bottom wall sized for extending the pipe through the bottom wall aperture with the pipe terminating in a free end portion positioned within the interior of the housing at a location above the bottom wall;

a valve attachable to the free end portion of the pipe, the junction of the valve and the pipe being within the interior of the housing above the bottom wall; and a first seal positioned to provide a fluid-tight seal between the bottom wall and the pipe to prevent fluid within the interior of the housing from passing out of the interior of the housing through the bottom wall aperture.

2. A utility box mounted at least in part within a wall, the box comprising: a housing including a top wall, a bottom wall, a first side wall and a second side wall, a back wall and a front opening providing access into an interior of the housing defined by the top, bottom, first side, second side and back walls;

a bottom wall aperture in the bottom wall;

a fluid carrying supply pipe extending through the bottom wall aperture and terminating in a free end portion within the interior of the housing at a location above the bottom wall;

a valve attached to the free end portion of the pipe, the junction of the valve and the pipe being within the interior of the housing above the bottom wall;

a first seal providing a fluid-tight seal between the bottom wall and the pipe to prevent fluid within the interior of the housing from passing out of the interior of the housing through the bottom wall aperture; and a second seal providing a fluid-tight seal between the free end portion of the pipe and the valve.

3. The utility box of clauses 1 or 2, further comprising: a manifold positioned to provide a fluid path between the free end portion of the pipe and the valve, the manifold having a lower connecting portion, an upper connecting portion and a side connecting portion positioned between the lower and upper connecting portions, with the lower connecting portion being connected in a fluid-tight arrangement to the free end portion of the pipe and one of the upper and side connecting portions being connected in a fluid-tight arrangement to the valve.

4. The utility box of any of clauses 1-3 for use with a fitting having a push-fit connector, wherein one of the upper and side connecting portions is a tube sized for having the push-fit connector pressed thereon.

5. The utility box of any of clauses 1-4, wherein the lower connecting portion comprises a push-fit connector sized for being pressed onto the free end portion of the pipe.

6. The utility box of any of clauses 1-5 for use with an arrestor assembly, wherein valve is connected to the side connecting portion and the upper connection portion is configured for connection to the arrestor assembly.

7. The utility box of any of clauses 1-6, further comprising: a manifold positioned to provide a fluid path between the free end portion of the pipe and the valve, the manifold having a lower connecting portion and an upper connecting portion, with the lower connecting portion being connected in a fluid-tight arrangement to the free end portion of the pipe and the upper connecting portions being connected in a fluid-tight arrangement to the valve.

8. A utility box for mounting at least in part within a wall for use with an in-wall drain pipe and a drain-fluid source conduit transporting a drain fluid for entry into the drain pipe, the box comprising:

a housing including a top wall, a bottom wall, a first side wall and a second side wall, a back wall and a front opening providing access into an interior of the housing defined by the top, bottom, first side, second side and back walls;

a bottom wall aperture in the bottom wall sized to be placed in fluid communication with the drain pipe;

a drain including a drain base positioned within the bottom wall aperture and in fluid-tight communication with the drain pipe, and a retaining member for removable attachment to the drain base for retaining the drain-fluid source conduit in place relative to the drain base for communication of the drain fluid into the drain base.

9. A method of mounting a utility box at least in part within a wall, the method comprising:

providing a housing including a top wall, a bottom wall, a first side wall and a second side wall, a back wall and a front opening providing access into an interior of the housing defined by the top, bottom, first side, second side and back walls, the bottom wall having a bottom wall aperture;

extending a fluid carrying supply pipe through the bottom wall aperture and an positioning a free end portion of the pipe within the interior of the housing at a location above the bottom wall;

attaching a valve to the free end portion of the pipe with the junction of the valve and the pipe being within the interior of the housing above the bottom wall;

positioning a first seal between the bottom wall and the pipe to provide a fluid-tight seal prevent fluid therebetween to prevent fluid within the interior of the housing from passing out of the interior of the housing through the bottom wall aperture; and positioning a second seal between the free end portion of the pipe and the valve to provide a fluid-tight seal therebetween.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

The invention claimed is:

1. A utility box for being mounting at least in part within a wall having an interior wall space defined between first and second spaced-apart, upright wall studs, with a section of support pipe positioned within the wall space and extending between the first and second wall studs, with a first end portion of the support pipe attached to the first wall stud and a second end portion of the support pipe attached to the second wall stud, the box comprising:

a housing including a top wall, a bottom wall, a first side wall, a second side wall, a back wall and a front opening providing access into an interior of the housing defined by the top, bottom, first side, second side and back walls, the top and bottom walls being spaced apart and the first and second side walls being spaced apart, the back wall extending between the first and second side walls, the first and second side walls each having a rearward portion adjacent to the back wall; and an elongated recess having a back wall recess portion in the back wall extending between the first and second side walls, the recess having a laterally open first end recess portion in the rearward portion of the first side wall and a laterally open second recess end portion in the rearward portion of the second side wall, the back wall recess portion, the first end recess portion and the second end recess portions together defining a channel having a rearwardly open channel opening extending the full width of the back wall and rearward portions of the first and second side walls, the channel opening being oriented to permit the box to be moved rearwardly into the wall space, and sized so that as moved rearwardly the support pipe is received through the channel opening and moved at least partially into the channel with the first and second end portions of the support pipe extending laterally beyond the first and second side walls, and when the support pipe is within the channel at least a portion of the weight of the box is supported by the support pipe.

2. The utility box of claim 1 for use with a support pipe having the diameter "D", wherein the back wall recess portion has a portion with an upper wall portion and a lower wall portion separated by at least the distance "D".

3. The utility box of claim 1 for use with a support pipe having the diameter "D", wherein the back wall recess portion has a portion with an upper wall portion terminating at an upper terminal end portion at the channel opening and a lower wall portion terminating at a lower terminal end portion at the channel opening, with the distance between the upper terminal end portion and the lower terminal end portion being at least the distance "D".

4. The utility box of claim 1, wherein the back wall recess portion has a portion with an upper wall portion terminating at an upper terminal end portion at the channel opening and a lower wall portion terminating at a lower terminal end portion at the channel opening, and a protuberance extending at least one of downward from the upper terminal end portion and upward from the lower terminal end portion to releasably retain the support pipe in the channel.

5. The utility box of claim 1, wherein the back wall recess portion has a portion with an upper wall portion terminating at an upper terminal end portion at the channel opening and a lower wall portion terminating at a lower terminal end portion at the channel opening, the upper wall portion having an concave shape.

6. The utility box of claim 1, wherein the back wall recess portion has a partially circular cross-sectional shape.

7. The utility box of claim 1, wherein the back wall recess portion has a C-shaped cross-sectional shape.

8. A utility box for being mounting at least in part within a wall having an interior wall space defined between first and second spaced-apart, upright wall studs, with a support member positioned within the wall space and extending between the first and second wall studs, with a first end portion of the support member attached to the first wall stud and a second end portion of the support member attached to the second wall stud, the box comprising:

a housing including a first side wall, a second side wall, a back wall and a front opening providing access into an interior of the housing, the first and second side walls being spaced apart, the back wall extending between the first and second side walls, the first and second side walls each having a rearward portion adjacent to the back wall; and an elongated recess having a back wall recess portion in the back wall extending between the first and second side walls, the recess having a laterally open first end recess portion in the rearward portion of the first side wall and a laterally open second recess end portion in the rearward portion of the second side wall, the back wall recess portion, the first end recess portion and the second end recess portions together defining a channel having a rearwardly open channel opening extending the full width of the back wall and rearward portions of the first and second side walls, the channel opening being oriented to permit the box to be moved rearwardly into the wall space, and sized so that as moved rearwardly the support member is received through the channel opening and moved at least partially into the channel with the first and second end portions of the support member extending laterally beyond the first and second side walls, and when the support member is within the channel at least a portion of the weight of the box is supported by the support member.

9. The utility box of claim 8 for use with a support member having a cross-sectional dimension "D", wherein the back wall recess portion has a portion with an upper wall portion and a lower wall portion separated by at least the distance "D".

10. The utility box of claim 8 for use with a support member having a cross-sectional dimension "D", wherein the back wall recess portion has a portion with an upper wall portion terminating at an upper terminal end portion at the channel opening and a lower wall portion terminating at a lower terminal end portion at the channel opening, with the distance between the upper terminal end portion and the lower terminal end portion being at least the distance "D".

11. The utility box of claim 8, wherein the back wall recess portion has a portion with an upper wall portion terminating at the channel opening at an upper terminal end portion and a lower wall portion terminating at the channel opening at a lower terminal end portion, and a protuberance extending at least one of downward from the upper terminal end portion and upward from the lower terminal end portion to releasably retain the support member in the channel.

12. The utility box of claim 8, wherein the back wall recess portion has a portion with an upper wall portion terminating at an upper terminal end portion at the channel opening and a lower wall portion terminating at a lower terminal end portion at the channel opening, the upper wall portion having an concave shape.

13. The utility box of claim 8, wherein the back wall recess portion has a shape at least partially matching at least a portion of the cross-sectional shape of the support member.

14. A utility box for being mounting at least in part within a wall having an interior wall space defined between first and second spaced-apart, upright wall studs, with a support member positioned within the wall space and extending between the first and second wall studs, with a first end portion of the support member attached to the first wall stud and a second end portion of the support member attached to the second wall stud, the box comprising:

a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud, the first and second side walls each having a rearward portion, the rearward portion of the first side wall having a laterally open first side wall recess portion with a rearwardly open opening and the rearward portion of the second side wall having a laterally open second side wall recess portion with a rearwardly open opening, the first and second side wall recess portions being oriented to permit the box to be moved rearwardly into the wall space, and sized so that as moved rearwardly the support member is received through the rearwardly open openings of the first and second side wall recess portions and moved at least partially into the first and second side wall recess portions with the first end portion of the support member extending laterally outward beyond the first side wall and the second end portion of the support member extending laterally outward beyond the second side wall, and when the support member is within the first and second side wall recess portions at least a portion of the weight of the box is supported by the support member.

15. A utility box for being mounting at least in part within a wall having an interior wall space defined between first and second spaced-apart, upright wall studs, with a support member positioned within the wall space and extending between the first and second wall studs, with a first end portion of the support member attached to the first wall stud and a second end portion of the support member attached to the second wall stud, the box comprising:

a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud; and a support receptacle on a rearward side of the back wall having a back wall recess portion in the back wall, the support receptacle being attachable to the support member when the housing is positioned at least in part within the wall space with the first side wall laterally in inward of the first wall stud and the second side wall is laterally inward of the second wall stud, and when the support receptacle is attached to the support member at least a portion of the weight of the box is supported by the support member, the support receptacle including an elongated back wall opening in the back wall extending between the first and second side walls, with a first end of the back wall opening being aligned with a first opening in a rearward portion of the first side wall and a second end of the back wall opening being aligned with a second opening in a rearward portion of the second side wall, the back wall opening, the first opening and the second opening together defining an open region extending the full width of the back wall and rearward portions of the first and second side walls, the open region being positioned to permit the box to be moved rearwardly into the wall space, and sized so that as moved rearwardly the support member is received at least partially within the open region with the first and second end portions of the support member extending laterally beyond the first and second side walls, and when the support member is within the open region at least a support portion of the housing engages the support member and is supported by the support member.

16. The utility box of claim 15, wherein the support portion is an upper wall portion positioned at an upper portion of the open region for engagement with the support member when the housing is positioned at least in part within the wall space to transmit at least a portion of the weight of the box the support member.

17. The utility box of claim 16, wherein the support portion further includes a lower wall portion spaced apart from the upper wall portion with an opening therebetween sized to permit the support member to move through the opening for positioning of the upper wall portion in engagement with the support member.

18. A utility box assembly for being mounting at least in part within a wall having an interior wall space defined between first and second spaced-apart, upright wall studs, the box assembly comprising:

a support member having a length sized for positioning within the wall space and extending between the first and second wall studs, a first end portion of the support member being attachable to the first wall stud and a second end portion of the support member being attachable to the second wall stud;

a housing including a first side wall, a second side wall, a back wall and a front opening providing access into an interior of the housing, the first and second side walls being spaced apart, the back wall extending between the first and second side walls, the first and second side walls each having a rearward portion adjacent to the back wall; and an elongated recess having a back wall recess portion in the back wall extending between the first and second side walls, the recess having a laterally open first end recess portion in the rearward portion of the first side wall and a laterally open second recess end portion in the rearward portion of the second side wall, the back wall recess portion, the first end recess portion and the second end recess portions together defining a channel having a rearwardly open channel opening extending the full width of the back wall and rearward portions of the first and second side walls, the channel opening being oriented to permit the box to be moved rearwardly into the wall space, and sized so that as moved rearwardly the support member when attached to the first and second wall studs is received through the channel opening and moved at least partially into the channel with the first and second end portions of the support member extending laterally beyond the first and second side walls, and when the support member is within the channel at least a portion of the weight of the box is supported by the support member.

19. The utility box assembly of claim 18, wherein the support member is a section of pipe.

20. The utility box assembly of claim 19, wherein the pipe has a diameter "D", and the back wall recess portion has a portion with an upper wall portion and a lower wall portion separated by at least the distance "D".

21. The utility box assembly of claim 19, wherein the back wall recess portion has a portion with an upper wall portion terminating at an upper terminal end portion at the channel opening and a lower wall portion terminating at a lower terminal end portion at the channel opening, and a protuberance extending at least one of downward from the upper terminal end portion and upward from the lower terminal end portion to releasably retain the support pipe in the channel.

22. The utility box assembly of claim 18, wherein the support member has a cross-sectional dimension "D", and the back wall recess portion has a portion with an upper wall portion and a lower wall portion separated by at least the distance "D".

23. The utility box assembly of claim 22, wherein the support member has a cross-sectional dimension "D", and the back wall recess portion has a portion with an upper wall portion terminating at an upper terminal end portion at the channel opening and a lower wall portion terminating at a lower terminal end portion at the channel opening, with the distance between the upper terminal end portion and the lower terminal end portion being at least the distance "D".

24. The utility box assembly of claim 18, wherein the back wall recess portion has a portion with an upper wall portion terminating at the channel opening at an upper terminal end portion and a lower wall portion terminating at the channel opening at a lower terminal end portion, and a protuberance extending at least one of downward from the upper terminal end portion and upward from the lower terminal end portion to releasably retain the support member in the channel.

25. The utility box assembly of claim 18, wherein the back wall recess portion has a portion with an upper wall portion terminating at an upper terminal end portion at the channel opening and a lower wall portion terminating at a lower terminal end portion at the channel opening, the upper wall portion having an concave shape.

26. The utility box assembly of claim 18, wherein the back wall recess portion has a shape at least partially matching at least a portion of the cross-sectional shape of the support member to be engaged by the back wall recess portion.

27. A utility box assembly for being mounting at least in part within a wall having an interior wall space defined between first and second spaced-apart, upright wall studs, the box assembly comprising:

a support member having a length sized for positioning within the wall space and extending between the first and second wall studs, with a first end portion of the support member being adjacent to the first wall stud and a second end portion of the support member being adjacent to the second wall stud;

a first mounting bracket attachable to the first wall stud and having a first support portion to which the first end portion of the support member is attachable to attach the first end portion of the support member to the first wall stud for support of the first end portion of the support member by the second wall stud;

a second mounting bracket attachable to the second wall stud and having a second support portion to which the second end portion of the support member is attachable to attach the second end portion of the support member to the second wall stud for support of the second end portion of the support member by the second wall stud;

a housing including a first side wall, a second side wall, a back wall and a front opening providing access into an interior of the housing, the first and second side walls being spaced apart, the back wall extending between the first and second side walls, the first and second side walls each having a rearward portion adjacent to the back wall; and an elongated recess having a back wall recess portion in the back wall extending between the first and second side walls, the recess having a laterally open first end recess portion in the rearward portion of the first side wall and a laterally open second recess end portion in the rearward portion of the second side wall, the back wall recess portion, the first end recess portion and the second end recess portions together defining a channel having a rearwardly open channel opening extending the full width of the back wall and rearward portions of the first and second side walls, the channel opening being oriented to permit the box to be moved rearwardly into the wall space, and sized so that as moved rearwardly the support member when attached to the first and second wall studs is received through the channel opening and moved at least partially into the channel with the first and second end portions of the support member extending laterally beyond the first and second side walls, and when the support member is within the channel at least a portion of the weight of the box is supported by the support member.

28. The utility box assembly of claim 27, wherein the support member is a section of pipe.

29. The utility box assembly of claim 28, wherein the back wall recess portion has a partially circular cross-sectional shape.

30. The utility box assembly of claim 28, wherein the back wall recess portion has a C-shaped cross-sectional shape.

31. The utility box assembly of claim 27, wherein the support member has a diameter "D", and the back wall recess portion has a portion with an upper wall portion and a lower wall portion separated by at least the distance "D".

32. The utility box assembly of claim 27, wherein the back wall recess portion has a portion with an upper wall portion terminating at an upper terminal end portion at the channel opening and a lower wall portion terminating at a lower terminal end portion at the channel opening, and a protuberance extending at least one of downward from the upper terminal end portion and upward from the lower terminal end portion to releasably retain the support member in the channel.

33. The utility box assembly of claim 27, wherein the support member has a cross-sectional dimension "D", and the back wall recess portion has a portion with an upper wall portion and a lower wall portion separated by at least the distance "D".

34. The utility box assembly of claim 27, wherein the support member has a cross-sectional dimension "D", and the back wall recess portion has a portion with an upper wall portion terminating at an upper terminal end portion at the channel opening and a lower wall portion terminating at a lower terminal end portion at the channel opening, with the distance between the upper terminal end portion and the lower terminal end portion being at least the distance "D".

35. The utility box assembly of claim 27, wherein the back wall recess portion has a portion with an upper wall portion terminating at the channel opening at an upper terminal end portion and a lower wall portion terminating at the channel opening at a lower terminal end portion, and a protuberance extending at least one of downward from the upper terminal end portion and upward from the lower terminal end portion to releasably retain the support member in the channel.

36. The utility box assembly of claim 27, wherein the back wall recess portion has a portion with an upper wall portion terminating at an upper terminal end portion at the channel opening and a lower wall portion terminating at a lower terminal end portion at the channel opening, the upper wall portion having an concave shape.

37. The utility box assembly of claim 27, wherein the back wall recess portion has a shape at least partially matching at least a portion of the cross-sectional shape of the support member to be engaged by the back wall recess portion.

38. The utility box assembly of claim 27, wherein the first mounting bracket has a first main bracket body positionable against and securable to the first stud, and a first retaining member attached to the first main bracket body and attachable to the first end portion of the support member, and the second mounting bracket has a second main bracket body positionable against and securable to the second stud, and a second retaining member attached to the second main bracket body and attachable to the second end portion of the support member.

39. The utility box assembly of claim 38, wherein the first end portion of the support member has a first end opening, and the second end portion of the support member has a second end opening, the first retaining member of the first mounting bracket being insertable within the first end opening of the support member to attach the first retaining member to the first end portion of the support member, and the second retaining member of the second mounting bracket being insertable within the second end opening of the support member to attach the second retaining member to the second end portion of the support member.

40. The utility box assembly of claim 39, wherein the first retaining member of the first mounting bracket has a first plurality of fins extending radially outward from a first central core portion, the first plurality of fins being sized and arranged to snugly fit within the first end opening of the support member, and the second retaining member of the second mounting bracket has a second plurality of fins extending radially outward from a second central core portion, the second plurality of fins being sized and arranged to snugly fit within the second end opening of the support member.

41. The utility box assembly of claim 38, wherein the first end portion of the support member has a first end opening, and the first retaining member of the first mounting bracket being insertable within the first end opening of the support member to attach the first retaining member to the first end portion of the support member.

42. The utility box assembly of claim 38 usable with first and second wall studs of two different sizes, a first size having a stud lateral side with a first depth dimension and a second size having a stud lateral side with a second depth dimension larger than the first depth dimension, the stud lateral side of each of the first and second wall studs being the side of wall stud facing toward the other wall stud, whereby the wall studs with the first depth dimension provide an interior wall space with a first wall space depth dimension and the wall studs with the second depth dimension provide an interior wall space with a second wall space depth dimension larger than the first wall space depth dimension, the first and second wall studs of both sizes having a rearward facing side and a forward facing side, wherein the first main bracket body of the first mounting bracket has a first end and a second end spaced apart from the first end, with the first retaining member attached to the first main bracket body at a location between the first and second ends of the first main bracket body, whereat when the first mounting bracket is attached to the stud lateral side of the first wall stud of the first size with the first end of the first main bracket body positioned adjacent to the rearward facing side of the first wall stud, the first retaining member is located at a position which positions the front opening of the housing at a selected position, and whereat when the first mounting bracket is attached to the stud lateral side of the first wall stud of the second size with the second end of the first main bracket body positioned adjacent to the rearward facing side of the first wall stud, the first retaining member is located at a position which positions the front opening of the housing at the selected position; and wherein the second main bracket body of the second mounting bracket has a first end and a second end spaced apart from the first end, with the second retaining member attached to the second main bracket body at a location between the first and second ends of the second main bracket body, whereat when the second mounting bracket is attached to the stud lateral side of the second wall stud of the first size with the first end of the second main bracket body positioned adjacent to the rearward facing side of the second wall stud, the second retaining member is located at a position which positions the front opening of the housing at the selected position, and whereat when the second mounting bracket is attached to the stud lateral side of the second wall stud of the second size with the second end of the second main bracket body positioned adjacent to the rearward facing side of the second wall stud, the second retaining member is located at a position which positions the front opening of the housing at the selected position.

43. The utility box assembly of claim 38 usable with first and second wall studs of two different sizes, a first size having a stud lateral side with a first depth dimension and a second size having a stud lateral side with a second depth dimension larger than the first depth dimension, the stud lateral side of each of the first and second wall studs being the side of wall stud facing toward the other wall stud, whereby the wall studs with the first depth dimension provide an interior wall space with a first wall space depth dimension and the wall studs with the second depth dimension provide an interior wall space with a second wall space depth dimension larger than the first wall space depth dimension, the first and second wall studs of both sizes having a rearward facing side and a forward facing side, wherein the first main bracket body of the first mounting bracket has a first end and a second end spaced apart from the first end, with the first retaining member attached to the first main bracket body at a location between the first and second ends of the first main bracket body, whereat when the first mounting bracket is attached to the stud lateral side of the first wall stud of the first size with the first end of the first main bracket body positioned adjacent to the rearward facing side of the first wall stud, the first retaining member is located at a position which positions the front opening of the housing at a selected position, and whereat when the first mounting bracket is attached to the stud lateral side of the first wall stud of the second size with the second end of the first main bracket body positioned adjacent to the rearward facing side of the first wall stud, the first retaining member is located at a position which positions the front opening of the housing at the selected position.

44. A utility box assembly for being mounting at least in part within a wall having an interior wall space defined between first and second spaced-apart, upright wall studs, the box assembly comprising:

a support member having a length sized for positioning within the wall space and extending between the first and second wall studs, a first end portion of the support member being attachable to the first wall stud and a second end portion of the support member being attachable to the second wall stud;

a housing including a first side wall, a second side wall, a back wall and a front opening providing access into an interior of the housing, the first and second side walls being spaced apart, the back wall extending between the first and second side walls, the first and second side walls each having a rearward portion adjacent to the back wall; and an elongated recess having a back wall recess portion in the back wall extending between the first and second side walls, the recess having a laterally open first end recess portion in the rearward portion of the first side wall and a laterally open second recess end portion in the rearward portion of the second side wall, the back wall recess portion, the first end recess portion and the second end recess portions together defining a channel having a rearwardly open channel opening extending the full width of the back wall and rearward portions of the first and second side walls, the channel opening being sized to receive the support member through the channel opening with the first and second end portions of the support member extending laterally beyond the first and second side walls, and when the support member is within the channel at least a portion of the weight of the box is supported by the support member.

45. A utility box assembly for being mounting at least in part within a wall having an interior wall space defined between first and second spaced-apart, upright wall studs, the box assembly comprising:

a support member having a length sized for positioning within the wall space and extending between the first and second wall studs, a first end portion of the support member being attachable to the first wall stud and a second end portion of the support member being attachable to the second wall stud; and a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud, the first and second side walls each having a rearward portion, the rearward portion of the first side wall having a laterally open first side wall recess portion with a rearwardly open opening and the rearward portion of the second side wall having a laterally open second side wall recess portion with a rearwardly open opening, the first and second side wall recess portions being oriented to permit the box to be moved rearwardly into the wall space, and sized so that as moved rearwardly the support member is received through the rearwardly open openings of the first and second side wall recess portions and moved at least partially into the first and second side wall recess portions with the first end portion of the support member extending laterally outward beyond the first side wall and second end portion of the support member extending laterally outward beyond the second side wall, and when the support member is within the first and second side wall recess portions at least a portion of the weight of the box is supported by the support member.

46. A utility box assembly for being mounting at least in part within a wall having an interior wall space defined between first and second spaced-apart, upright wall studs, the box assembly comprising:

a support member having a length sized for positioning within the wall space and extending between the first and second wall studs, a first end portion of the support member being attachable to the first wall stud and a second end portion of the support member being attachable to the second wall stud;

a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud; and a support receptacle on a rearward side of the back wall having a back wall recess portion in the back wall, the support receptacle being attachable to the support member when the housing is positioned at least in part within the wall space with the first side wall laterally in inward of the first wall stud and the second side wall is laterally inward of the second wall stud, and when the support receptacle is attached to the support member at least a portion of the weight of the box is supported by the support member, the support receptacle including an elongated back wall opening in the back wall extending between the first and second side walls, with a first end of the back wall opening being aligned with a first opening in a rearward portion of the first side wall and a second end of the back wall opening being aligned with a second opening in a rearward portion of the second side wall, the back wall opening, the first opening and the second opening together defining an open region extending the full width of the back wall and rearward portions of the first and second side walls, the open region being positioned to permit the box to be moved rearwardly into the wall space, and sized so that as moved rearwardly the support member is received at least partially within the open region with the first and second end portions of the support member extending laterally beyond the first and second side walls, and when the support member is within the open region at least a support portion of the housing engages the support member and is supported by the support member.

47. The utility box assembly of claim 46, wherein the support portion is an upper wall portion positioned at an upper portion of the open region for engagement with the support member when the housing is positioned at least in part within the wall space to transmit at least a portion of the weight of the box the support member.

48. The utility box assembly of claim 47, wherein the support portion further includes a lower wall portion spaced apart from the upper wall portion with an opening therebetween sized to permit the support member to move through the opening for positioning of the upper wall portion in engagement with the support member.

49. A utility box for being mounting at least in part within a wall having an interior wall space defined between first and second spaced-apart, upright wall studs, with a support member positioned within the wall space and extending between the first and second wall studs, with a first end portion of the support member attached to the first wall stud and a second end portion of the support member attached to the second wall stud, the box comprising:

a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud, the first and second side walls each having a rearward portion, the rearward portion of the first side wall having a laterally open first side wall recess portion with a rearwardly open opening and the rearward portion of the second side wall having a laterally open second side wall recess portion with a rearwardly open opening, the back wall having a back wall recess portion extending at least partially between the first and second side walls, the back wall recess portion having a laterally open first back wall end portion and a laterally open second back wall end portion, the back wall recess portion having a rearwardly open opening, the first and second side wall recess portions and the back wall recess portion being oriented to permit the box to be moved rearwardly into the wall space, and sized so that as moved rearwardly the support member is received through the rearwardly open openings of the first and second side wall recess portions and the rearwardly open opening of the back wall recess portion, and moved at least partially into the first and second side wall recess portions and the back wall recess portion with the first end portion of the support member extending laterally outward beyond the first side wall and second end portion of the support member extending laterally outward beyond the second side wall, and when the support member is within the first and second side wall recess portions and the back wall recess portion, at least a portion of the weight of the box is supported by the support member.

50. The utility box of claim 49, wherein the back wall recess is located between an upper portion of the back wall above and immediately adjacent to the back wall recess and a lower portion of the back wall below and immediately adjacent to the back wall recess, the back wall recess having a forward wall portion protruding forward beyond the upper and lower portions of the back wall.

51. The utility box of claim 50, wherein the first and second side wall recess portions and the back wall recess portion together define a channel having laterally open first and second channel ends and a rearwardly open opening extending between the first and second channel ends.

52. The utility box of claim 49, wherein the first and second side wall recess portions and the back wall recess portion together define a channel extending between the first and second side walls.

53. The utility box of claim 52, wherein the channel is elongated and extends fully between the first and second side walls.

54. The utility box of claim 52, wherein the channel extends at least partially between the first and second side walls.

55. The utility box of claim 49, wherein the back wall recess is defined by a recess defining portion of the back wall, and when the support member is within the first and second side wall recess portions and the back wall recess portion, at least a portion of the recess defining portion of the back wall is positioned to be in supported engagement with the support member.

56. The utility box of claim 49, wherein a portion of the back wall is positioned to be in supported engagement with the support member when the support member is positioned within the first and second side wall recess portions and the back wall recess portion.

57. The utility box of claim 49, wherein the back wall has a planar back wall portion and a forwardly protruding back wall portion, the forwardly protruding back wall portion protruding forward beyond the planar back wall portion and defining the back wall recess.

58. A utility box for being mounting at least in part within a wall having an interior wall space defined between first and second spaced-apart, upright wall studs, with a support member positioned within the wall space and extending between the first and second wall studs, with a first end portion of the support member attached to the first wall stud and a second end portion of the support member attached to the second wall stud, the box comprising:

a housing including a first side wall, a second side wall, a back wall and a front opening providing access into an interior of the housing, the first and second side walls being spaced apart, the back wall extending between the first and second side walls, the housing being sized such that first side wall is laterally inward of the first wall stud and the second side wall is laterally inward of the second wall stud, the back wall having a back wall recess portion extending at least partially between the first and second side walls, the back wall has an upper back wall portion and a forwardly protruding back wall portion located below the upper back wall portion, the forwardly protruding back wall portion protruding forward beyond the upper back wall portion and defining the back wall recess, the back wall recess portion having a laterally open first back wall end portion and a laterally open second back wall end portion, the back wall recess portion having a rearwardly open opening, the back wall recess portion being oriented to permit the box to be moved rearwardly into the wall space, and sized so that as moved rearwardly the support member is received through the rearwardly open opening of the back wall recess portion, and moved at least partially into the back wall recess portion with the first end portion of the support member extending laterally outward beyond the laterally open first back wall end portion and beyond the first side wall, and the second end portion of the support member extending laterally outward beyond the laterally open second back wall end portion and beyond the second side wall, and when the support member is within the back wall recess portion, at least a portion of the weight of the box is supported by the support member.

59. The utility box of claim 58, wherein the back wall portion includes a lower back wall portion, the forwardly protruding back wall portion being located above the lower back wall portion and protruding forward beyond the lower back wall portion, the upper and lower back wall portions being planar.

60. The utility box of claim 58, wherein the forwardly protruding back wall portion is positioned to be in supported engagement with the support member when the support member is positioned within the back wall recess portion.

61. The utility box of claim 58, wherein the first and second side walls each having a rearward portion, the rearward portion of the first side wall having a laterally open first side wall recess portion with a rearwardly open opening and the rearward portion of the second side wall having a laterally open second side wall recess portion with a rearwardly open opening, the first side wall recess portion being in alignment with the laterally open first back wall end portion and the second side wall recess portion being in alignment with the laterally open second back wall end portion, and the forwardly protruding back wall portion extends fully between the first and second side walls.

* * * * *